US010030328B2

(12) United States Patent
Lonati et al.

(10) Patent No.: US 10,030,328 B2
(45) Date of Patent: Jul. 24, 2018

(54) PROCESS FOR PRODUCTION OF KNITTED ARTICLES

(71) Applicant: KARL MAYER Textilmaschinenfabrik GmbH, Obertshausen (DE)

(72) Inventors: Ettore Lonati, Botticino (IT); Fausto Lonati, Brescia (IT); Andrea Lonati, Brescia (IT); Mauro Alghisi, Torbole Casaglia (IT); Giovanni Vignoni, Brescia (IT)

(73) Assignee: KARL MAYER TEXTILMASCHINENFABRIK GMBH, Obertshausen (DE)

( * ) Notice: Subject to any disclaimer, the term of this patent is extended or adjusted under 35 U.S.C. 154(b) by 0 days.

(21) Appl. No.: 15/301,556

(22) PCT Filed: Mar. 25, 2015

(86) PCT No.: PCT/IB2015/052193
§ 371 (c)(1),
(2) Date: Oct. 3, 2016

(87) PCT Pub. No.: WO2015/150981
PCT Pub. Date: Oct. 8, 2015

(65) Prior Publication Data

US 2017/0107649 A1 Apr. 20, 2017

(30) Foreign Application Priority Data

Apr. 4, 2014 (IT) ..... BS2014A0080

(51) Int. Cl.
*D04B 21/08* (2006.01)
*D04B 21/04* (2006.01)
(Continued)

(52) U.S. Cl.
CPC ..... *D04B 21/08* (2013.01); *D04B 21/04* (2013.01); *D04B 21/207* (2013.01); *D04B 23/02* (2013.01); *D04B 27/12* (2013.01)

(58) Field of Classification Search
CPC ..... D04B 21/10; D04B 21/12; D04B 23/02; D04B 23/08; D04B 27/02
See application file for complete search history.

(56) References Cited

U.S. PATENT DOCUMENTS 3,834,193 A 9/1974 Wilkens
3,999,407 A * 12/1976 Odham ..... D04B 21/18 66/193

(Continued)

FOREIGN PATENT DOCUMENTS

DE 4312443 C1 9/1994
JP 2007308809 A 11/2007
WO 2004078067 A2 9/2004

*Primary Examiner* — Danny Worrell
(74) *Attorney, Agent, or Firm* — Jones Robb, PLLC

(57) ABSTRACT

A process for production of knitted articles is disclosed. The process may be performed using, for example, a linear knitting machine including a first needle bed, a second needle bed, a first jacquard bar with odd thread guides, a second jacquard bar with even thread guides, a third jacquard bar with odd thread guides, and a fourth jacquard bar with even thread guides. The process includes producing at least a portion of a knitted article by means of a base movement of the jacquard bars, in which: the first and the third jacquard bar are each moved with an identical shog movement; the second and the fourth jacquard bar are moved with a respective shog movement identical to one another; and the second and the fourth jacquard bar are moved with a respective shog movement identical to one another.

19 Claims, 36 Drawing Sheets

(51) Int. Cl.

| | |
|---|---|
| ***D04B 21/20*** | (2006.01) |
| ***D04B 23/02*** | (2006.01) |
| ***D04B 27/12*** | (2006.01) |

(56) References Cited

U.S. PATENT DOCUMENTS

| | | | | |
|---|---|---|---|---|
| 5,339,657 | A * | 8/1994 | McMurray | D04B 21/10 442/1 |
| 5,899,095 | A * | 5/1999 | Spillane | D04B 21/06 66/195 |
| 7,293,433 | B1 * | 11/2007 | McMurray | D04B 21/10 66/170 |
| 8,746,014 | B2 * | 6/2014 | Mortarino | A61F 2/0063 66/170 |
| 9,416,471 | B2 * | 8/2016 | Trabucco | D04B 21/12 |

* cited by examiner

1F - CLOSE

3B - CLOSE

2F - CLOSE

4B - CLOSE

1F - OPEN

3B - OPEN

2F - OPEN

4B - OPEN

| | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|
| 27 | B | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 |
| | F | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 |
| 26 | B | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 |
| | F | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 |
| 25 | B | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 |
| | F | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 |
| 24 | B | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 |
| | F | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 |
| 23 | B | 10 | 10 | 10 | 10 | 25 | 25 | 11 | 11 | 11 | 12 | 12 | 10 | 10 | 10 | 10 | 10 | 10 | 10 | 25 | 25 | 11 | 11 | 11 | 12 | 12 | 10 | 10 | 10 | 10 | 10 |
| | F | 12 | 12 | 12 | 12 | 23 | 23 | 11 | 11 | 11 | 26 | 24 | 12 | 12 | 12 | 12 | 12 | 12 | 12 | 23 | 23 | 11 | 11 | 11 | 26 | 24 | 12 | 12 | 12 | 12 | 12 |
| 22 | B | 10 | 10 | 10 | 10 | 25 | 25 | 21 | 21 | 21 | 21 | 12 | 12 | 10 | 10 | 10 | 10 | 10 | 10 | 10 | 10 | 25 | 25 | 21 | 21 | 21 | 12 | 12 | 10 | 10 | 10 | 10 |
| | F | 12 | 12 | 12 | 12 | 23 | 23 | 11 | 11 | 11 | 11 | 26 | 24 | 12 | 12 | 12 | 12 | 12 | 12 | 12 | 12 | 23 | 23 | 11 | 11 | 11 | 26 | 24 | 12 | 12 | 12 | 12 |
| 21 | B | 10 | 10 | 10 | 10 | 25 | 25 | 21 | 21 | 21 | 21 | 21 | 12 | 12 | 10 | 10 | 10 | 10 | 10 | 10 | 10 | 25 | 25 | 21 | 21 | 21 | 12 | 12 | 10 | 10 | 10 | 10 |
| | F | 12 | 12 | 12 | 12 | 23 | 23 | 11 | 11 | 11 | 11 | 11 | 26 | 24 | 12 | 12 | 12 | 12 | 12 | 12 | 12 | 23 | 23 | 11 | 11 | 11 | 26 | 24 | 12 | 12 | 12 | 12 |
| 20 | B | 10 | 10 | 10 | 10 | 25 | 25 | 21 | 21 | 21 | 21 | 21 | 21 | 12 | 12 | 10 | 10 | 10 | 10 | 10 | 10 | 25 | 25 | 21 | 21 | 21 | 12 | 12 | 10 | 10 | 10 | 10 |
| | F | 12 | 12 | 12 | 12 | 23 | 23 | 11 | 11 | 11 | 11 | 11 | 11 | 26 | 24 | 12 | 12 | 12 | 12 | 12 | 12 | 23 | 23 | 11 | 11 | 11 | 26 | 24 | 12 | 12 | 12 | 12 |
| 19 | B | 10 | 10 | 10 | 10 | 25 | 25 | 21 | 21 | 21 | 21 | 21 | 21 | 21 | 12 | 12 | 10 | 10 | 10 | 10 | 10 | 25 | 25 | 21 | 21 | 21 | 12 | 12 | 10 | 10 | 10 | 10 |
| | F | 12 | 12 | 12 | 12 | 23 | 23 | 11 | 11 | 11 | 11 | 11 | 11 | 11 | 26 | 24 | 12 | 12 | 12 | 12 | 12 | 23 | 23 | 11 | 11 | 11 | 26 | 24 | 12 | 12 | 12 | 12 |
| 18 | B | 10 | 10 | 10 | 10 | 25 | 25 | 21 | 21 | 21 | 21 | 21 | 21 | 21 | 21 | 12 | 12 | 10 | 10 | 10 | 10 | 25 | 25 | 21 | 21 | 21 | 12 | 12 | 10 | 10 | 10 | 10 |
| | F | 12 | 12 | 12 | 12 | 23 | 23 | 11 | 11 | 11 | 11 | 11 | 11 | 11 | 11 | 26 | 24 | 12 | 12 | 12 | 12 | 23 | 23 | 11 | 11 | 11 | 26 | 24 | 12 | 12 | 12 | 12 |
| 17 | B | 10 | 10 | 10 | 10 | 25 | 25 | 21 | 21 | 21 | 21 | 21 | 21 | 21 | 21 | 21 | 12 | 12 | 10 | 10 | 10 | 25 | 25 | 21 | 21 | 21 | 12 | 12 | 10 | 10 | 10 | 10 |
| | F | 12 | 12 | 12 | 12 | 23 | 23 | 11 | 11 | 11 | 11 | 11 | 11 | 11 | 11 | 11 | 26 | 24 | 12 | 12 | 12 | 23 | 23 | 11 | 11 | 11 | 26 | 24 | 12 | 12 | 12 | 12 |
| 16 | B | 10 | 10 | 10 | 10 | 25 | 25 | 21 | 21 | 21 | 21 | 21 | 21 | 21 | 21 | 21 | 21 | 12 | 12 | 10 | 25 | 25 | 21 | 21 | 21 | 12 | 12 | 10 | 10 | 10 | 10 |
| | F | 12 | 12 | 12 | 12 | 23 | 23 | 11 | 11 | 11 | 11 | 11 | 11 | 11 | 11 | 11 | 26 | 24 | 12 | 23 | 23 | 11 | 11 | 11 | 26 | 24 | 12 | 12 | 12 | 12 | 12 |
| 15 | B | 10 | 10 | 10 | 10 | 25 | 25 | 21 | 21 | 21 | 21 | 21 | 21 | 21 | 21 | 21 | 21 | 21 | 12 | 12 | 25 | 25 | 21 | 21 | 21 | 12 | 12 | 10 | 10 | 10 | 10 |
| | F | 12 | 12 | 12 | 12 | 23 | 23 | 11 | 11 | 11 | 11 | 11 | 11 | 11 | 11 | 11 | 11 | 26 | 24 | 23 | 23 | 11 | 11 | 11 | 26 | 24 | 12 | 12 | 12 | 12 | 12 |
| 14 | B | 10 | 10 | 10 | 10 | 25 | 25 | 21 | 21 | 21 | 21 | 21 | 21 | 21 | 21 | 21 | 21 | 21 | 21 | 21 | 21 | 21 | 21 | 21 | 21 | 12 | 12 | 10 | 10 | 10 | 10 |
| | F | 12 | 12 | 12 | 12 | 23 | 23 | 11 | 11 | 11 | 11 | 11 | 11 | 11 | 11 | 11 | 11 | 11 | 11 | 11 | 11 | 11 | 11 | 11 | 11 | 26 | 24 | 12 | 12 | 12 | 12 |
| 13 | B | 10 | 10 | 10 | 10 | 25 | 25 | 21 | 21 | 21 | 21 | 12 | 12 | 25 | 25 | 21 | 21 | 21 | 21 | 21 | 21 | 21 | 21 | 21 | 21 | 12 | 12 | 10 | 10 | 10 | 10 |
| | F | 12 | 12 | 12 | 12 | 23 | 23 | 11 | 11 | 11 | 11 | 26 | 24 | 23 | 23 | 11 | 11 | 11 | 11 | 11 | 11 | 11 | 11 | 11 | 11 | 26 | 24 | 12 | 12 | 12 | 12 |
| 12 | B | 10 | 10 | 10 | 10 | 25 | 25 | 21 | 21 | 21 | 21 | 12 | 12 | 10 | 25 | 25 | 21 | 21 | 21 | 21 | 21 | 21 | 21 | 21 | 21 | 12 | 12 | 10 | 10 | 10 | 10 |
| | F | 12 | 12 | 12 | 12 | 23 | 23 | 11 | 11 | 11 | 11 | 26 | 24 | 12 | 23 | 23 | 11 | 11 | 11 | 11 | 11 | 11 | 11 | 11 | 11 | 26 | 24 | 12 | 12 | 12 | 12 |
| 11 | B | 10 | 10 | 10 | 10 | 25 | 25 | 21 | 21 | 21 | 21 | 12 | 12 | 10 | 10 | 25 | 25 | 21 | 21 | 21 | 21 | 21 | 21 | 21 | 21 | 12 | 12 | 10 | 10 | 10 | 10 |
| | F | 12 | 12 | 12 | 12 | 23 | 23 | 11 | 11 | 11 | 11 | 26 | 24 | 12 | 12 | 23 | 23 | 11 | 11 | 11 | 11 | 11 | 11 | 11 | 11 | 26 | 24 | 12 | 12 | 12 | 12 |
| 10 | B | 10 | 10 | 10 | 10 | 25 | 25 | 21 | 21 | 21 | 21 | 12 | 12 | 10 | 10 | 10 | 25 | 25 | 21 | 21 | 21 | 21 | 21 | 21 | 21 | 12 | 12 | 10 | 10 | 10 | 10 |
| | F | 12 | 12 | 12 | 12 | 23 | 23 | 11 | 11 | 11 | 11 | 26 | 24 | 12 | 12 | 12 | 23 | 23 | 11 | 11 | 11 | 11 | 11 | 11 | 11 | 26 | 24 | 12 | 12 | 12 | 12 |
| 9 | B | 10 | 10 | 10 | 10 | 25 | 25 | 21 | 21 | 21 | 21 | 12 | 12 | 10 | 10 | 10 | 10 | 25 | 25 | 21 | 21 | 21 | 21 | 21 | 21 | 12 | 12 | 10 | 10 | 10 | 10 |
| | F | 12 | 12 | 12 | 12 | 23 | 23 | 11 | 11 | 11 | 11 | 26 | 24 | 12 | 12 | 12 | 12 | 23 | 23 | 11 | 11 | 11 | 11 | 11 | 11 | 26 | 24 | 12 | 12 | 12 | 12 |
| 8 | B | 10 | 10 | 10 | 10 | 25 | 25 | 21 | 21 | 21 | 21 | 12 | 12 | 10 | 10 | 10 | 10 | 10 | 25 | 25 | 21 | 21 | 21 | 21 | 21 | 12 | 12 | 10 | 10 | 10 | 10 |
| | F | 12 | 12 | 12 | 12 | 23 | 23 | 11 | 11 | 11 | 11 | 26 | 24 | 12 | 12 | 12 | 12 | 12 | 23 | 23 | 11 | 11 | 11 | 11 | 11 | 26 | 24 | 12 | 12 | 12 | 12 |
| 7 | B | 10 | 10 | 10 | 10 | 25 | 25 | 21 | 21 | 21 | 21 | 12 | 12 | 10 | 10 | 10 | 10 | 10 | 10 | 25 | 25 | 21 | 21 | 21 | 21 | 12 | 12 | 10 | 10 | 10 | 10 |
| | F | 12 | 12 | 12 | 12 | 23 | 23 | 11 | 11 | 11 | 11 | 26 | 24 | 12 | 12 | 12 | 12 | 12 | 12 | 23 | 23 | 11 | 11 | 11 | 11 | 26 | 24 | 12 | 12 | 12 | 12 |
| 6 | B | 10 | 10 | 10 | 10 | 25 | 25 | 21 | 21 | 21 | 21 | 12 | 12 | 10 | 10 | 10 | 10 | 10 | 10 | 10 | 25 | 25 | 21 | 21 | 21 | 12 | 12 | 10 | 10 | 10 | 10 |
| | F | 12 | 12 | 12 | 12 | 23 | 23 | 11 | 11 | 11 | 11 | 26 | 24 | 12 | 12 | 12 | 12 | 12 | 12 | 12 | 23 | 23 | 11 | 11 | 11 | 26 | 24 | 12 | 12 | 12 | 12 |
| 5 | B | 10 | 10 | 10 | 10 | 25 | 25 | 21 | 21 | 21 | 21 | 12 | 12 | 10 | 10 | 10 | 10 | 10 | 10 | 10 | 10 | 25 | 25 | 21 | 21 | 12 | 12 | 10 | 10 | 10 | 10 |
| | F | 12 | 12 | 12 | 12 | 23 | 23 | 11 | 11 | 11 | 11 | 26 | 24 | 12 | 12 | 12 | 12 | 12 | 12 | 12 | 12 | 23 | 23 | 11 | 11 | 26 | 24 | 12 | 12 | 12 | 12 |
| 4 | B | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 |
| | F | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 |
| 3 | B | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 |
| | F | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 |
| 2 | B | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 |
| | F | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 |
| 1 | B | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 |
| | F | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 |

FIG.18

| | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|
| 27 | B | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 |
| | F | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 |
| 26 | B | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 |
| | F | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 |
| 25 | B | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 |
| | F | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 |
| 24 | B | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 |
| | F | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 |
| 23 | B | 10 | 10 | 10 | 10 | 10 | 28 | 28 | 28 | 28 | 28 | 10 | 10 | 10 | 10 | 10 | 10 | 10 | 10 | 10 | 10 | 28 | 28 | 28 | 28 | 28 | 10 | 10 | 10 | 10 | 10 |
| | F | 12 | 12 | 12 | 12 | 12 | 11 | 11 | 11 | 11 | 11 | 12 | 12 | 12 | 12 | 12 | 12 | 12 | 12 | 12 | 12 | 11 | 11 | 11 | 11 | 11 | 12 | 12 | 12 | 12 | 12 |
| 22 | B | 10 | 10 | 10 | 10 | 10 | 28 | 28 | 28 | 28 | 28 | 28 | 10 | 10 | 10 | 10 | 10 | 10 | 10 | 10 | 10 | 28 | 28 | 28 | 28 | 28 | 10 | 10 | 10 | 10 | 10 |
| | F | 12 | 12 | 12 | 12 | 12 | 11 | 11 | 11 | 11 | 11 | 11 | 12 | 12 | 12 | 12 | 12 | 12 | 12 | 12 | 12 | 11 | 11 | 11 | 11 | 11 | 12 | 12 | 12 | 12 | 12 |
| 21 | B | 10 | 10 | 10 | 10 | 10 | 28 | 28 | 28 | 28 | 28 | 28 | 28 | 10 | 10 | 10 | 10 | 10 | 10 | 10 | 10 | 28 | 28 | 28 | 28 | 28 | 10 | 10 | 10 | 10 | 10 |
| | F | 12 | 12 | 12 | 12 | 12 | 11 | 11 | 11 | 11 | 11 | 11 | 11 | 12 | 12 | 12 | 12 | 12 | 12 | 12 | 12 | 11 | 11 | 11 | 11 | 11 | 12 | 12 | 12 | 12 | 12 |
| 20 | B | 10 | 10 | 10 | 10 | 10 | 28 | 28 | 28 | 28 | 28 | 28 | 28 | 28 | 10 | 10 | 10 | 10 | 10 | 10 | 10 | 28 | 28 | 28 | 28 | 28 | 10 | 10 | 10 | 10 | 10 |
| | F | 12 | 12 | 12 | 12 | 12 | 11 | 11 | 11 | 11 | 11 | 11 | 11 | 11 | 12 | 12 | 12 | 12 | 12 | 12 | 12 | 11 | 11 | 11 | 11 | 11 | 12 | 12 | 12 | 12 | 12 |
| 19 | B | 10 | 10 | 10 | 10 | 10 | 28 | 28 | 28 | 28 | 28 | 28 | 28 | 28 | 28 | 10 | 10 | 10 | 10 | 10 | 10 | 28 | 28 | 28 | 28 | 28 | 10 | 10 | 10 | 10 | 10 |
| | F | 12 | 12 | 12 | 12 | 12 | 11 | 11 | 11 | 11 | 11 | 11 | 11 | 11 | 11 | 12 | 12 | 12 | 12 | 12 | 12 | 11 | 11 | 11 | 11 | 11 | 12 | 12 | 12 | 12 | 12 |
| 18 | B | 10 | 10 | 10 | 10 | 10 | 28 | 28 | 28 | 28 | 28 | 28 | 28 | 28 | 28 | 28 | 10 | 10 | 10 | 10 | 10 | 28 | 28 | 28 | 28 | 28 | 10 | 10 | 10 | 10 | 10 |
| | F | 12 | 12 | 12 | 12 | 12 | 11 | 11 | 11 | 11 | 11 | 11 | 11 | 11 | 11 | 11 | 12 | 12 | 12 | 12 | 12 | 11 | 11 | 11 | 11 | 11 | 12 | 12 | 12 | 12 | 12 |
| 17 | B | 10 | 10 | 10 | 10 | 10 | 28 | 28 | 28 | 28 | 28 | 28 | 28 | 28 | 28 | 28 | 28 | 10 | 10 | 10 | 10 | 28 | 28 | 28 | 28 | 28 | 10 | 10 | 10 | 10 | 10 |
| | F | 12 | 12 | 12 | 12 | 12 | 11 | 11 | 11 | 11 | 11 | 11 | 11 | 11 | 11 | 11 | 11 | 12 | 12 | 12 | 12 | 11 | 11 | 11 | 11 | 11 | 12 | 12 | 12 | 12 | 12 |
| 16 | B | 10 | 10 | 10 | 10 | 10 | 28 | 28 | 28 | 28 | 28 | 28 | 28 | 28 | 28 | 28 | 28 | 28 | 10 | 10 | 10 | 28 | 28 | 28 | 28 | 28 | 10 | 10 | 10 | 10 | 10 |
| | F | 12 | 12 | 12 | 12 | 12 | 11 | 11 | 11 | 11 | 11 | 11 | 11 | 11 | 11 | 11 | 11 | 11 | 12 | 12 | 12 | 11 | 11 | 11 | 11 | 11 | 12 | 12 | 12 | 12 | 12 |
| 15 | B | 10 | 10 | 10 | 10 | 10 | 28 | 28 | 28 | 28 | 28 | 28 | 28 | 28 | 28 | 28 | 28 | 28 | 28 | 10 | 10 | 28 | 28 | 28 | 28 | 28 | 10 | 10 | 10 | 10 | 10 |
| | F | 12 | 12 | 12 | 12 | 12 | 11 | 11 | 11 | 11 | 11 | 11 | 11 | 11 | 11 | 11 | 11 | 11 | 11 | 12 | 12 | 11 | 11 | 11 | 11 | 11 | 12 | 12 | 12 | 12 | 12 |
| 14 | B | 10 | 10 | 10 | 10 | 10 | 28 | 28 | 28 | 28 | 28 | 28 | 28 | 28 | 28 | 28 | 28 | 28 | 28 | 28 | 28 | 28 | 28 | 28 | 28 | 28 | 10 | 10 | 10 | 10 | 10 |
| | F | 12 | 12 | 12 | 12 | 12 | 11 | 11 | 11 | 11 | 11 | 11 | 11 | 11 | 11 | 11 | 11 | 11 | 11 | 11 | 11 | 11 | 11 | 11 | 11 | 11 | 12 | 12 | 12 | 12 | 12 |
| 13 | B | 10 | 10 | 10 | 10 | 10 | 28 | 28 | 28 | 28 | 28 | 28 | 10 | 10 | 28 | 28 | 28 | 28 | 28 | 28 | 28 | 28 | 28 | 28 | 28 | 28 | 10 | 10 | 10 | 10 | 10 |
| | F | 12 | 12 | 12 | 12 | 12 | 11 | 11 | 11 | 11 | 11 | 11 | 12 | 12 | 11 | 11 | 11 | 11 | 11 | 11 | 11 | 11 | 11 | 11 | 11 | 11 | 12 | 12 | 12 | 12 | 12 |
| 12 | B | 10 | 10 | 10 | 10 | 10 | 28 | 28 | 28 | 28 | 28 | 28 | 10 | 10 | 10 | 28 | 28 | 28 | 28 | 28 | 28 | 28 | 28 | 28 | 28 | 28 | 10 | 10 | 10 | 10 | 10 |
| | F | 12 | 12 | 12 | 12 | 12 | 11 | 11 | 11 | 11 | 11 | 11 | 12 | 12 | 12 | 11 | 11 | 11 | 11 | 11 | 11 | 11 | 11 | 11 | 11 | 11 | 12 | 12 | 12 | 12 | 12 |
| 11 | B | 10 | 10 | 10 | 10 | 10 | 28 | 28 | 28 | 28 | 28 | 28 | 10 | 10 | 10 | 10 | 28 | 28 | 28 | 28 | 28 | 28 | 28 | 28 | 28 | 28 | 10 | 10 | 10 | 10 | 10 |
| | F | 12 | 12 | 12 | 12 | 12 | 11 | 11 | 11 | 11 | 11 | 11 | 12 | 12 | 12 | 12 | 11 | 11 | 11 | 11 | 11 | 11 | 11 | 11 | 11 | 11 | 12 | 12 | 12 | 12 | 12 |
| 10 | B | 10 | 10 | 10 | 10 | 10 | 28 | 28 | 28 | 28 | 28 | 28 | 10 | 10 | 10 | 10 | 10 | 28 | 28 | 28 | 28 | 28 | 28 | 28 | 28 | 28 | 10 | 10 | 10 | 10 | 10 |
| | F | 12 | 12 | 12 | 12 | 12 | 11 | 11 | 11 | 11 | 11 | 11 | 12 | 12 | 12 | 12 | 12 | 11 | 11 | 11 | 11 | 11 | 11 | 11 | 11 | 11 | 12 | 12 | 12 | 12 | 12 |
| 9 | B | 10 | 10 | 10 | 10 | 10 | 28 | 28 | 28 | 28 | 28 | 28 | 10 | 10 | 10 | 10 | 10 | 10 | 28 | 28 | 28 | 28 | 28 | 28 | 28 | 28 | 10 | 10 | 10 | 10 | 10 |
| | F | 12 | 12 | 12 | 12 | 12 | 11 | 11 | 11 | 11 | 11 | 11 | 12 | 12 | 12 | 12 | 12 | 12 | 11 | 11 | 11 | 11 | 11 | 11 | 11 | 11 | 12 | 12 | 12 | 12 | 12 |
| 8 | B | 10 | 10 | 10 | 10 | 10 | 28 | 28 | 28 | 28 | 28 | 28 | 10 | 10 | 10 | 10 | 10 | 10 | 10 | 28 | 28 | 28 | 28 | 28 | 28 | 28 | 10 | 10 | 10 | 10 | 10 |
| | F | 12 | 12 | 12 | 12 | 12 | 11 | 11 | 11 | 11 | 11 | 11 | 12 | 12 | 12 | 12 | 12 | 12 | 12 | 11 | 11 | 11 | 11 | 11 | 11 | 11 | 12 | 12 | 12 | 12 | 12 |
| 7 | B | 10 | 10 | 10 | 10 | 10 | 28 | 28 | 28 | 28 | 28 | 28 | 10 | 10 | 10 | 10 | 10 | 10 | 10 | 10 | 28 | 28 | 28 | 28 | 28 | 28 | 10 | 10 | 10 | 10 | 10 |
| | F | 12 | 12 | 12 | 12 | 12 | 11 | 11 | 11 | 11 | 11 | 11 | 12 | 12 | 12 | 12 | 12 | 12 | 12 | 12 | 11 | 11 | 11 | 11 | 11 | 11 | 12 | 12 | 12 | 12 | 12 |
| 6 | B | 10 | 10 | 10 | 10 | 10 | 28 | 28 | 28 | 28 | 28 | 28 | 10 | 10 | 10 | 10 | 10 | 10 | 10 | 10 | 10 | 28 | 28 | 28 | 28 | 28 | 10 | 10 | 10 | 10 | 10 |
| | F | 12 | 12 | 12 | 12 | 12 | 11 | 11 | 11 | 11 | 11 | 11 | 12 | 12 | 12 | 12 | 12 | 12 | 12 | 12 | 12 | 11 | 11 | 11 | 11 | 11 | 12 | 12 | 12 | 12 | 12 |
| 5 | B | 10 | 10 | 10 | 10 | 10 | 28 | 28 | 28 | 28 | 28 | 28 | 10 | 10 | 10 | 10 | 10 | 10 | 10 | 10 | 10 | 10 | 28 | 28 | 28 | 28 | 10 | 10 | 10 | 10 | 10 |
| | F | 12 | 12 | 12 | 12 | 12 | 11 | 11 | 11 | 11 | 11 | 11 | 12 | 12 | 12 | 12 | 12 | 12 | 12 | 12 | 12 | 12 | 11 | 11 | 11 | 11 | 12 | 12 | 12 | 12 | 12 |
| 4 | B | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 |
| | F | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 |
| 3 | B | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 |
| | F | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 |
| 2 | B | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 |
| | F | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 |
| 1 | B | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 |
| | F | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 | 12 |

FIG.27

| | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|
| 27 | B | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 |
| | F | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 |
| 26 | B | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 |
| | F | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 |
| 25 | B | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 |
| | F | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 |
| 24 | B | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 |
| | F | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 |
| 23 | B | 10 | 10 | 10 | 10 | 10 | 28 | 28 | 28 | 28 | 28 | 10 | 10 | 10 | 10 | 10 | 10 | 10 | 10 | 10 | 28 | 28 | 28 | 28 | 28 | 10 | 10 | 10 | 10 | 10 | 10 |
| | F | 28 | 28 | 28 | 28 | 28 | 11 | 11 | 11 | 11 | 11 | 28 | 28 | 28 | 28 | 28 | 28 | 28 | 28 | 28 | 11 | 11 | 11 | 11 | 11 | 28 | 28 | 28 | 28 | 28 | 28 |
| 22 | B | 10 | 10 | 10 | 10 | 10 | 28 | 28 | 28 | 28 | 28 | 28 | 10 | 10 | 10 | 10 | 10 | 10 | 10 | 10 | 10 | 28 | 28 | 28 | 28 | 28 | 10 | 10 | 10 | 10 | 10 |
| | F | 28 | 28 | 28 | 28 | 28 | 11 | 11 | 11 | 11 | 11 | 11 | 28 | 28 | 28 | 28 | 28 | 28 | 28 | 28 | 28 | 11 | 11 | 11 | 11 | 11 | 28 | 28 | 28 | 28 | 28 |
| 21 | B | 10 | 10 | 10 | 10 | 10 | 28 | 28 | 28 | 28 | 28 | 28 | 28 | 10 | 10 | 10 | 10 | 10 | 10 | 10 | 10 | 28 | 28 | 28 | 28 | 28 | 10 | 10 | 10 | 10 | 10 |
| | F | 28 | 28 | 28 | 28 | 28 | 11 | 11 | 11 | 11 | 11 | 11 | 11 | 28 | 28 | 28 | 28 | 28 | 28 | 28 | 28 | 11 | 11 | 11 | 11 | 11 | 28 | 28 | 28 | 28 | 28 |
| 20 | B | 10 | 10 | 10 | 10 | 10 | 28 | 28 | 28 | 28 | 28 | 28 | 28 | 28 | 10 | 10 | 10 | 10 | 10 | 10 | 10 | 28 | 28 | 28 | 28 | 28 | 10 | 10 | 10 | 10 | 10 |
| | F | 28 | 28 | 28 | 28 | 28 | 11 | 11 | 11 | 11 | 11 | 11 | 11 | 11 | 28 | 28 | 28 | 28 | 28 | 28 | 28 | 11 | 11 | 11 | 11 | 11 | 28 | 28 | 28 | 28 | 28 |
| 19 | B | 10 | 10 | 10 | 10 | 10 | 28 | 28 | 28 | 28 | 28 | 28 | 28 | 28 | 28 | 10 | 10 | 10 | 10 | 10 | 10 | 28 | 28 | 28 | 28 | 28 | 10 | 10 | 10 | 10 | 10 |
| | F | 28 | 28 | 28 | 28 | 28 | 11 | 11 | 11 | 11 | 11 | 11 | 11 | 11 | 11 | 28 | 28 | 28 | 28 | 28 | 28 | 11 | 11 | 11 | 11 | 11 | 28 | 28 | 28 | 28 | 28 |
| 18 | B | 10 | 10 | 10 | 10 | 10 | 28 | 28 | 28 | 28 | 28 | 28 | 28 | 28 | 28 | 28 | 10 | 10 | 10 | 10 | 10 | 28 | 28 | 28 | 28 | 28 | 10 | 10 | 10 | 10 | 10 |
| | F | 28 | 28 | 28 | 28 | 28 | 11 | 11 | 11 | 11 | 11 | 11 | 11 | 11 | 11 | 11 | 28 | 28 | 28 | 28 | 28 | 11 | 11 | 11 | 11 | 11 | 28 | 28 | 28 | 28 | 28 |
| 17 | B | 10 | 10 | 10 | 10 | 10 | 28 | 28 | 28 | 28 | 28 | 28 | 28 | 28 | 28 | 28 | 28 | 10 | 10 | 10 | 10 | 28 | 28 | 28 | 28 | 28 | 10 | 10 | 10 | 10 | 10 |
| | F | 28 | 28 | 28 | 28 | 28 | 11 | 11 | 11 | 11 | 11 | 11 | 11 | 11 | 11 | 11 | 11 | 28 | 28 | 28 | 28 | 11 | 11 | 11 | 11 | 11 | 28 | 28 | 28 | 28 | 28 |
| 16 | B | 10 | 10 | 10 | 10 | 10 | 28 | 28 | 28 | 28 | 28 | 28 | 28 | 28 | 28 | 28 | 28 | 28 | 10 | 10 | 10 | 28 | 28 | 28 | 28 | 28 | 10 | 10 | 10 | 10 | 10 |
| | F | 28 | 28 | 28 | 28 | 28 | 11 | 11 | 11 | 11 | 11 | 11 | 11 | 11 | 11 | 11 | 11 | 11 | 28 | 28 | 28 | 11 | 11 | 11 | 11 | 11 | 28 | 28 | 28 | 28 | 28 |
| 15 | B | 10 | 10 | 10 | 10 | 10 | 28 | 28 | 28 | 28 | 28 | 28 | 28 | 28 | 28 | 28 | 28 | 28 | 28 | 10 | 10 | 28 | 28 | 28 | 28 | 28 | 10 | 10 | 10 | 10 | 10 |
| | F | 28 | 28 | 28 | 28 | 28 | 11 | 11 | 11 | 11 | 11 | 11 | 11 | 11 | 11 | 11 | 11 | 11 | 11 | 28 | 28 | 11 | 11 | 11 | 11 | 11 | 28 | 28 | 28 | 28 | 28 |
| 14 | B | 10 | 10 | 10 | 10 | 10 | 28 | 28 | 28 | 28 | 28 | 28 | 28 | 28 | 28 | 28 | 28 | 28 | 28 | 28 | 28 | 28 | 28 | 28 | 28 | 28 | 10 | 10 | 10 | 10 | 10 |
| | F | 28 | 28 | 28 | 28 | 28 | 11 | 11 | 11 | 11 | 11 | 11 | 11 | 11 | 11 | 11 | 11 | 11 | 11 | 11 | 11 | 11 | 11 | 11 | 11 | 11 | 28 | 28 | 28 | 28 | 28 |
| 13 | B | 10 | 10 | 10 | 10 | 10 | 28 | 28 | 28 | 28 | 28 | 28 | 10 | 10 | 28 | 28 | 28 | 28 | 28 | 28 | 28 | 28 | 28 | 28 | 28 | 28 | 10 | 10 | 10 | 10 | 10 |
| | F | 28 | 28 | 28 | 28 | 28 | 11 | 11 | 11 | 11 | 11 | 11 | 28 | 28 | 11 | 11 | 11 | 11 | 11 | 11 | 11 | 11 | 11 | 11 | 11 | 11 | 28 | 28 | 28 | 28 | 28 |
| 12 | B | 10 | 10 | 10 | 10 | 10 | 28 | 28 | 28 | 28 | 28 | 28 | 10 | 10 | 10 | 28 | 28 | 28 | 28 | 28 | 28 | 28 | 28 | 28 | 28 | 28 | 10 | 10 | 10 | 10 | 10 |
| | F | 28 | 28 | 28 | 28 | 28 | 11 | 11 | 11 | 11 | 11 | 11 | 28 | 28 | 28 | 11 | 11 | 11 | 11 | 11 | 11 | 11 | 11 | 11 | 11 | 11 | 28 | 28 | 28 | 28 | 28 |
| 11 | B | 10 | 10 | 10 | 10 | 10 | 28 | 28 | 28 | 28 | 28 | 28 | 10 | 10 | 10 | 10 | 28 | 28 | 28 | 28 | 28 | 28 | 28 | 28 | 28 | 28 | 10 | 10 | 10 | 10 | 10 |
| | F | 28 | 28 | 28 | 28 | 28 | 11 | 11 | 11 | 11 | 11 | 11 | 28 | 28 | 28 | 28 | 11 | 11 | 11 | 11 | 11 | 11 | 11 | 11 | 11 | 11 | 28 | 28 | 28 | 28 | 28 |
| 10 | B | 10 | 10 | 10 | 10 | 10 | 28 | 28 | 28 | 28 | 28 | 28 | 10 | 10 | 10 | 10 | 10 | 28 | 28 | 28 | 28 | 28 | 28 | 28 | 28 | 28 | 10 | 10 | 10 | 10 | 10 |
| | F | 28 | 28 | 28 | 28 | 28 | 11 | 11 | 11 | 11 | 11 | 11 | 28 | 28 | 28 | 28 | 28 | 11 | 11 | 11 | 11 | 11 | 11 | 11 | 11 | 11 | 28 | 28 | 28 | 28 | 28 |
| 9 | B | 10 | 10 | 10 | 10 | 10 | 28 | 28 | 28 | 28 | 28 | 28 | 10 | 10 | 10 | 10 | 10 | 10 | 28 | 28 | 28 | 28 | 28 | 28 | 28 | 28 | 10 | 10 | 10 | 10 | 10 |
| | F | 28 | 28 | 28 | 28 | 28 | 11 | 11 | 11 | 11 | 11 | 11 | 28 | 28 | 28 | 28 | 28 | 28 | 11 | 11 | 11 | 11 | 11 | 11 | 11 | 11 | 28 | 28 | 28 | 28 | 28 |
| 8 | B | 10 | 10 | 10 | 10 | 10 | 28 | 28 | 28 | 28 | 28 | 28 | 10 | 10 | 10 | 10 | 10 | 10 | 10 | 28 | 28 | 28 | 28 | 28 | 28 | 28 | 10 | 10 | 10 | 10 | 10 |
| | F | 28 | 28 | 28 | 28 | 28 | 11 | 11 | 11 | 11 | 11 | 11 | 28 | 28 | 28 | 28 | 28 | 28 | 28 | 11 | 11 | 11 | 11 | 11 | 11 | 11 | 28 | 28 | 28 | 28 | 28 |
| 7 | B | 10 | 10 | 10 | 10 | 10 | 28 | 28 | 28 | 28 | 28 | 28 | 10 | 10 | 10 | 10 | 10 | 10 | 10 | 10 | 28 | 28 | 28 | 28 | 28 | 28 | 10 | 10 | 10 | 10 | 10 |
| | F | 28 | 28 | 28 | 28 | 28 | 11 | 11 | 11 | 11 | 11 | 11 | 28 | 28 | 28 | 28 | 28 | 28 | 28 | 28 | 11 | 11 | 11 | 11 | 11 | 11 | 28 | 28 | 28 | 28 | 28 |
| 6 | B | 10 | 10 | 10 | 10 | 10 | 28 | 28 | 28 | 28 | 28 | 28 | 10 | 10 | 10 | 10 | 10 | 10 | 10 | 10 | 28 | 28 | 28 | 28 | 28 | 10 | 10 | 10 | 10 | 10 | 10 |
| | F | 28 | 28 | 28 | 28 | 28 | 11 | 11 | 11 | 11 | 11 | 11 | 28 | 28 | 28 | 28 | 28 | 28 | 28 | 28 | 11 | 11 | 11 | 11 | 11 | 28 | 28 | 28 | 28 | 28 | 28 |
| 5 | B | 10 | 10 | 10 | 10 | 10 | 28 | 28 | 28 | 28 | 28 | 28 | 10 | 10 | 10 | 10 | 10 | 10 | 10 | 10 | 10 | 28 | 28 | 28 | 28 | 10 | 10 | 10 | 10 | 10 | 10 |
| | F | 28 | 28 | 28 | 28 | 28 | 11 | 11 | 11 | 11 | 11 | 11 | 28 | 28 | 28 | 28 | 28 | 28 | 28 | 28 | 28 | 11 | 11 | 11 | 11 | 28 | 28 | 28 | 28 | 28 | 28 |
| 4 | B | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 |
| | F | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 |
| 3 | B | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 |
| | F | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 |
| 2 | B | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 |
| | F | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 |
| 1 | B | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 | 10 |
| | F | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 | 28 |

FIG.32

PROCESS FOR PRODUCTION OF KNITTED ARTICLES

This application is a national stage application under 35 U.S.C. § 371(c) of International Application No. PCT/IB2015/052193, filed on Mar. 25, 2015, which claims priority to Italian Application No. BS2014A000080, filed Apr. 4, 2014, the entire contents of each of which is incorporated by reference herein.

The present invention relates to a process for production of knitted articles. In particular, the invention relates to a process for production of knitted articles by means of a linear knitting machine for warp knitting, of a raschel type. The present invention further relates to a chain knitting machine for realizing the process and the knitted articles resulting from the process.

The present invention is applicable to the technical sector of linear knitting machines for warp knitting.

As is known, linear knitting machines for chain knitting are provided with a plurality of bars able to bear a plurality of thread-bearing elements commonly known as thread guides. The bars must be moved so as to enable the threads associated to the thread guides to be located correctly on the needles of the knitting machine for the formation of new knitting. The needles of the knitting machine are arranged in line on a single needle bed (in a case of a single-bed machine) or on two distinct beds that are parallel to one another (in the case of double-bed machines), typically known as the front bed and back bed.

To perform the knitting task, each thread guide bar performs two fundamental movements, i.e. a linear movement frontally or posteriorly of the tip of each needle, known as a shog movement, and an oscillating movement by a side of each needle so as to bring the threads alternatively in front of and behind the needle tip, known as swing.

Further, thread guide bars are known of a jacquard type (known as jacquard bars) which are provided with jacquard devices, which enable individually moving the single thread guides by an addition needle space, in the same direction or opposite directions, with respect to the shog movement of the bars. These jacquard devices can be of a mechanical type, a piezoelectric type or a pneumatic type.

Typically the displacements of the jacquard devices can be carried out both when the thread guide is in front of the needle tip (known as the overlap movement) and when it is behind the needle tip (known as the underlap movement), or when, by effect of the horizontal translation of the bar or shog, the guide displaces horizontally in both directions.

Consider a double-bed jacquard warp linear knitting machine of known type. The machine is provided with two needle beds (front bed or back bed) and four thread guide bars of a jacquard type: two jacquard bars are positioned at the front bed and two at the back bed. Conventionally, in each pair of jacquard bars a bar comprises "even" thread guides and the other bar comprises "odd" thread guides. By means of swing and shog movements, and by a jacquard selection of the single thread guides, each bar can supply, with the thread guides thereof, both the needles of the respective bed and the needles of the other bed. Further, the even and odd thread guides can supply different needles according to the state of activation of the respective jacquard bar.

Generally the base movement (i.e. the shog movement) of the jacquard bars is of the type schematically shown in FIG. 3 or FIG. 4: in substance, the two jacquard bars positioned at the front bed carry out the same movement or a phase opposition movement (i.e. equal and opposite, or "specular") and in turn the two jacquard bars positioned at the back bed carry out a respective same movement or a respective movement in phase opposition (i.e. equal and opposite, or "specular"). The base movement is defined, by means of activation means of the linear warp machine, on two successive rows of knitting, and is cyclically repeated.

In detail, in FIG. 3 it is possible to observe a base movement in which the two jacquard bars of the front bed carry out the same shog movement, realising, for each row of knitting, a closed knitting stitch ("close") on the front bed and no stitch on the back bed.

Using a notation method used in the technical sector of warp linear machines, the two bars both carry out a shog movement (of a length of two rows of knitting) of type 0/−1, 0/0, 0/1, 0/0, where each pair of numbers identifies the movements respectively of underlap and overlap performed by the thread guide at a half-row of knitting. This means that in this case the jacquard thread guide realizes, at the first half-row of knitting, a close stitch on a needle of the front bed (0/−1), while on the second half-row of knitting it performs no stitch on the back bed (0/0), on the third half-row of knitting it performs a close stitch on a further needle of the front bed (0/1), and on the fourth half-row of knitting it performs no stitch on the rear bed (0/0).

Still with reference to FIG. 3, the two jacquard bars of the back bed perform a respective shog movement (equal to one another but different to the movement of the bars of the front bed), realising, for each row of knitting, a close stitch on the back bed and not stitch on the front bed. Using the notation method used in the technical sector of warp linear machines, the two bars of the back bed both perform a shog movement (of a length of two rows of knitting) of type 0/0, 0/1, 0/0, 0/−1, where each pair of numbers identifies the movements respectively of underlap and overlap performed by the thread guide at a half-row of knitting. This means that, in this case, on the first half-row of knitting it does not perform any stitch on the front bed (0/0), on the second half-row of knitting the jacquard thread bar realizes a close stitch on a needle of the front bed (0/1), on the third half-row it performs no stitch on the front bed (0/0), and on the fourth half-row of knitting it realizes a close stitch on a further needle of the back bed (0/−1). Observe that in the known notation, a change internally of a pair of numbers corresponds to the formation of a knitted stitch, while the presence of two equal numbers in a pair identifies absence of a knitting stitch on the corresponding half-row.

As indicated above, FIG. 4 shows a further example of a base movement belonging to the prior art: in this case, the two jacquard bars of the front bed carry out an identical but opposite movement (i.e. they are in "phase opposition") and in turn the two jacquard bars of the back bed carry out a respective equal but opposite movement (i.e. they are also in phase opposition). In this case too, the thread guides of the two front bed bars realize, for each row of knitting, a close stitch on the front bed and no stitch on the back bed, while, on the contrary, the thread guides of the two bars of the back bed realize, for each row of knitting, a close knitted stitch on the back bed and no stitch on the front bed. The base movements of FIG. 4 can be codified in the following way: the two jacquard bars of the front bed carry out a movement represented respectively by 0/−1, 0/0, 0/1, 0/0 and its opposite 0/1, 0/0, 0/−1, 0/0, while the two jacquard bars of the back bed carry out a movement represented respectively by 0/0, 0/1, 0/0, 0/−1 and its opposite 0/0, 0/−1, 0/0, 0/1.

FIGS. 23 and 24 also show base movements according to the prior art. In detail, FIG. 23 is alike FIG. 3, while FIG. 24 is alike FIG. 4, with the difference that the knitted stitches realized by the thread guides on the needles are open.

The base movements shown in FIGS. 3, 4, 23 and 24 correspond to the shog movements of the jacquard bars considering the thread guides of all the bars to be still in the default position (i.e. the "OFF" position). In the OFF position the thread guide is positioned by a side of a respective needle of the respective bed, while, following activation of the respective jacquard device, it is moved into the ON position, i.e. it moves by a step of a needle with respect to the OFF position. The selection of the state (OFF or ON) of each single jacquard thread guide enables adding to or subtracting from the base movement single displacements of one or more thread guides, with the aim of realizing determined knitting operations.

In the prior art, normally in the absence of command of the jacquard thread guides (i.e. with the thread guides still in the OFF or ON position), the two jacquard bars of the front bed produce knitting only on the front bed and the two jacquard bars of the back bed produce knitting only on the back bed (as emerges from the patterns shown in FIGS. 3, 4, 23 and 24), i.e. two strata of knitting are generated, separate from one another. Note that, for position of the type, for example, 0/0 or 1/1, knitting is not realized as the thread guide does not change position during the lapping in front of the needle, or the "shog overlap". On the contrary, in positions of the type, for example, 0/−1 or 0/1, knitting is created as the thread guide laps or displaces in front of the needle, which takes the thread (in the descending or collecting step) borne by thread guide and is thus supplied. A "0/−1" conventionally indicates a shog movement of the bar from the position to the left of the needle to the position to the right of the needle. On the contrary, a "0/1" indicates a shog movement of the bar from the position to the right of needle to the position to the left thereof.

The above corresponds to the classic work situation of a double-bed jacquard machine when it produces tubular knitting articles, where we find that two jacquard bars mainly work on the needles of the front bed and the other two jacquard bars mainly work on the needles of the back bed. Normally, beyond the jacquard bars, bottom bars can be present (provided with fixed thread guides) which cooperate with the jacquard bars for forming the knitting.

No more description will be made of the prior art of use of the mobile jacquard thread guides in warp knitting for obtaining tubular articles or other finished articles directly on the machine with joints to the side of each tubular articles and closure of the bottoms. These methods exploit the potentialities offered by computerized systems present in warp linear machines, which on the basis of a specific graphic program are able to selectively activate each jacquard thread guide between the respective OFF and ON positions.

The Applicant has found that the known knitting processes, performed on warp linear machines, are not free of drawbacks and can be improved in various aspects thereof.

A drawback of the known solutions is represented by the limited knitting possibilities, i.e. the limited number of combinations of knitting stitches obtainable. In fact, consider that in the prior art all the rows of knitting produced, from the first to the last, a carried out by repeating the same base movements as the above-described jacquard bars over the whole production cycle of a knitted article.

The base movements, together with the jacquard displacements of the single thread guides, enable setting up a limited number of knitting stitch combinations, typically called: 1) blank or zero 2) single step, 3) double step, 4) inverted single step, 5) tubular join on single step, 6) tubular join on inverted single step, 7) tubular join on double step, 8) start fork (linked fabric between front and back bed). With these eight types of stitch realizable on fabric it is possible to obtain four different effects (from a visual point of view), called: blank, single step, double step, link. These stitches are obtained with the four jacquard bars which carry out the same movement two by two (the two jacquard bars perform the same movement and the two jacquard bars of the back bed move in a respective same way); in substance it is the situation of FIG. 3.

The base movement illustrated in FIG. 4, on the other hand, is used to realise the classic mesh. In this case, as illustrated above, the jacquard bars of the front bed move in phase opposition to one another, as do the two jacquard bars of the back bed. In this last case there is a different base movement system of the jacquard bars (with respect to FIG. 3). However, this movement too is maintained unaltered for the whole construction of the knitted article (for example "ballerina" type net stockings, i.e. over all the rows of knitting produced. In this case, though having available the same number and type of jacquard movements of the single levers as the preceding case (FIG. 3), the effects visible on the produced fabric are reduced to three: blank, double step, join, and the bottom bars with fixed thread guides can be absent.

As can be noted, the adopting of a different base movement of the jacquard bars (classic mesh) has led to a significant variation on what it is possible to produce with the same warp linear machine.

Certainly the base movement of FIG. 4 enables obtaining a new article (otherwise impossible to realise with the base movement of FIG. 3), but it is also true that this advantage leads to the "loss" of other possible patterns, previously workable. In other words, the base movement of FIG. 4 reduces the field of use of the linear knitting machine, as it does not enable obtaining the "single step" effect, since a combination of jacquard selections of the thread guides with the base movements of the bars of FIG. 4 does not exist for preventing the article produced from exhibiting laddering (in the absence of the bottom bars).

As confirmation of the fact that the limited nature of the combination of stitches obtainable for each row with a warp linear machine represents a relevant problem in the prior art, numerous patent applications can be found, as well as granted patents, directed at exploiting to the full the potential of a warp linear knitting machine with jacquard thread guide bars.

In relation to the importance of adopting a base movement of the jacquard bars which enables obtaining (in combination with the jacquard selection of the thread guides), the largest possible number of knitting stitches, see Japanese patent application JP2007308809 of 29 Nov. 2007 (claiming priority of Japanese patent application JP20060135906 of 16 May 2006), which describes a method for producing scarves in various colours and the like.

The above patent application describes five possible different base movements of the jacquard bars with which to construct knitted articles. The machine used is a double-bed jacquard warp linear knitting machine, and necessarily works at "half" gauge, i.e. on the front bed and on the back bed only half of the needles are at work (i.e. there is an alternation of needles working and needles at rest). The means that the knitting machine, developed to operate at gauge X, is instead used with X/2 gauge. In patent document JP2007308809, the jacquard bars positioned at the front bed are superposed on one another (not offset) and move together (as if they were a single bar); the same is true of the two jacquard bars positioned at the back bed. The jacquard thread guides can each carry a thread of a different colour so as to obtain a multi-coloured fabric. The jacquard thread guides, as indicated above, can displace from an OFF position to an ON position by performing a linear displacement equal to a needle step, i.e. equal to the step of the native gauge of the knitting machine (for example the displacement in the case of a gauge 24 will be 1.0583 mm). Differently, the jacquard bars, in order to correctly perform the base movement, will have to carry out displacements having an equal or multiple step with regard to the "real" distance between a needle and another, considering the halved gauge. For example, for a gauge 12 the displacement of the bars will be 2.116 mm per 1 step, 4.233 mm per 2 steps, etc. Clearly the base movements of the jacquard bars are particular and difficult to coordinate with the jacquard selection displacements.

Patent document JP2007308809 describes five possible base movements of the jacquard bar. For each base movement, which alone can or might not create knitting, three further knitting stitches are included for each bar group, as clearly described in the patent. In practice, each base movement, by means of the jacquard selection, makes available a respective set of three different knitting stitches. Note, however, that on each row of knitting it is possible to carry out a sole base movement of the jacquard bars (from among the five described) and therefore for each row of knitting there is a limit of one only set of movements (base movement plus three variants of knitting stitches) simultaneously. To obtain motifs or knitting stitches that are different, it is necessary to change the base movement of the jacquard bars, but in any case it will be possible to produce on a same row only four different types of stitch (base movement plus three variants). Clearly it is not possible to produce, in a same row of knitting, knitting stitches belonging to different base movements: each base movement includes its three knitting stitches and cannot realize other stitches. Therefore it is clear that the process described in JP2007308809 offers a limited variety of obtainable knitting effects.

A linear knitting machine configured according to what is described in JP2007308809 is able to produce scarves with four colours on both sides and other knitting patterns, but limited to the type of base movement of the chosen jacquard bars. The five base movements, with relative knitting stitches obtainable by jacquard selection, can be chained to one another in successive rows; in this case the product obtained, for example a scarf, will be characterised by horizontal strips of various width each having motifs and designs according to the base movement of the jacquard bar used.

The limits of the knitting process described in JP2007308809 are primarily the need to reduce the knitting machine to work at half-gauge, and further the poor availability of knitting stitches that can be carried out on a same row.

Note that the need to operate at half-gauge creates a considerable drawback: in fact, the half-gauge setting reduces by half the resolution of the motifs designed in the knitted article. This produces strong aliasing effects that are clearly visible on diagonal or round designs. This translates into a lower resolution of the knitting design and the impossibility of creating logos, writing and small geometrical motifs in different colours from the base colour; in fact, the graphic elements would be grainy and unpleasant.

The low resolution (due to the half-gauge) and the small set of knitting stitches that can be performed on a same row make the knitting process of JP2007308809 unsuitable for applications in which the required design resolution (very high contrast) and consistency of the fabric (dimensional stability), such as for example in the production of shoe uppers made via a fabric process, or in the production of lateral sides of mattresses or other products where these attributes are particularly required.

Also, the described method is characterised by a high complexity in chaining the various knitting stitches at each change of base movement, as well as a limited scope of use, which makes the method of JP2007308809 a special application on warp knitting machines, and not a "general purpose" method.

In this situation the aim underpinning the present invention, in its various aspects and/or embodiments, is to provide a process for production of knitted articles which is able to obviate one or more of the cited drawbacks.

A further aim of the present invention is to provide a process for producing knitted articles on warp linear knitting machines able to produce knitted articles having characteristics such as sharpness of the colours, consistency (thickness), dimensional stability, possibility of presence of areas with different permeability to air, resistance to laddering and other characteristics that can make the product sturdy, pleasant to behold and at the same time comfortable to use.

A further aim of the present invention is to disclose a process for the production of knitted articles able to broaden the knitting possibilities offered by a warp linear knitting machine and characterised by jacquard motifs that are more complex and complete with respect to the prior art.

A further aim of the present invention is to provide a process for production of knitted articles able to realise and combine, with one another and in a simple way, a plurality of different knitting effects.

A further aim of the present invention is to disclose a process for production of knitted articles able to operate efficiently at all gauges (in particular high gauges) and able to operate at full gauge (using all the needles) on a warp linear knitting machine.

A further aim of the present invention is to disclose a process for production of knitted articles able to produce knitted articles characterised by high quality and/or uniformity, in particular with respect to the known knitting processes.

A further aim of the present invention is to disclose a process for production of knitted articles, characterised by high functioning reliability.

A further aim of the present invention is to disclose a process for production of knitted articles able to operate efficiently and continuously at high velocity.

A further aim of the present invention is to disclose a process for production of knitted articles characterised by an assembling of original steps, alternative and innovative with respect to the known solutions.

A further aim of the present invention is to disclose a process for production of knitted articles having improved performance, in particular able to improve the quality and/or increase the productivity, for example in terms of quantity of knitting produced in a time unit and/or in terms of complexity of the knitting produced.

A further aim of the present invention is to disclose a process for production of knitted articles characterised by a modest cost of application with respect to the performance and quality offered.

These aims and others besides, which will more fully emerge during the course of the following description, are substantially attained by a process for production of knitted articles, according to one or more claims, each of which taken alone (without the relative dependencies) or in any combination with the other claims, as well as according to the following aspects and/or embodiments, variously combined, including with the claims.

In a first aspect, the invention relates to a process for production of knitted articles, comprising at least steps of:

predisposing a linear knitting machine for warp knitting, of a double-bed raschel type, comprising at least:

a bearing structure, knitting organs mounted on the bearing structure and comprising a first needle bed, comprising a plurality of needles aligned to one another, and a second needle bed, comprising a respective plurality of needles aligned to one another;

a first jacquard bar provided with an odd-number plurality of thread guide of a jacquard type configured such as to selectively supply thread to the needles of the beds;

a second jacquard bar provided with an even-number plurality of jacquard-type thread guides, configured such as to selectively supply thread to the needles of the beds;

a third jacquard bar provided with an odd-number plurality of jacquard-type thread guide configured such as to selectively supply thread to the needles of the beds;

a fourth jacquard bar provided with an even-number plurality of jacquard-type thread guide configured such as to selectively supply thread to the needles of the beds;

wherein each of the odd and even jacquard-type thread guide is further singly and selectively mobile by means of a corresponding jacquard-activation element between a base position and an activation position, displaced by a needle space with respect to the base position, and wherein the jacquard bars are configured such as each to carry out a linear shog movement, frontally and posteriorly to the tip of the needles in the beds, and a respective oscillating swing movement, substantially perpendicular and substantially alternated with the respective shog movement and carried out by a side of the needles of the beds so as to bring the threads alternatively in front of and behind the needle tips, the shog movement and the swing movement enabling production of at least a knitted article on the needle beds; and producing at least a portion of a knitted article by means of a base movement of the jacquard bars.

In an aspect the needles of the first needle bed are conventionally identified as even and odd needles, alternated with one another; likewise the needles of the second needle bed are conventionally identified as even and odd needles, alternated with one another.

In an aspect, in the step of producing at least a portion of a knitted article by means of a base movement of the jacquard bars, the first jacquard bar, the second jacquard bar, the third jacquard bar and the fourth jacquard bar are moved, in each row of knitting, so as to operate alternatively at the first and the second needle bed.

In an aspect, in the step of producing at least a portion of a knitted article by means of a base movement of the jacquard bars, the first jacquard bar and the third jacquard bar are moved with a shog movement identical to one another and simultaneously on a same bed of the needle beds.

In an aspect, in the step of producing at least a portion of a knitted article by means of a base movement of the jacquard bars, the second jacquard bar and the fourth jacquard bar are moved with a shog movement identical to one another and simultaneously on a same bed of the needle beds.

In the present invention, the order and arrangement of the jacquard bars can be modified as required with respect to the arrangement given by way of example in the figures, as long as two jacquard bars (one with odd thread guides) are located at the first needle bed and two jacquard bars (one with even and one with odd thread guides) are located at the second needle bed.

In an aspect the first and the second jacquard bar are arranged at the first bed and the third and the fourth jacquard bar are arranged and mounted at the second bed.

In an aspect one of the jacquard bars has having even and one of the jacquard bars having odd are arranged and mounted at the first needle bed and wherein the remaining jacquard bar having even and the remaining jacquard bar having odd are arranged and mounted at the second needle bed.

In an aspect, in the step of producing at least a portion of a knitted article by means of a base movement of the jacquard bars, all four jacquard bars are moved to carry out a same swing movement, and/or the first and the second jacquard bar are reciprocally identical and at half-gauge with respect to the gauge of the needle beds, and are in default position, one with respect to the other, offset by one needle space, and wherein the third and the fourth jacquard bar are reciprocally identical and at half-gauge with respect to the gauge of the needle beds, and are in default position, with respect to one another, offset by one needle space.

In an aspect, in the step of producing at least a portion of a knitted article by means of a base movement of the jacquard bars, the first and third jacquard bars are moved to perform a same swing movement.

In an aspect, in the step of producing at least a portion of a knitted article by means of a base movement of the jacquard bars, the second and fourth jacquard bars are moved to perform a same swing movement.

In an aspect, in the step of producing at least a portion of a knitted article by means of a base movement of the jacquard bars, all four jacquard bars are moved and perform a same swing movement.

By "same swing movement" is meant a swing movement substantially alike and temporally coordinated.

In an aspect the four jacquard bars all work, for each half-row of knitting, on a same needle bed.

In an aspect the first and the second jacquard bar are arranged at the first bed and the third and the fourth jacquard bar are arranged at the second bed.

In an aspect the thread guide are passive (or static) when not individually moved between the relative base position and the relative activation position during the shog movements of the relative jacquard bars, and are active when they are individually moved between the relative base position and the relative activation position during the shog movements of the relative jacquard bars. The expression "row of knitting" is taken to be a sequence of two steps of knitting working, where the first step comprises a plurality of knitting stitches realized by the jacquard bars on the first bed and the second step comprises a plurality of knitting stitches realized by the jacquard bars on the second bed. By "half-row of knitting" is meant a half of a row, i.e. one alone from between the first or second step which compose a range of knitting. A half-row of knitting can therefore be on the first bed or the second bed.

In an aspect the process is characterised in that, in the base movement of the jacquard bars, the shog movement of the first jacquard bar and the third jacquard bar is carried out in phase opposition, i.e. identically and oppositely, or symmetrically, with respect to the shog movement of the second jacquard bar and the fourth jacquard bar.

In an aspect, the first jacquard bar, the second jacquard bar, the third jacquard bar and the fourth jacquard bar are all moved simultaneously at a same bed of the beds.

In an aspect, in the base movement the jacquard bars are moved such that the passive thread guides of each bar always form stitches at each half-row of knitting produced, alternatively on the needles of the first needle bed and on the needles of the second bed.

In an aspect the base movement realises, for each row of knitting, a plurality of stitches of knitting on needles of the first bed and a plurality of stitches of knitting on needles of the second bed so as to define a double-cloth or linked fabric.

In an aspect the base movement determines, for all the passive jacquard thread guide of each jacquard bar, the realising of a stitch on both beds, for each row of knitting.

In an aspect the base movement defines a productive sequence of stitches carried out alternatively on the first bed and on the second bed, the productive sequence being cyclically repeated every two rows of knitting.

In an aspect, in the base movement, the jacquard bars are moved in such a way that each passive thread guide of each jacquard bar produces, in a predetermined sequence:

- in a first half-row of knitting, a first stitch at a respective first needle of the first bed,
- in a second half-row of knitting, a second stitch at a respective first needle of the second bed, corresponding in position to the first needle of the first bed,
- in a third half-row of knitting, a third stitch at a respective second needle of the first bed, adjacent to the first needle of the first bed,
- in a fourth half-row of knitting, a fourth stitch at a respective second needle of the second bed, adjacent to the first needle of the second bed.

In an aspect, the base movement is determined by a plurality of iterative repetitions of the predetermined sequence, each repetition for each passive thread guide starting from the same respective first needle of the first bed.

In an aspect, in the base movement, the first jacquard bar and the third jacquard bar are moved in such a way that each odd passive thread guide of the jacquard bars actuates the predetermined sequence at the respective: first needle of the first bed, first needle of the second bed, second needle of the first bed, adjacent and displaced in a first direction with respect to the first needle of the first bed, and second needle of the second bed, adjacent and displaced in the first direction with respect to the first needle of the second bed, and wherein the second jacquard bar and the fourth jacquard bar are moved so that each even passive thread guide of the jacquard bars actuates the predetermined sequence at the respective: first needle of the first bed, first needle of the second bed, a further second needle of the first bed, adjacent and displaced in a second direction (opposite the first direction) with respect to the first needle of the first bed, and a further second needle of the second bed, adjacent and displaced in the second direction with respect to the first needle of the second bed.

In an aspect, in the base movement, the jacquard bars are moved such that the passive thread guides of each bar always form closed knitting stitches on the first and/or the second needle bed at each half-row or row of knitting produced.

In an aspect, in the base movement, the jacquard bars are moved so that the passive thread guides of each bar always form open knitting stitches on the first and/or on the second needle bed at each half-row or row of knitting produced.

In an aspect, the base movement comprises a base semi-movement in which each of the jacquard bars produces, by means of the respective jacquard thread guide that remain passive in the same position, at least at a first half-row of knitting and at the first needle bed, a respective stitch of knitting on respective even or odd needles, alternated with needles, odd or even, on which stitches are not formed.

In an aspect, the respective alternated needle, even or odd, on which the stitches of the first half-row of knitting are formed are the same alternated needles, even or odd, at least for corresponding passive thread guides in the first and the third jacquard bar and/or for corresponding passive thread guide in the second and fourth jacquard bar In an aspect, wherein the process comprises a step of repeating the base semi-movement at least at two directly successive half-rows on the first and on the second needle bed.

In an aspect, the base movement of the jacquard bars is carried out in such a way that for the passive thread guide in the same position of each jacquard bar, at the formation of at least a stitch or at least a half-row of knitting, or at a plurality of consecutive stitches or a plurality of consecutive half-rows of knitting, the first and the third jacquard bar supply thread and produce, by means of respective odd passive thread guide and reciprocally corresponding to one another in the first and third jacquard bar, stitches realized at the same identical needles of one of the needle beds or at the same identical needles on both the needle beds, and wherein the second and the fourth jacquard bar supply thread and produce, by means of respective even passive thread guide reciprocally corresponding in position in the second and the fourth jacquard bar, stitches realized at the same identical needles of one of the needle beds or sequentially at the same identical needles on both the needle beds.

In an aspect, the base movement of the jacquard bars is carried out in such a way that for the passive thread guide in the same position of each jacquard bar, at the formation of at least a stitch or at least a half-row of knitting, or at a plurality of consecutive stitches or a plurality of half-rows of knitting, all the jacquard bars supply thread and produce, by means of respective of odd and even thread guides, passive and corresponding to on another, stitches at the same identical needles of one of the needle beds, or sequentially at the same identical needles on both the needle beds.

For the purposes of the present description and claims, the expression "corresponding" thread guide is taken to mean pairs of having a corresponding two positions on two like jacquard bars positioned at the two needle beds. In practice, each odd thread guide of the first jacquard bar has a corresponding odd thread guide of the third jacquard bar, and together form a pair of corresponding thread guides, i.e. located—along the series of—in like positions and position at (i.e. by the side of) like needles of the respective needle bed (front and back).

In the same way, each thread guide of the second jacquard bar has a corresponding thread guide of the fourth jacquard bar, and together they form a respective pair of corresponding thread guides.

In an aspect the base movement comprises following operating steps:

- simultaneously producing, by means of first odd passive thread guides in the same position and reciprocally corresponding in the first and third jacquard bar and by means of first even passive thread guides in the same position and reciprocally corresponding in the second and in the fourth jacquard bar, a first stitch with four threads at a first needle of the first needle bed;

thereafter simultaneously producing, by means of the first odd passive thread guides in the same position and reciprocally corresponding in the first and the third jacquard bar and by means of the even passive thread guides in the same position and reciprocally corresponding in the second and the fourth jacquard bar, a second stitch with four threads at a same first needle of the second needle bed, corresponding to the first needle of the first bed;

thereafter simultaneously producing, by means of the first odd passive thread guides in the same position and reciprocally corresponding in the first and the third jacquard bar, and by means of second even passive thread guides in the same position and reciprocally corresponding in the second and fourth jacquard bar and adjacent and displaced in a first direction with respect to the first even passive thread guides, a third stitch with four threads at a same second needle of the first needle bed adjacent and displaced in the first direction with respect to the first needle of the first needle bed; and thereafter, simultaneously producing, by means of the first odd passive thread guides in the same position and reciprocally corresponding in the first and the third jacquard bar, and by means of the second even passive thread guides in the same position and reciprocally corresponding in the second and the fourth jacquard bar and adjacent and displaced in a first direction with respect to the first even passive thread guides, a fourth stitch with four threads at a same second needle of the second needle bed adjacent and displaced in the first direction with respect to the first needle of the second needle bed and corresponding to the second needle of the first needle bed.

In an aspect the base movement comprises an iterative repetition of the operating steps. In an aspect the operating steps are carried out for all the passive jacquard thread guides of the jacquard bars.

In an aspect, in the base movement of the jacquard bars the first jacquard bar, the second jacquard bar, the third jacquard bar and the fourth jacquard bar are all moved with a shog movement that is identical to one another and simultaneously on a same bed of the beds.

In an aspect, in the base movement, the jacquard bars are moved in such a way as to produce, in a predetermined sequence:

in a first half-row of knitting, corresponding passive thread guides of the first and the third jacquard bar produce a first stitch at a respective first needle of the first bed and corresponding passive thread guides of the second and fourth jacquard bar produce a second stitch at a respective second needle of the first bed, adjacent to the first needle of the first bed;

in a second half-row of knitting, the corresponding passive thread guides of the first and third jacquard bar produce a third stitch at a respective first needle of the second bed, corresponding in position to the first needle of the first bed, and the corresponding passive thread guides of the second and fourth jacquard bar produce a fourth stitch at a respective second needle of the second bed, corresponding in position to the second needle of the first bed;

in a third half-row of knitting, the corresponding passive thread guides of the first and the third jacquard bar produce a fifth stitch at the second needle of the first bed, and the corresponding passive thread guides of the second and the fourth jacquard bar produce a sixth stitch at a respective third needle of the first bed, adjacent to the second needle of the first bed and on an opposite side with respect to the first needle of the first bed;

in a fourth half-row of knitting, the corresponding passive thread guides of the first and third jacquard bar producing a seventh stitch at the second needle of the second bed, and the corresponding passive thread guides of the second and the fourth jacquard bar produce an eighth stitch at a respective third needle of the second bed, corresponding in position to the third needle of the first bed.

In an aspect the base movement is determined by a plurality of iterative movements of the predetermined sequence, each repetition beginning for each passive thread guide from a same respective first or second needle of the first bed.

In an aspect, in the base movement, the first jacquard bar and the third jacquard bar are moved such that each passive odd thread guide of the jacquard bars actuates the predetermined sequence at the respective: first needle of the first bed, first needle of the second bed, second needle of the first bed, adjacent and displaced in a first direction with respect to the first needle of the first bed, and second needle of the second bed, adjacent and displaced in the first direction with respect to the first needle of the second bed, and wherein the second jacquard bar and the fourth jacquard bar are moved so that each even passive thread guide of the jacquard bars actuates the predetermined sequence at the respective: second needle of the first bed, second needle of the second bed, third needle of the first bed, adjacent and displaced in the first direction with respect to the second needle of the first bed, and third needle of the second bed, adjacent and displaced in the first direction with respect to the second needle of the second bed.

In an aspect the base movement comprises a base semi-movement in which, at least at a first half-row of knitting and the first needle bed, each of the first and third jacquard bar produces, by means of the respective jacquard thread guides which remain passive in the same position, a respective stitch on respective even or odd needles, alternated with needles, odd or even, on which respective stitches are formed by each of the second and fourth jacquard bar, by means of the respective jacquard thread guides which are passive in the same position.

In an aspect the respective even or odd alternated needles, on which the stitches are formed in the first half-row of knitting, are the same alternated needles, even or odd, for corresponding passive thread guides in the first and the third jacquard bar, and the respective alternated odd or even needles, on which the stitches for the first half-row of knitting are formed, are the same odd or even alternated needles, for corresponding passive thread guides in the second and fourth jacquard bar.

In an aspect the process comprises a step of repeating the base semi-movement at least at two directly successive half-rows on the first and on the second needle beds.

In an aspect the base movement comprises following operating steps:

simultaneously producing, by means of first odd passive thread guides in the same position and reciprocally corresponding in the first and third jacquard bar, a first stitch with two threads at a same first needle of the first needle bed, and simultaneously producing, by means of first even passive thread guides in the same position and reciprocally corresponding in the second and the fourth jacquard bar, a second stitch with two threads at a same second needle of the first needle bed, adjacent to the first needle of the first bed;

thereafter, simultaneously producing, by means of the first odd passive thread guides in the same position and reciprocally corresponding in the first and the third jacquard bar, a third stitch with two rows at a same first needle of the second needle bed, corresponding in position to said first needle of the first bed, and simultaneously producing, by means of the first even passive thread guide in the same position and reciprocally corresponding in the second and the fourth jacquard bar, a fourth stitch with two threads at a same second needle of the second needle bed, corresponding in position to the second needle of the first bed;

thereafter, simultaneously producing, by means of the first odd passive first thread guides in the same position and reciprocally corresponding in the first and the third jacquard bar, a fifth stitch with two threads at the second needle of the first bed, and simultaneously producing, by means of the first even passive thread guides in the same position and reciprocally corresponding in the second and the fourth jacquard bar, a sixth stitch with two threads at a respective third needle of the first bed, adjacent to the second needle of the first bed and on an opposite side with respect to the first needle of the first bed; and thereafter, simultaneously producing, by means of the first odd passive thread guides in the same position and reciprocally corresponding in the first and the third jacquard bar, a seventh stitch with two threads at the second needle of the second bed, and simultaneously producing, by means of the first even passive thread guides in the same position and reciprocally corresponding in the second and fourth jacquard bar, an eighth stitch with two threads at a respective third needle of the second bed, corresponding in position to the third needle of the first bed and adjacent to the second needle of the second bed on an opposite side with respect to the first needle of the second bed.

In an aspect the base movement comprises an iterative repetition of the operating steps. In an aspect the operating steps are carried out for all the passive jacquard thread guides of the jacquard bars.

In an aspect the process comprises a step of activating, during the base movement of the jacquard bars, a plurality of jacquard thread guides, by carrying out corresponding individual displacements by one needle space of the plurality of jacquard thread guides, so as to selectively modify a base structure of the portion of the knitted article by means of realizing differentiated knitting stitches and structures, deriving from a combination of the base movement of the jacquard bars and the individual movements of the single active jacquard thread guides, in addition to or in subtraction from the shog movements of the jacquard bars.

In an aspect, the procedure comprises a step of supplying the first jacquard bar and the second jacquard bar with first threads of a first colour and/or of a first type and supplying the third jacquard bar and the fourth jacquard bar with second threads of a second colour and/or a second type.

In an aspect the process is characterised in that it selectively activates the jacquard of the jacquard bars in such a way as to realize at least a portion of the knitted article having on both sides of the knitting stitches realized with the first and with the second threads or with all the first and second threads or in such a way as to realize at least a portion of the knitted article having at least a side constituted only by stitches realized only with the first threads or with the second threads or in such a way as to realize at least a portion of the knitted article having both sides only constituted by stitches realized respectively only with the first threads on the first bed and only with the second threads on the second bed, in such a way as to realize a portion of fabric comprising two distinct and parallel lengths of fabric realized respectively on the first and on the second bed.

In an aspect, the process comprises a step of alternating, on a side of the fabric of the knitted article, at least a first portion realized only with stitches realized only with the first threads and at least a second portion realized only by stitches realized only with the second threads or with the first threads and the second threads, so as to define graphic elements, designs or writing on the side of the fabric, clearly-defined and/or with substantially sharply-defined borders.

In an aspect the step of predisposing a linear knitting machine for warp knitting comprises a step of predisposing at least a first bottom bar, arranged at the first needle bed or second needle bed and wherein the process comprises a step of realizing, by means of the bottom bar, knitting stitches, chains or non-lapped threads in cooperation with the four jacquard bars such as to realize at least a portion of the knitted article and/or so as to reinforce the structure of the fabric.

In an aspect the process comprises a step of realizing, by means of the bottom bar, stitches, chains or non-lapped threads in cooperation with the four jacquard bars, wherein at least the first and the second jacquard bar or at least the third and the fourth jacquard bar are operating with at least a group of passive jacquard thread guides so as to realize at least a portion of the knitted article with a sponge effect on the bed opposite the bottom bar. By "non-lapped" threads is meant threads that do not lap about the needle but are threaded among the threads that have been knitted.

In an aspect, at least a group of adjacent thread guides of the first jacquard bar and at least a corresponding group of adjacent thread guides of the second jacquard bar are in the base position and at least a group of corresponding adjacent thread guides of the third jacquard bar and at least a corresponding group of adjacent thread guides of the fourth jacquard bar are in the activation position, or vice versa wherein at least a group of adjacent thread guides of the first jacquard bar and at least a corresponding group of adjacent thread guides of the second jacquard bar are in activation position, and at least a corresponding group of adjacent thread guides of the third jacquard bar and at least a corresponding group of adjacent thread guide of the fourth jacquard bar are in base position, such as to realize, at the portion of fabric realized with the threads carried by the groups of adjacent on the jacquard bars, a portion of checked fabric characterised, at least on a side of the fabric, by an alternating of single stitches realized only with the first threads and single stitches realized only with the second threads.

In an aspect, the process comprises a step of supplying each jacquard thread guide with the jacquard bars with a respective thread independently with respect to the other jacquard thread guide of the knitting machine.

In an aspect the step of predisposing a linear knitting machine for warp knitting comprises a step of predisposing thread supply devices configured such as to supply a plurality of threads to the jacquard bars, wherein the thread supply devices comprise at least a creel provided with a plurality of thread-bearing reels singly combined to a respective jacquard thread guide, such that each thread-bearing reel provides, independently with respect to the other thread-bearing reels, a respective quantity of thread to a respective thread guide on the basis of a thread demand thereof, the at least a creel being configured so as to compensate for the difference of demand of the various threads in view of different stitches realized by the various thread guides of the jacquard bars.

In an aspect the thread supply devices comprise a plurality of tensioning elements, for example a plurality of tensioners, each tensioning element being singly dedicated to a respective thread coming from one of the thread creels and being interposed between the creel supplying the respective thread and a respective thread guide, in which each of the tensioning elements is configured so as to slidingly receive the respective thread and to elastically and proportionally deform on the basis of the tension of the respective supply thread received, with the aim of supplying the respective thread guide having a determined tension value that is substantially constant.

In an aspect, each respective linear movement of each of the four jacquard bars comprises, for each half-row of knitting, a respective underlap movement, performable while the jacquard bar is situated posteriorly of the needle with the oscillating movement thereof, and a respective and coupled overlap movement, performable while the bar is situated frontally of the needle with the oscillating movement thereof, the underlap movement thereof and the successive overlap movement thereof—reciprocally coupled—enabling, for each half-row of knitting, displacing each thread guide of the respective jacquard bar laterally with respect to the needle bed thereof in combination with the oscillating movement.

In an aspect, in the step of performing a base movement, the linear movements of the jacquard bars all include, for each half-row of knitting, an underlap movement followed by a respective overlap movement, so as to laterally displace each thread guide during each oscillating movement thereof forward and backward of the respective needle bed, and carry out at least a portion of a revolution about a respective needle, realizing a knitted stitch.

In an aspect, during the step of performing a base movement, the shog movements of the jacquard bars all include, between each half-row of knitting and the successive half-row of knitting, a new underlap movement in an opposite direction with respect to the preceding overlap movement, in such a way as to perform complete revolutions of the threads before and behind the tip of the needles of the beds and thus realise close knitted stitches.

In an aspect, during the step of performing a base movement, the linear movements of the jacquard bars all include, between each half-row of knitting and the following half-row of knitting, a new underlap movement in the same direction as the previous overlap movement or no underlap movement following the preceding overlap movement, in such a way as to perform half-revolutions about the needles of the beds and thus open knitting stitches.

In a further aspect, the present invention relates to a process comprising a step of producing at least a portion of a knitted article by means of a base movement of the jacquard bars, in which, for respective passive thread guides, the odd thread guide corresponding to one another in a position in the first and the third jacquard bar move identically to one another and at the same needles on the two needle beds, and the even thread guide that correspond in the position in the second and the fourth jacquard bar move identically with respect to one another and at the same needles of the two needle beds and/or wherein the first jacquard bar and the third jacquard bar are moved in a shog movement in phase opposition, i.e. in equal and opposite mode, with respect to the shog movement of the second and fourth jacquard bar.

In an aspect, in the base movement, the jacquard bars are moved, in cooperation with suitable jacquard movements of the single thread guides, in a predetermined sequence of two successive rows of knitting:

- in a first half-row of knitting, a first stitch at a respective first needle of the first bed,
- in a second half-row of knitting, a further stitch at a respective first needle of the second bed, corresponding in position to the first needle of the first bed,
- in a third half-row of knitting, no stitch at the first needle of the first bed,
- in a fourth half-row of knitting, a further stitch at a respective first needle of the second bed, adjacent to the first needle of the second bed, corresponding in position to the first needle of the first bed, so as to realize at least a portion of the knitted article with a sponge effect on the first bed.

In an alternative aspect, the jacquard bars are moved so as to realize, in cooperation with suitable jacquard movement of the single thread guides, in a predetermined sequence of two successive rows of knitting:

- in a first half-row of knitting, a stitch at a respective first needle of the first bed,
- in a second half-row of knitting, a further stitch at a respective first needle of the second bed, corresponding in position to the first needle of the first bed,
- in a third half-row of knitting, a further stitch at the first needle of the first bed,
- in a fourth half-row of knitting, no stitch at the first needle of the second bed, adjacent to the first needle of the second bed, corresponding in position to the first needle of the first bed;

so as to realize at least a portion of the knitted article with a sponge effect on the second bed.

In an aspect the base movement is determined by a plurality of iterative repetitions of the predetermined sequence of two successive rows of knitting, each repletion starting from the first needle of the first bed and having a length of two rows of knitting.

In an aspect, in the predetermined sequence of two successive rows of knitting, each of the stitches realized on the first or the second bed is produced by means of a thread carried by any one of the jacquard bars.

In an aspect, in the base movement, the jacquard bars are moved such as to realise, in cooperation with suitable jacquard movements of the single thread guides, in a predetermined sequence of two successive rows of knitting and with needles corresponding to the first and second needle beds:

- on one from between the first and second needle beds, a knitted stitch in each of the two respective half-rows of knitting of the at least one from between the first and second needle bed;
- on the other needle bed, a stitch of knitting in one of the two respective half-rows of knitting of the other needle bed and no stitch in the other half-row of the two respective half-rows of knitting of the other needle bed;

so as to realise at least a portion of the knitted article with a sponge effect on the other needle bed, in which the base movement is preferably determined by a plurality of iterative repetitions of the predetermined sequence of two successive rows of knitting.

In a further aspect thereof, the present invention further relates to a software program for the functioning of a linear knitting machine for warp knitting, of a double-bed raschel type, the program being configured so as to carry out a process according to any one of the claims and/or the preceding aspects and/or stored on a storage support interfaceable with a control device of the functioning of a linear knitting machine for warp knitting, of a raschel and double-bed type.

In a further aspect thereof, the present invention further relates to a control device of a functioning of a linear warp knitting machine for warp knitting, of a double-bed raschel type, in which the control device is configured so as to carry out a process according to any one of the claims and/or the preceding aspects.

In a further aspect, the invention further relates to a linear knitting machine for warp knitting, of a double-bed raschel type, comprising at least a control device of the functioning of the knitting machine configured so as to carry out a process according to any one of the claims and/or the preceding aspects.

In a further aspect, the present invention relates to a linear knitting machine for warp knitting, configured and predisposed so as to actuate the process according to any one of the claims and/or the preceding aspects.

In a further aspect, the present invention relates to a knitted article realised using a process according to one or more of the aspects and/or the claims.

In an aspect, the knitted article is, by way of non-limiting example, for example: a shoe upper, a scarf, a portion of an item of male and female clothing in general, a portion of an item of underwear, a portion of stocking, a hat, a blanket, a textile cladding, a mattress cover, a towel, an item of bathing costume, a curtain, a bag, etc.

Each of the above aspects of the invention can be taken alone or in combination with any one of the claims or the other described aspects.

Further characteristics and advantages will more fully emerge from the detailed description of some embodiments, among which also a preferred embodiment, by way of non-exclusive example, of a process for production of knitted articles according to the present invention. The description will be set down in the following with reference to the appended drawings, provided only by way of non-limiting example, in which:

FIG. 1 is a schematic view, in lateral view, of the structure of a linear knitting machine for chain knitting for realising a process according to the present invention; in particular, by way of example two needle beds are shown, as well as four jacquard thread guide bars and two bottom bars;

FIG. 2 schematically illustrates a base movement of the jacquard bars according to a first embodiment of the process of the present invention; in particular a first possible embodiment of the four shog movements of the four jacquard bars is shown, with respect to the two needle beds, the shog movements realising a plurality of close knitting stitches;

FIG. 2A is a schematic view of a base movement of the jacquard bars according to a second embodiment of the process of the present invention; in particular a second embodiment is shown of four shog movements of the four jacquard bars, with respect to the two needle beds, the shog movements realising a plurality of close stitches; in substance, the base movement of FIG. 2A is obtainable by translating the base movement of FIG. 2 by a half-row of knitting;

Figure 2:
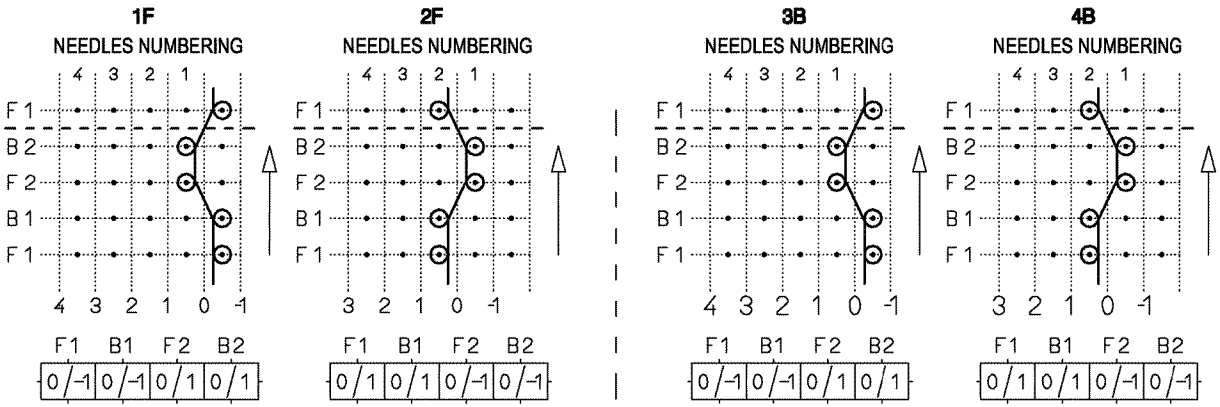
Figure 2A:
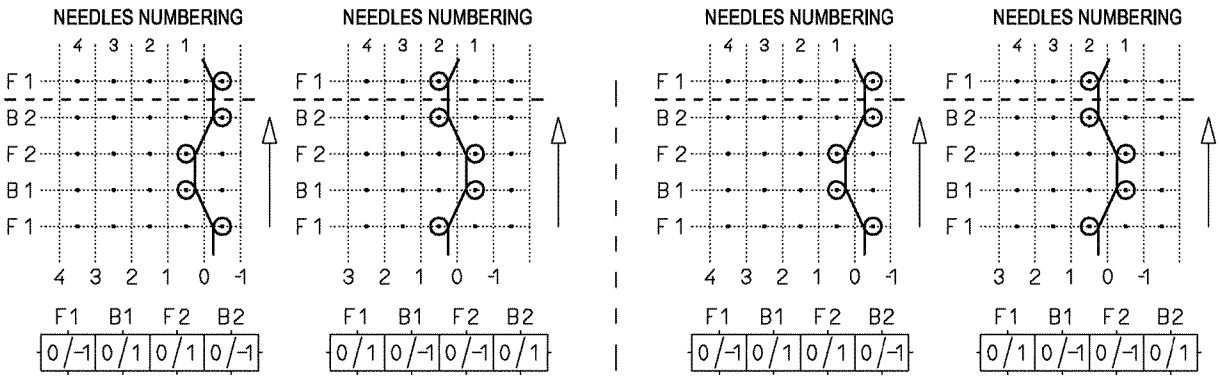
Figure 3:
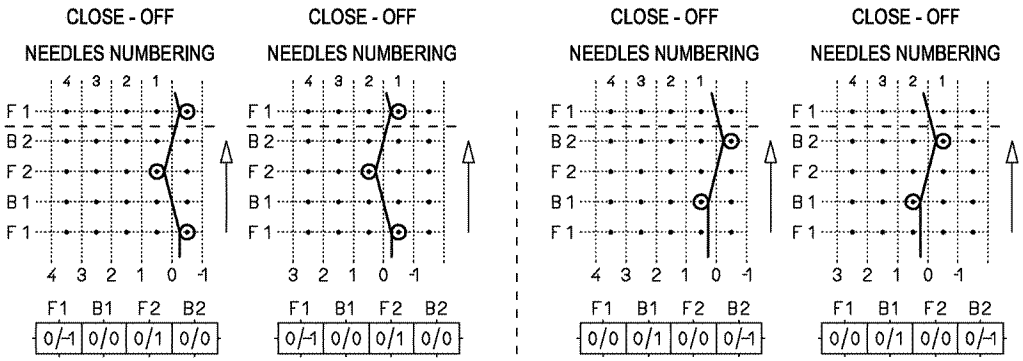
FIG. 3 is a schematic view of a base movement of the jacquard bars according to the prior art; in particular shog movements of known type are illustrated of the four jacquard bars, with respect to the two needle beds, the shog movements realizing a plurality of close knitting stitches.
Figure 4:
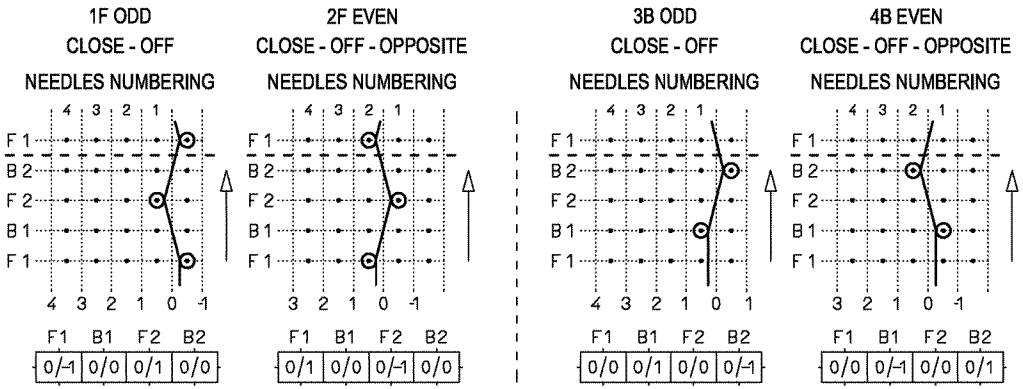
FIG. 4 is a schematic view of a further base movement of the jacquard bars of the prior art; in particular, further shog movements of known type are shown of the four jacquard bars, with respect to the two needle beds, the shog movements realising a plurality of close knitting stitches.
Figure 5:
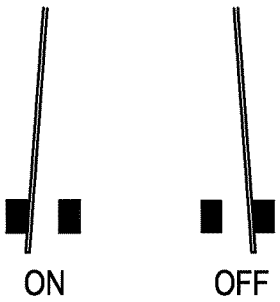
FIG. 5 is a schematic view of a jacquard thread guide of a linear knitting machine configured such as to realize the process of the present invention: to the right the thread guide is shown in a respective base position (OFF), while to the left the thread guide is shown in a respective activation position (ON), displaced by a needle step with respect to the base position.
Figure 6:
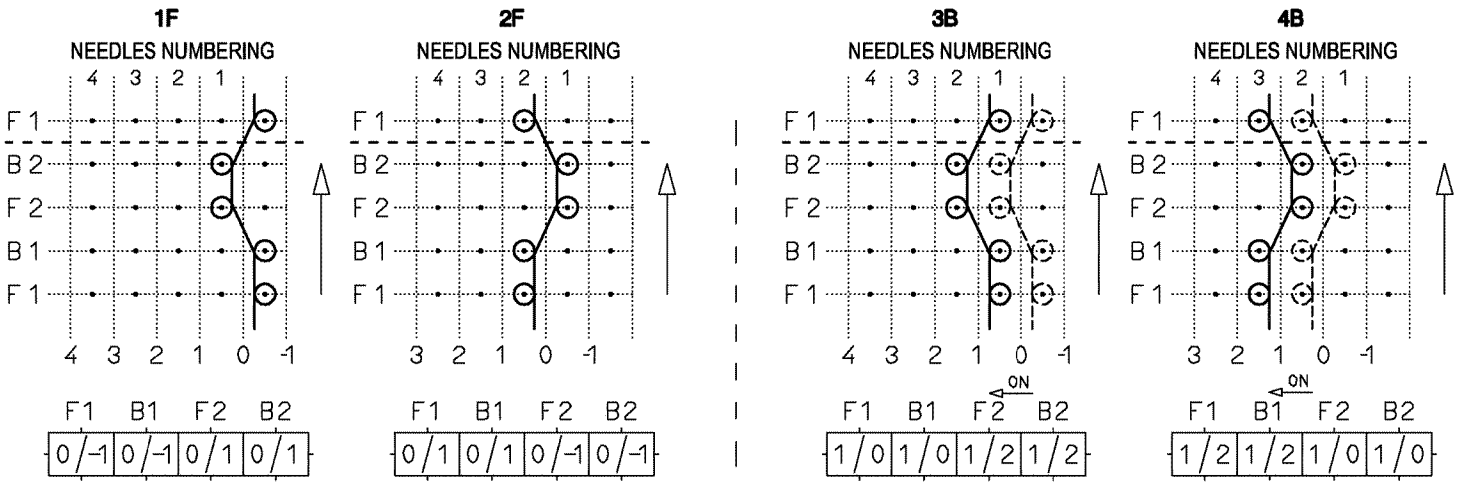
Figure 7:
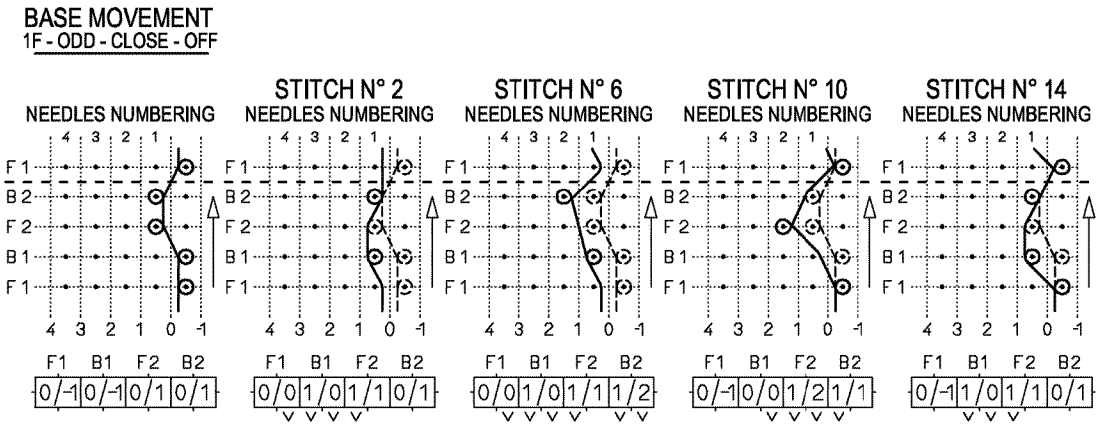
Figure 8:
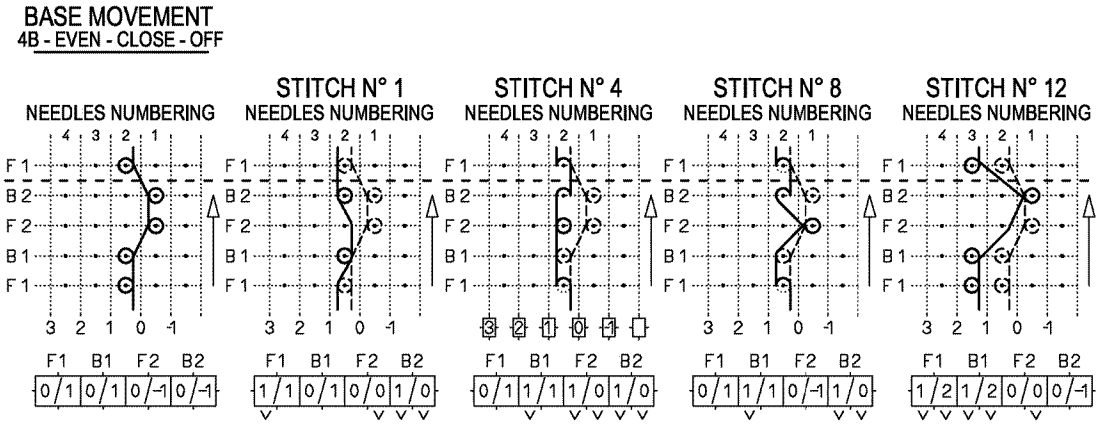
Figure 9:
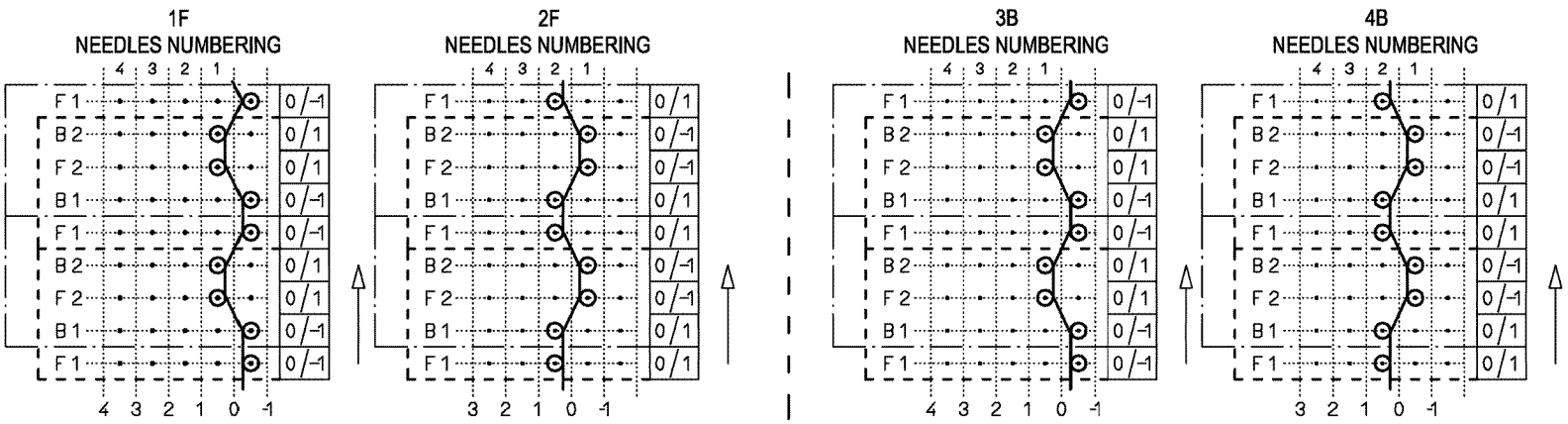
Figure 10:
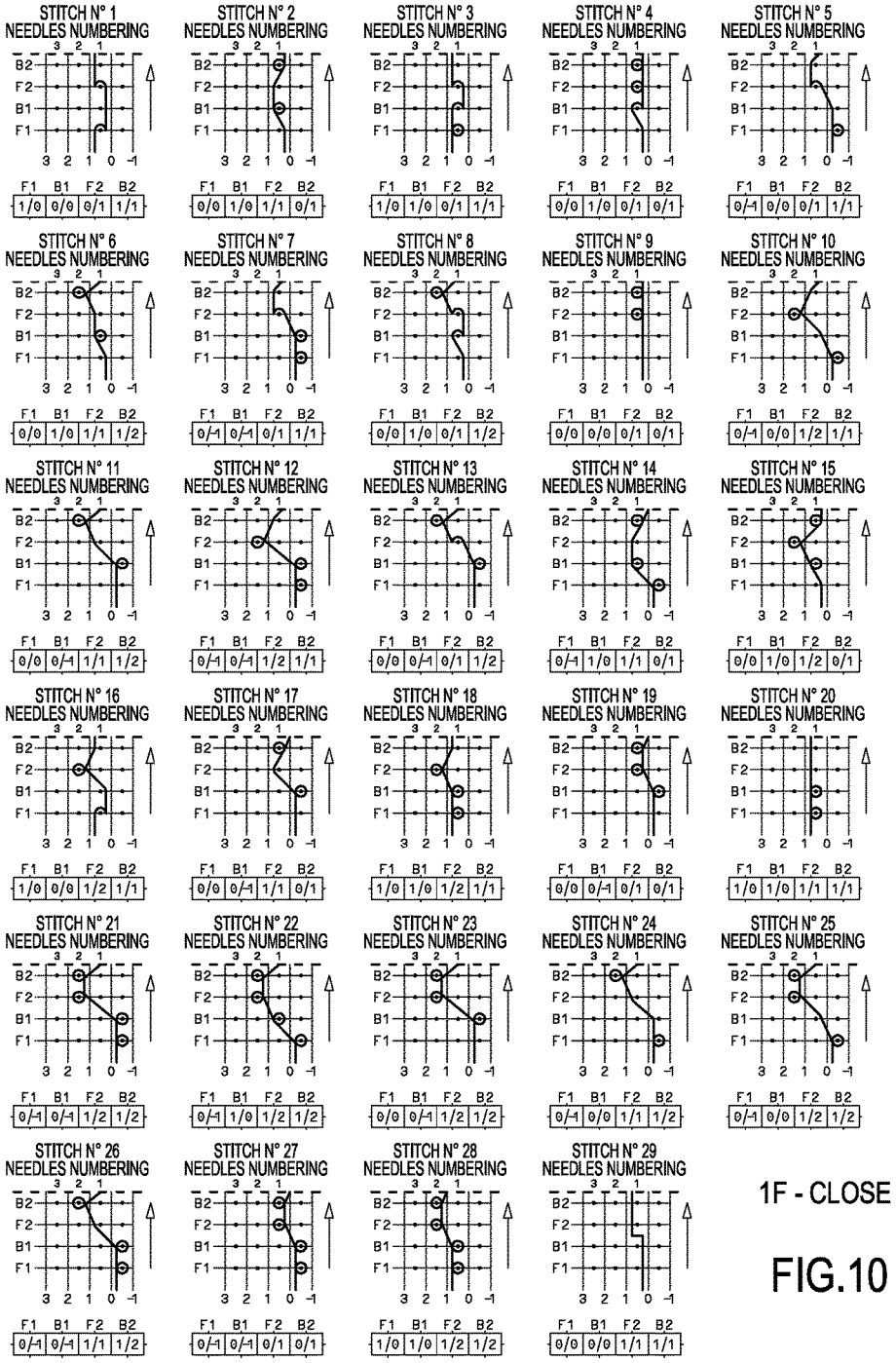
Figure 11:
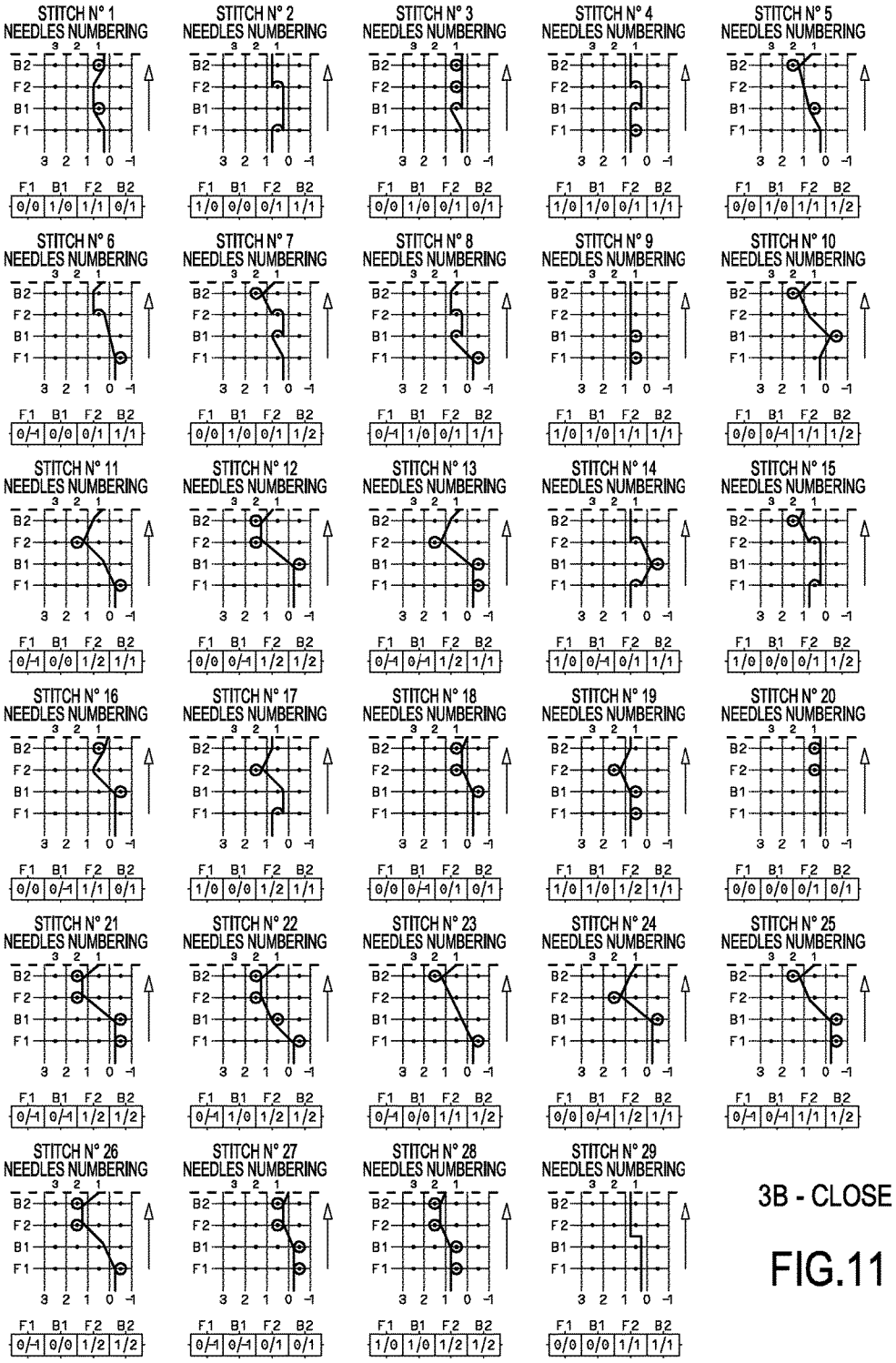
Figure 12:
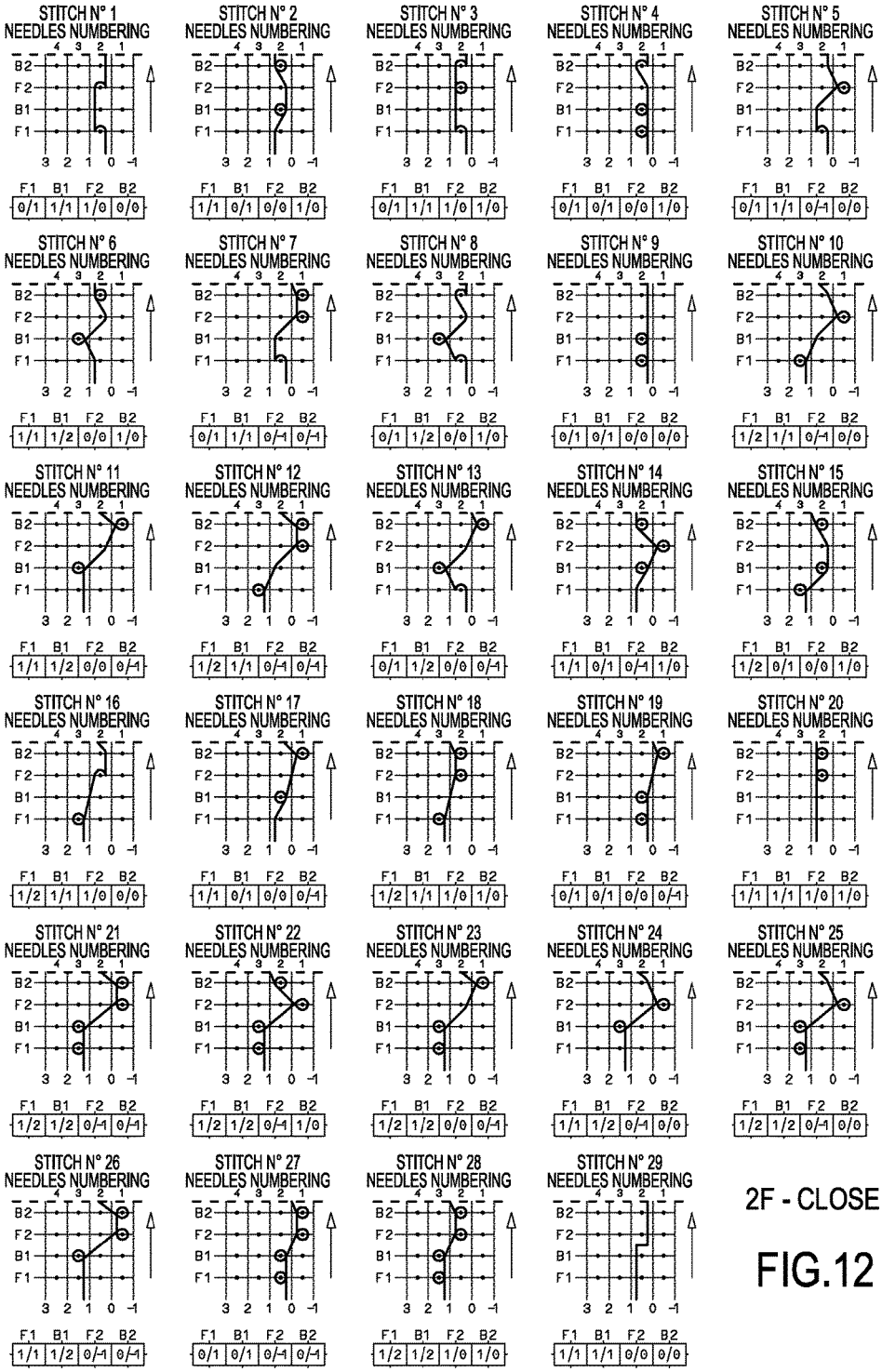
Figure 13:
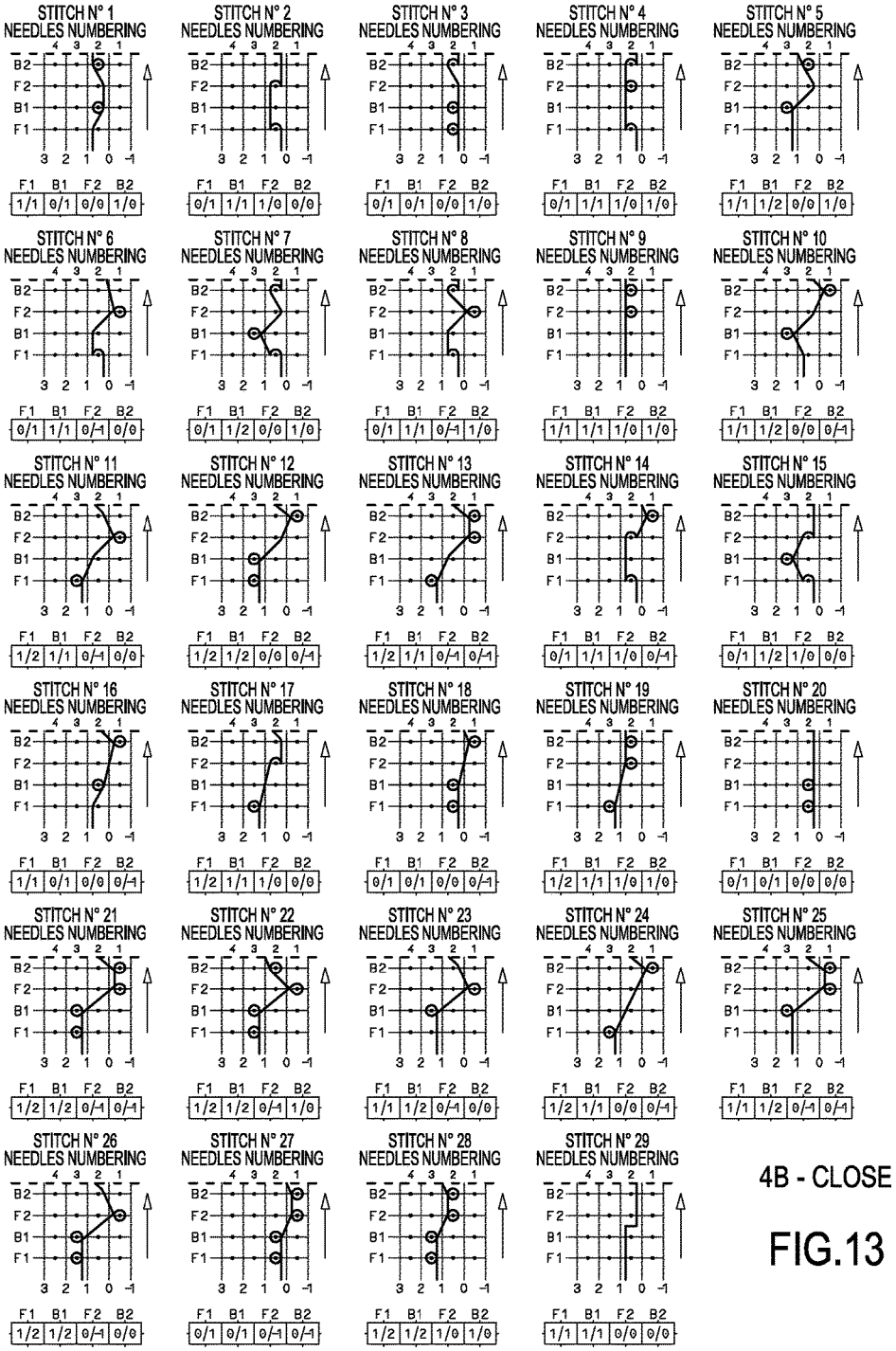
Figure 14:
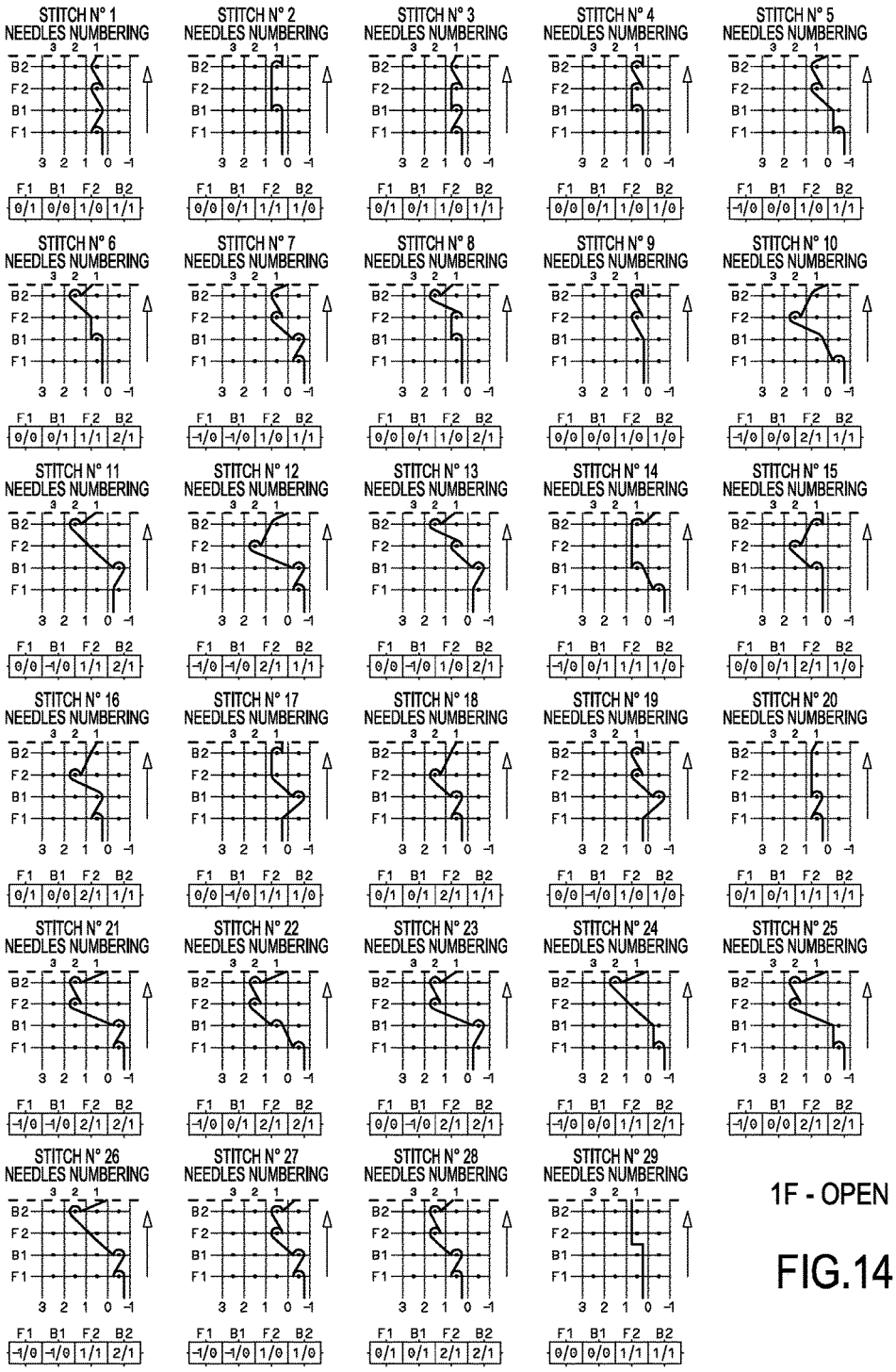
Figure 15:
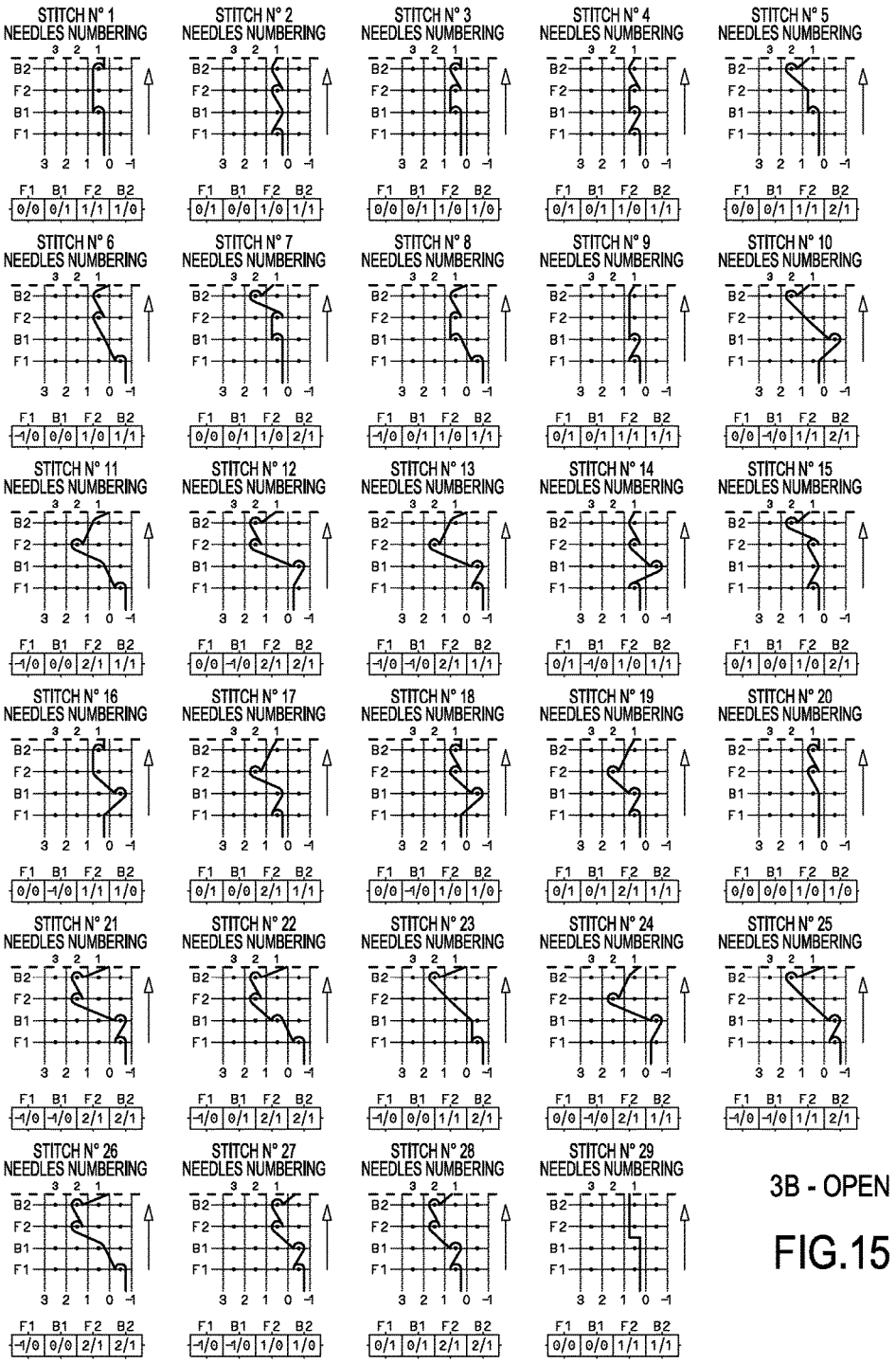
Figure 16:
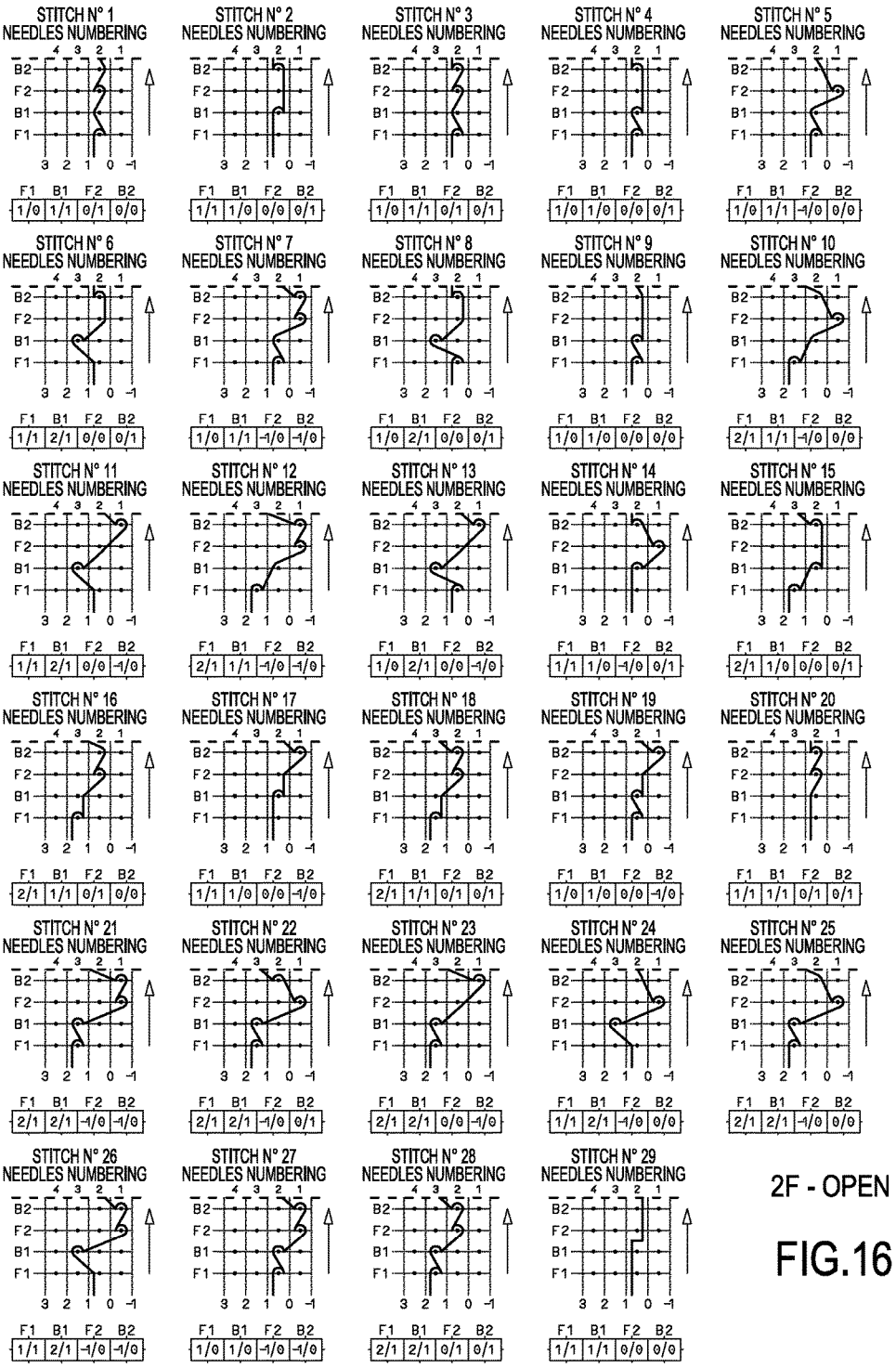
Figure 17:
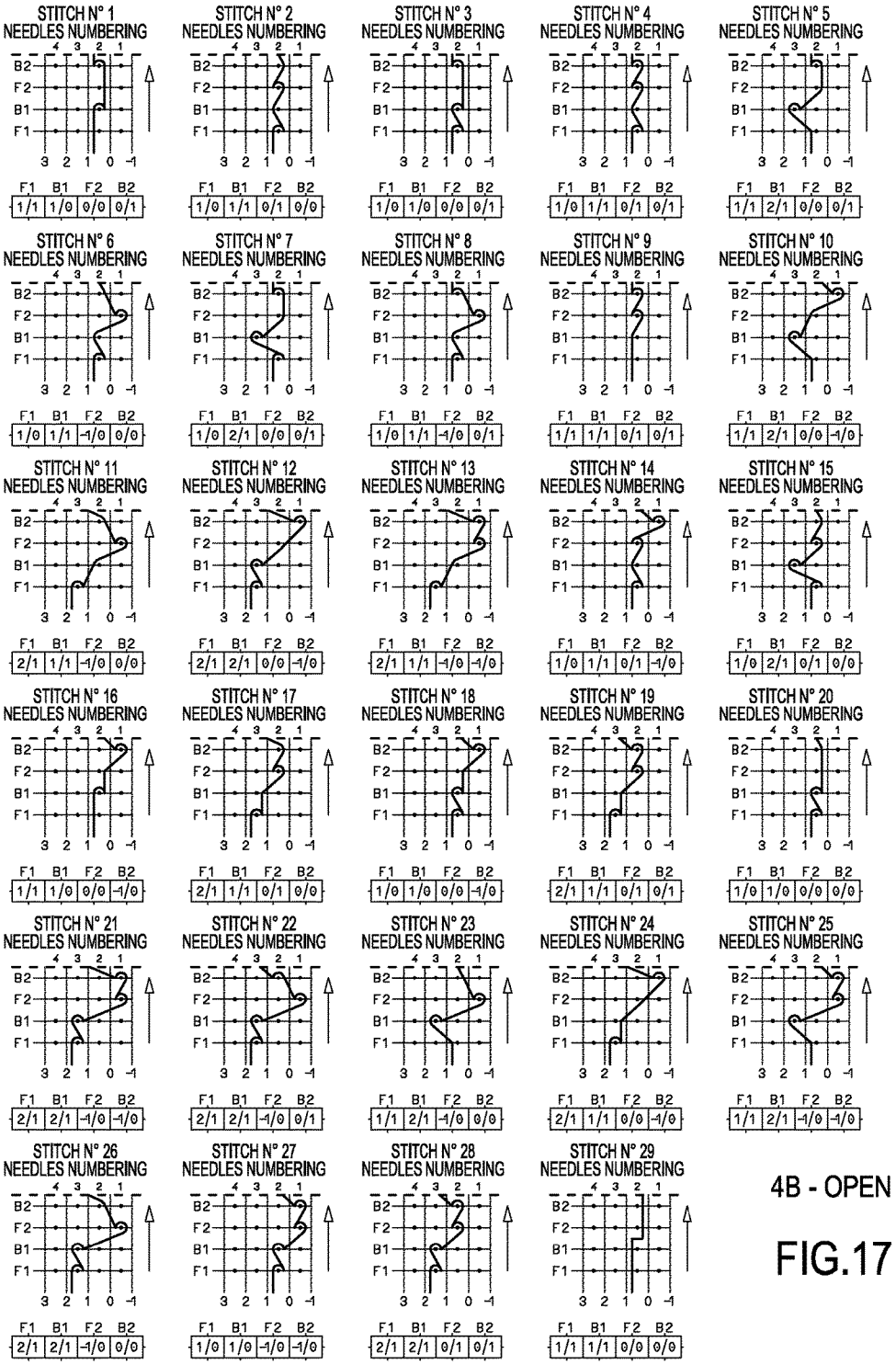
Figure 19:
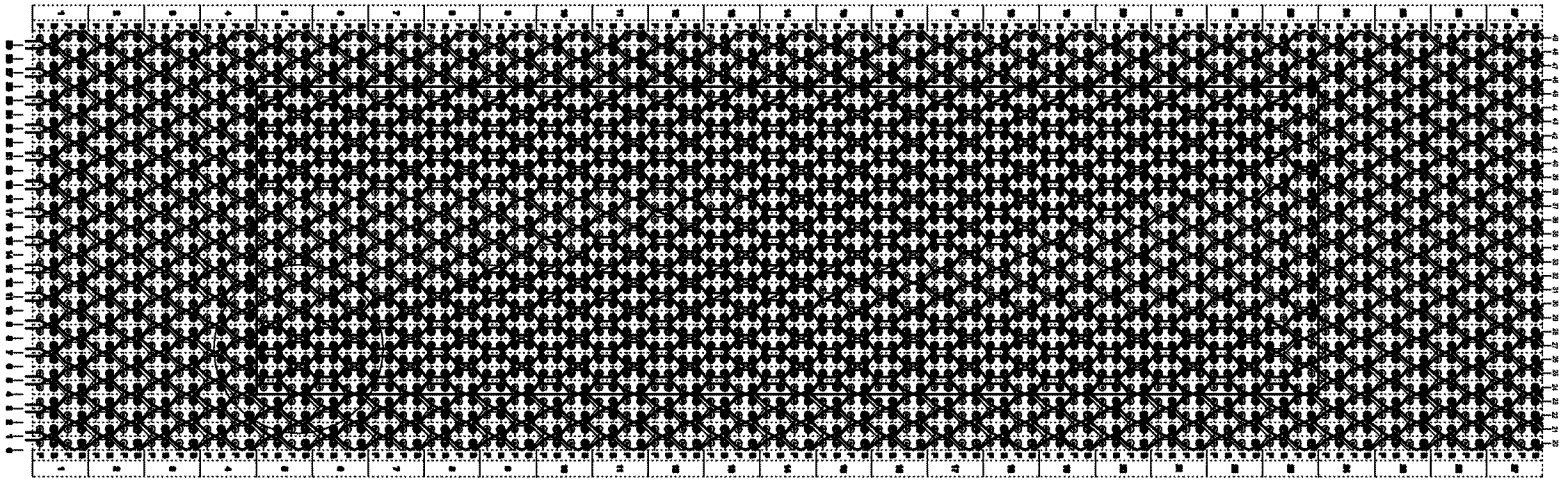
Figure 19A:
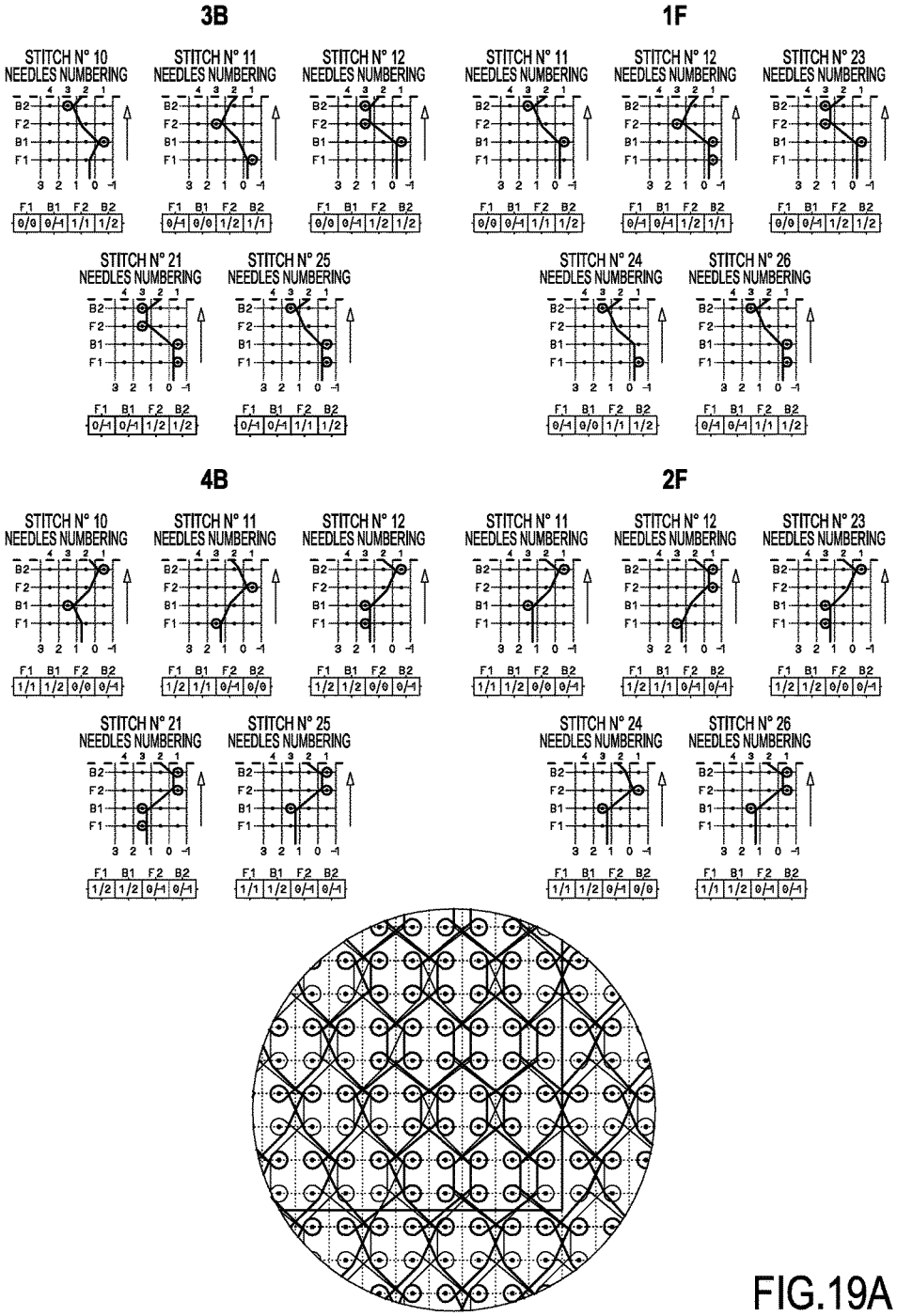
Figure 20:
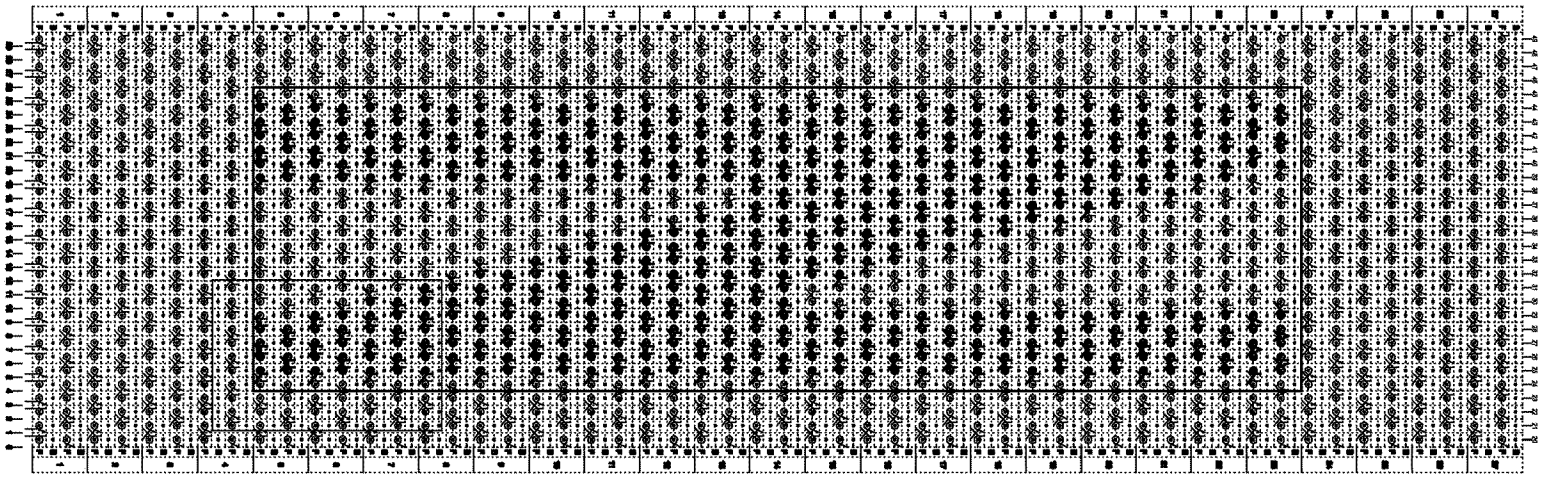
Figure 20A:
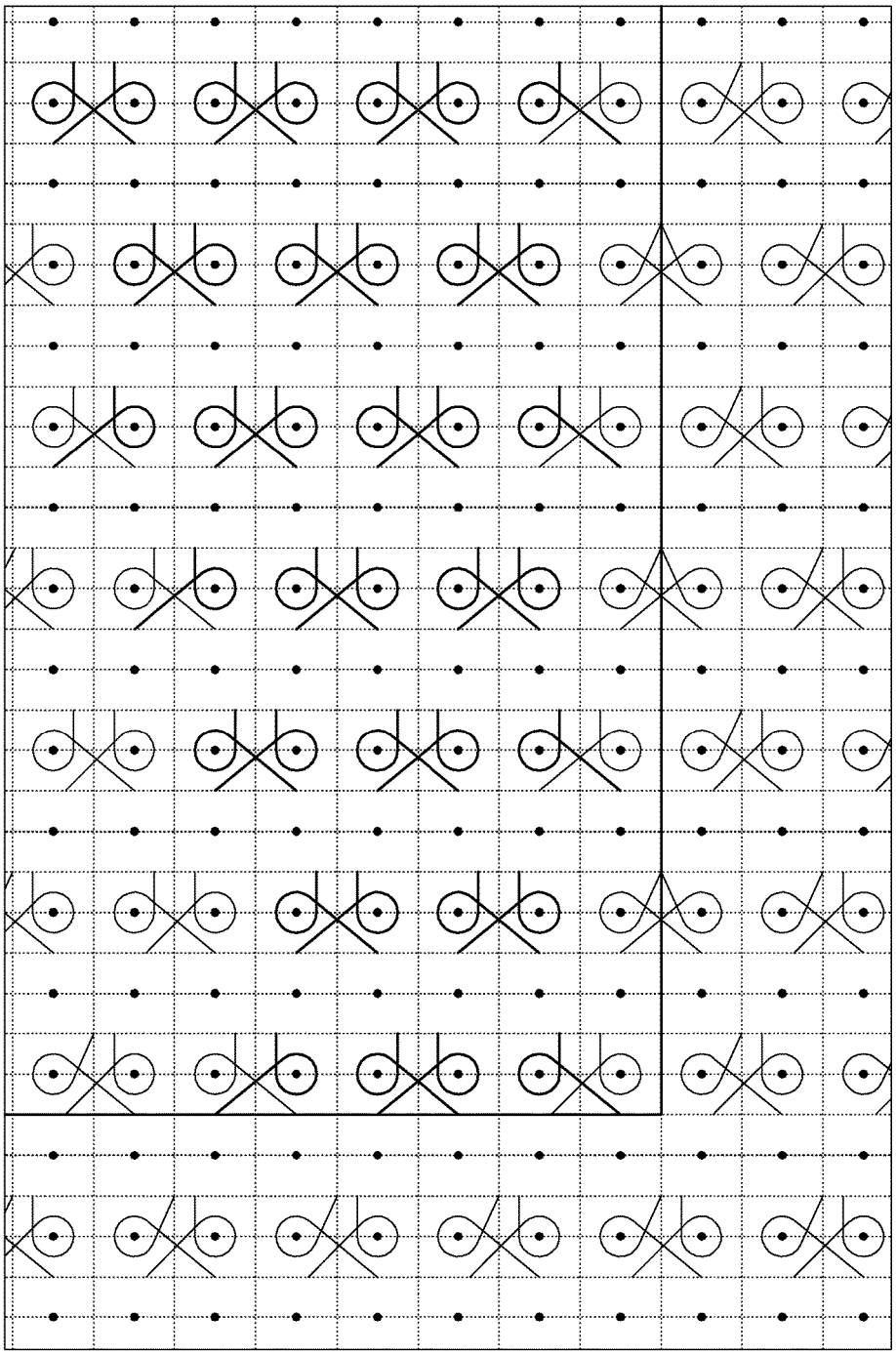
Figure 21:
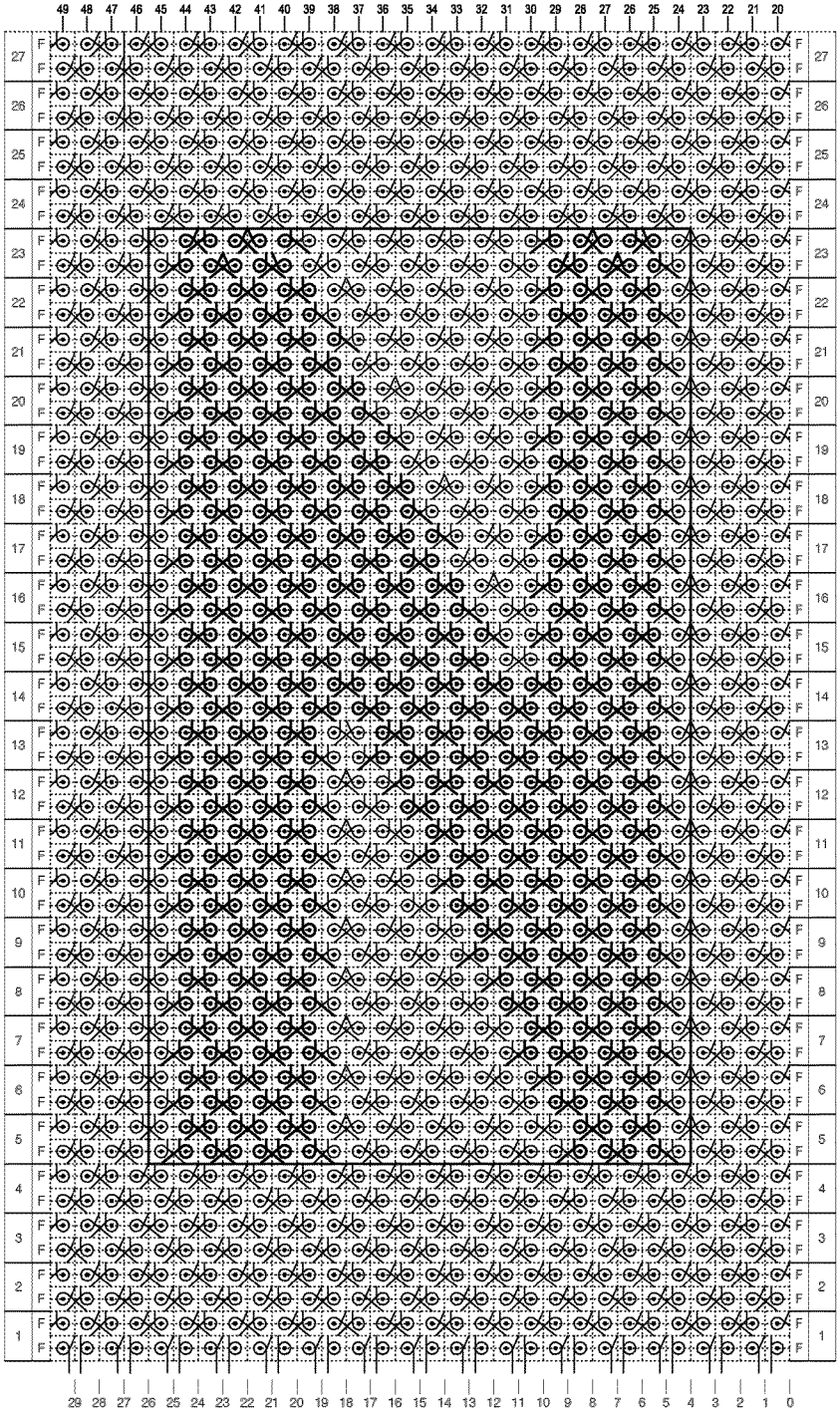
Figure 21A:
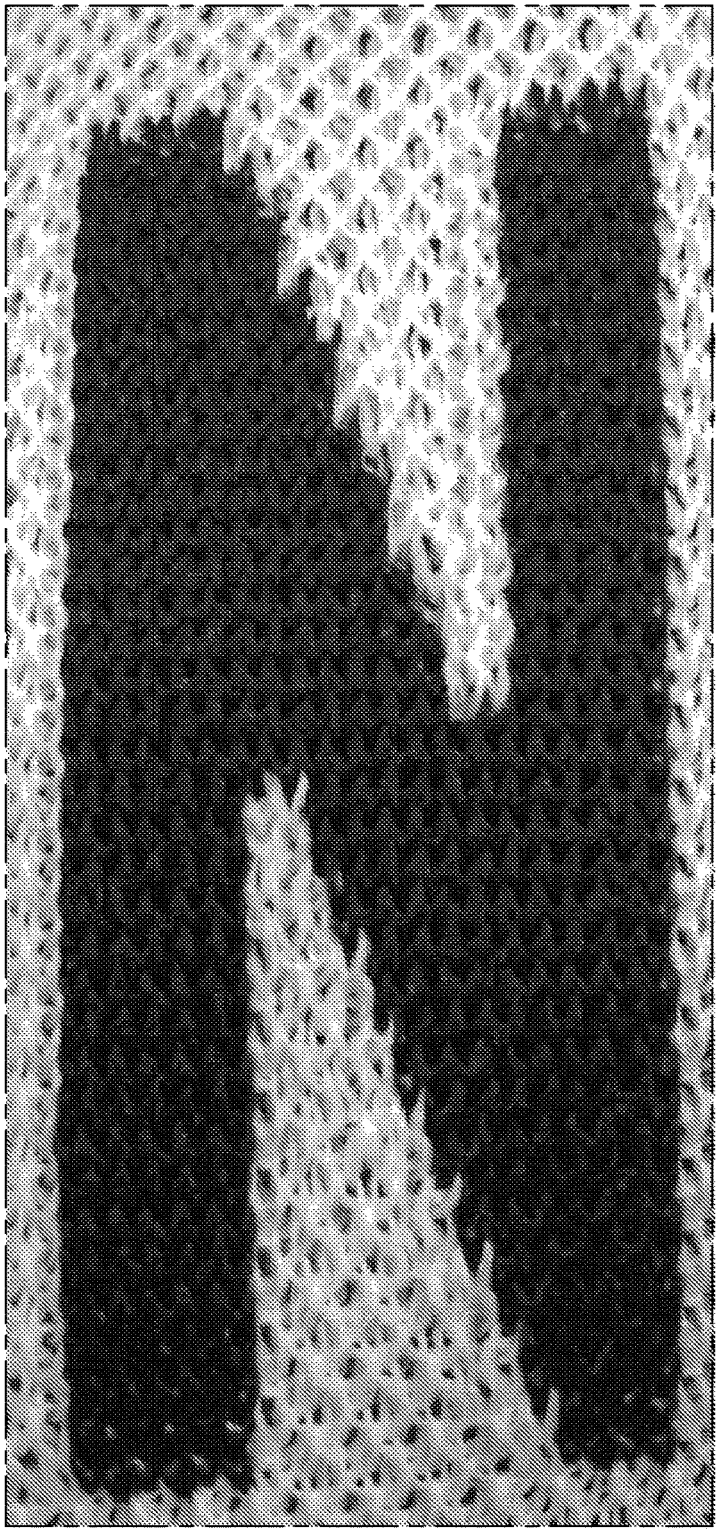
Figure 22:
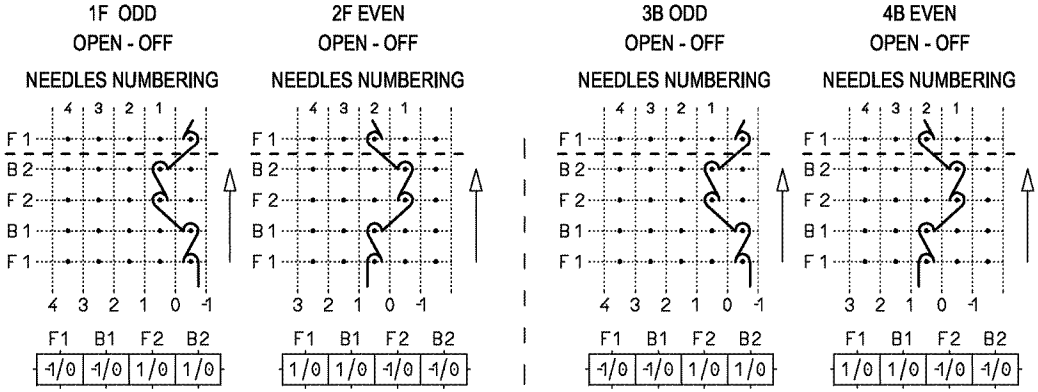
Figure 22A:
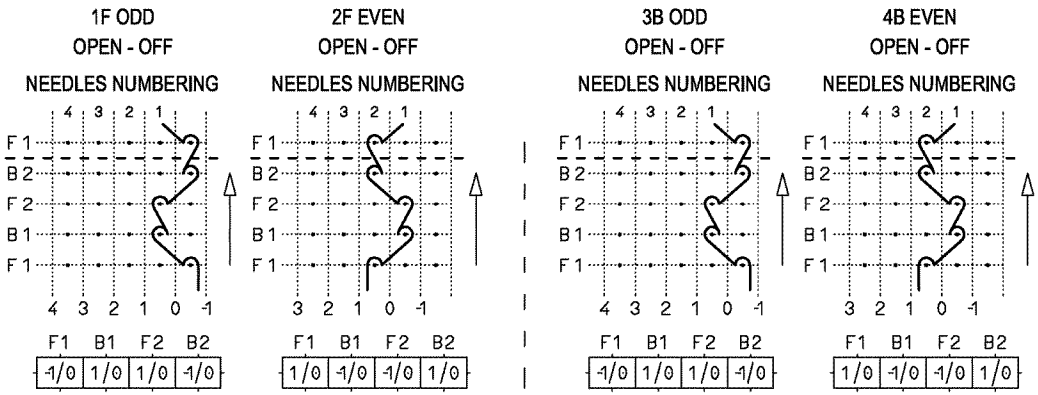
Figure 23:
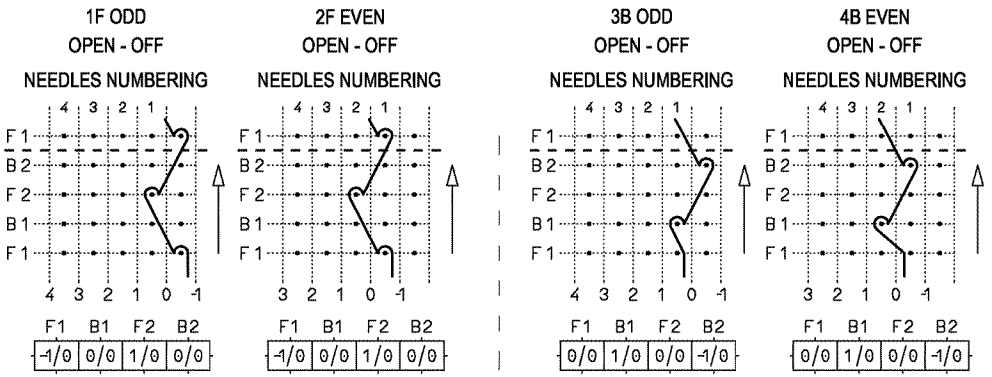
Figure 24:
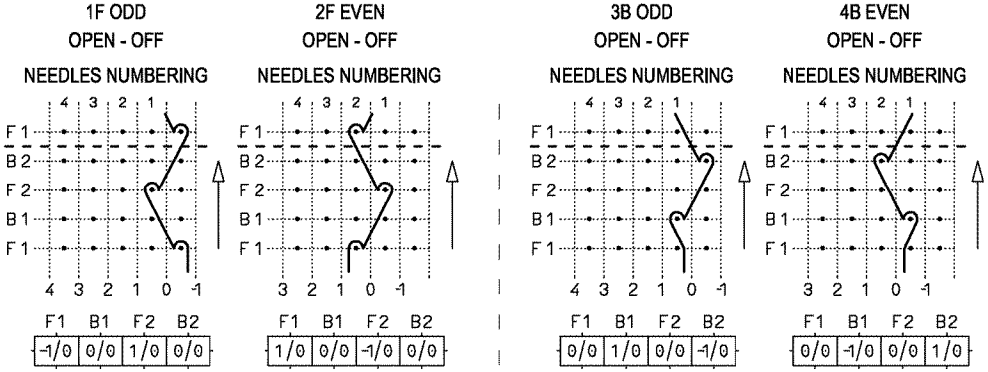
Figure 25:
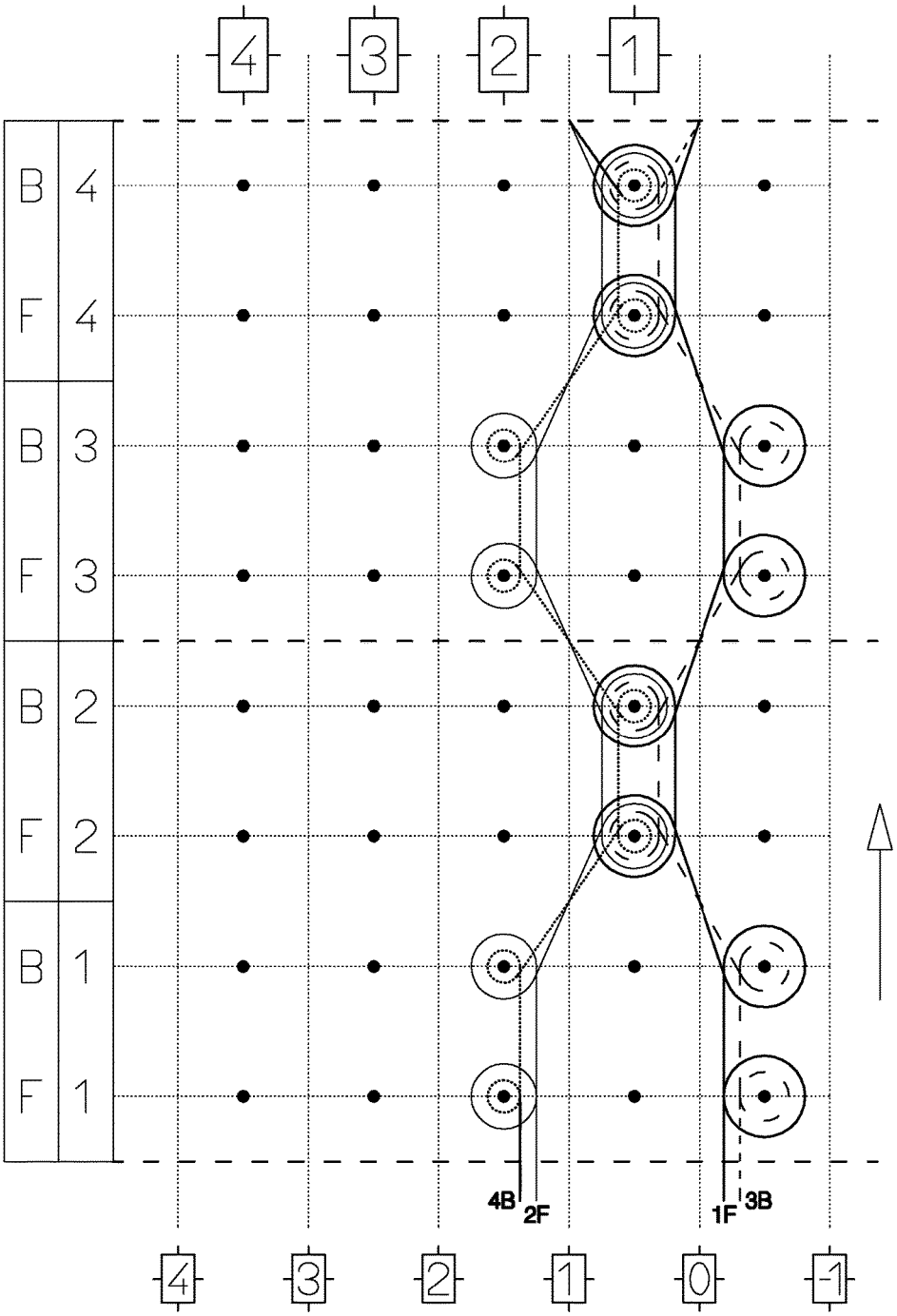
Figure 26:
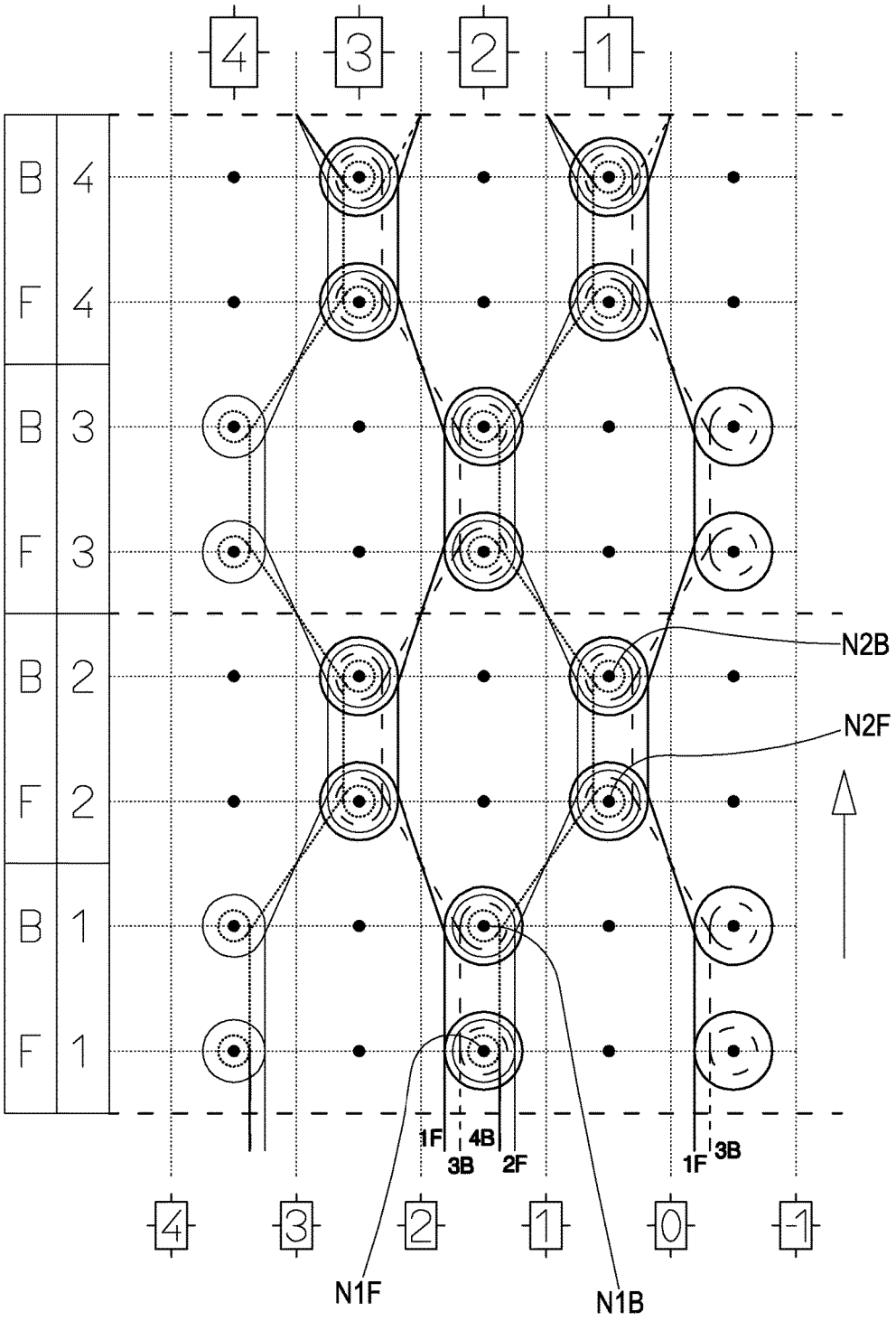
Figure 28:
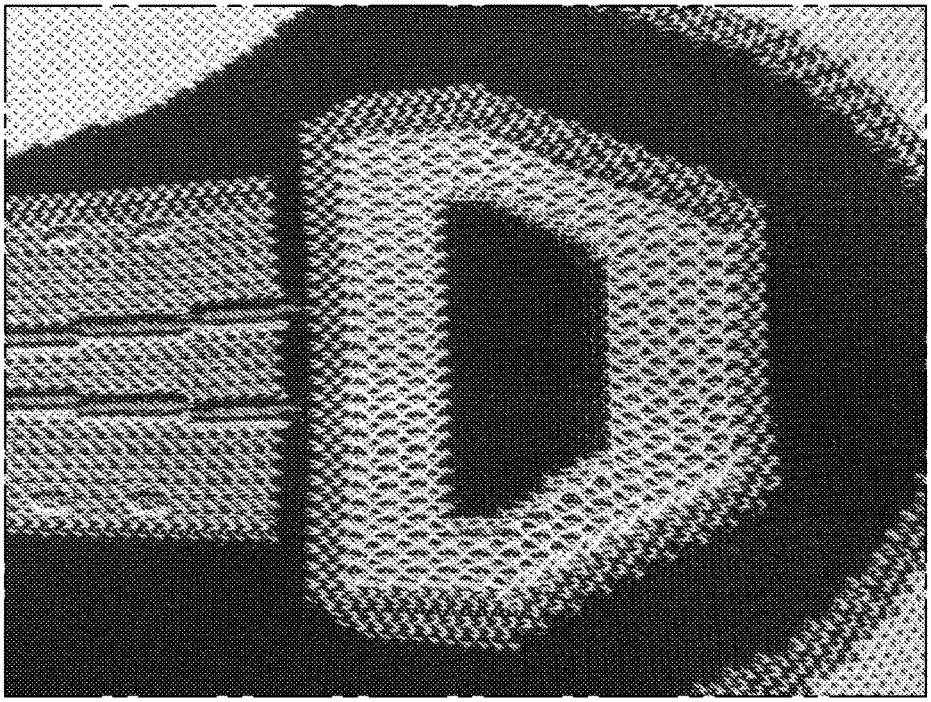
Figure 29:
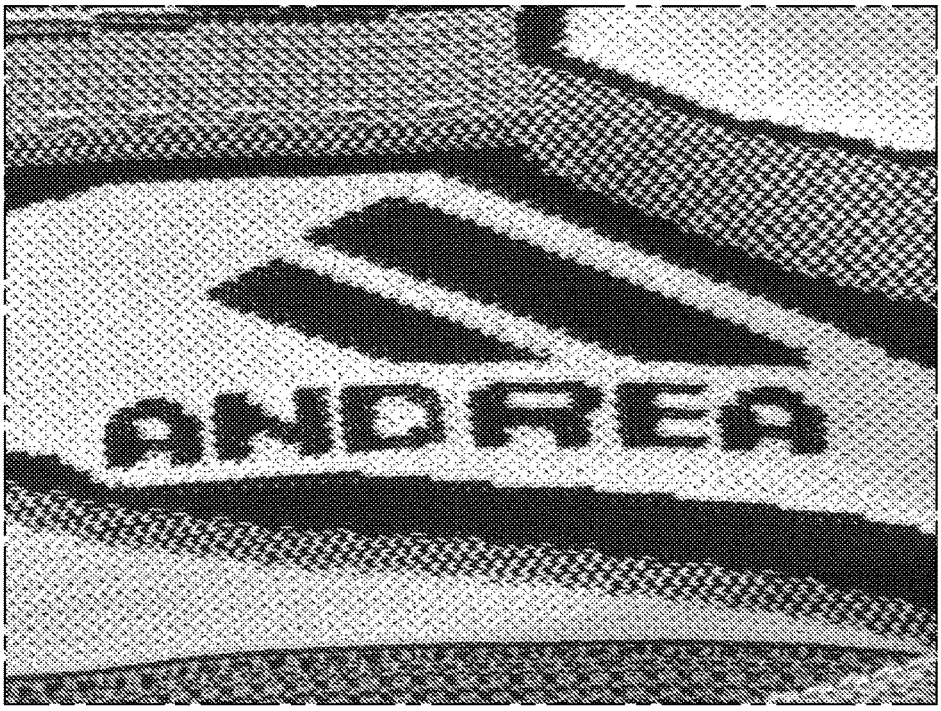
Figure 30:
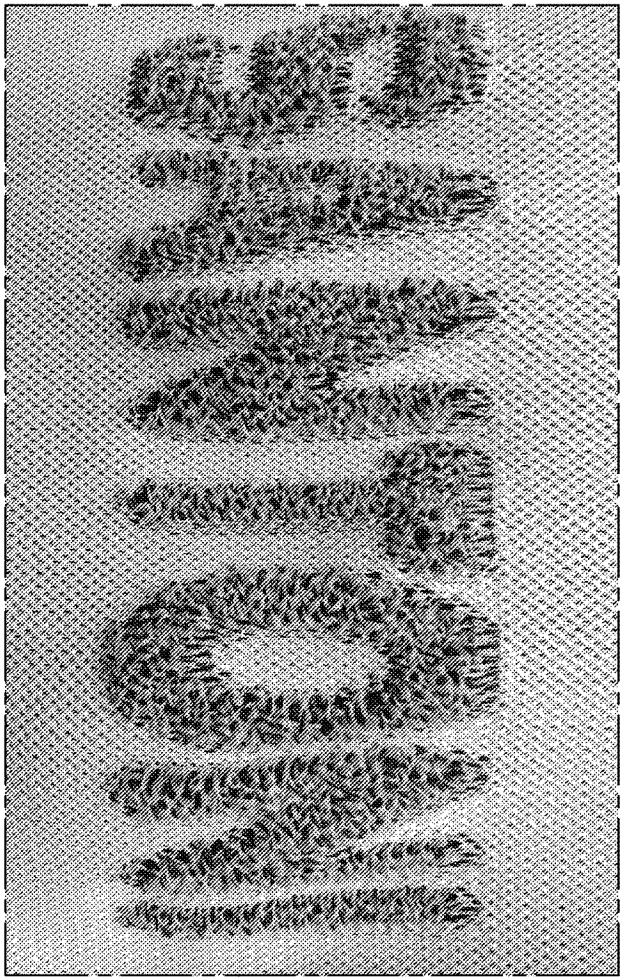
Figure 31:
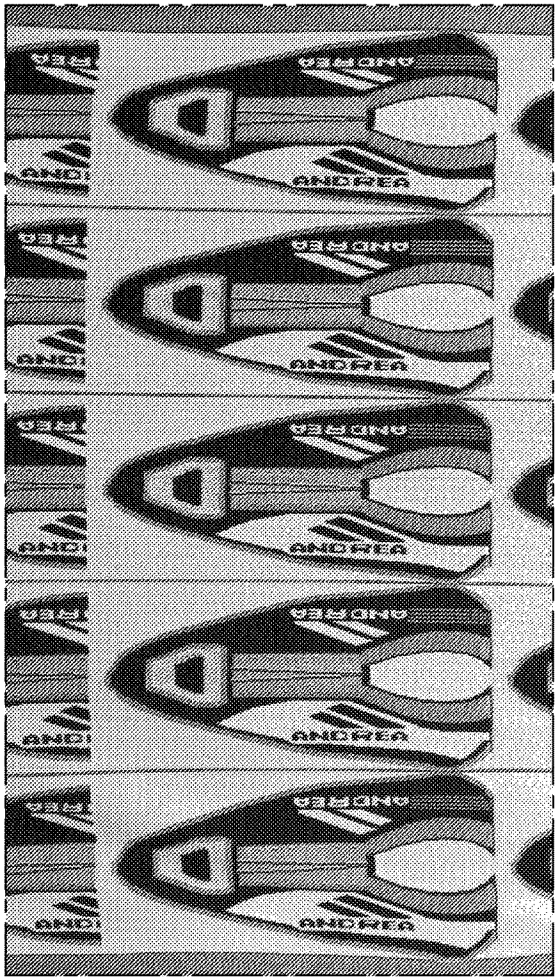
Figure 33:
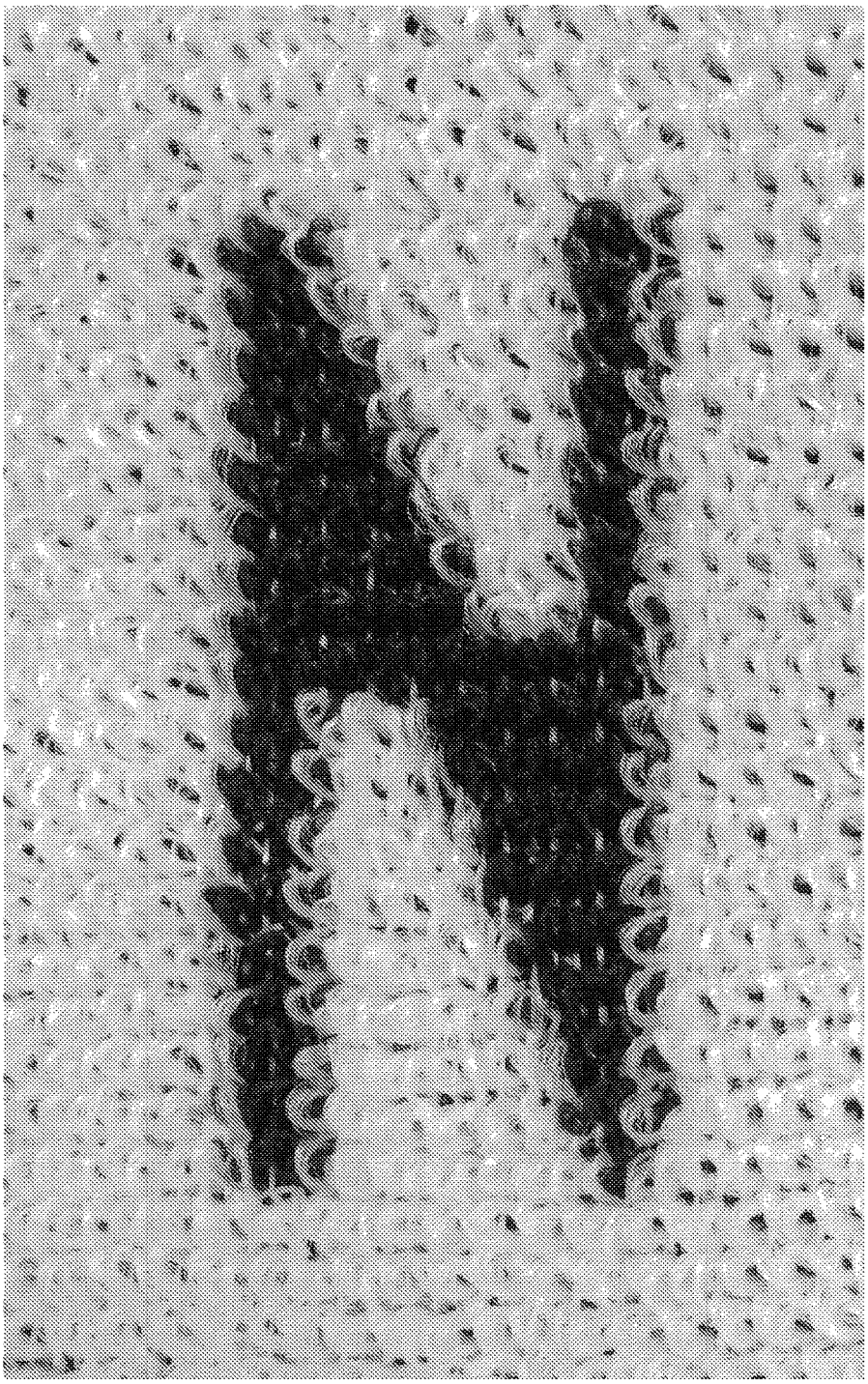
Figure 34:
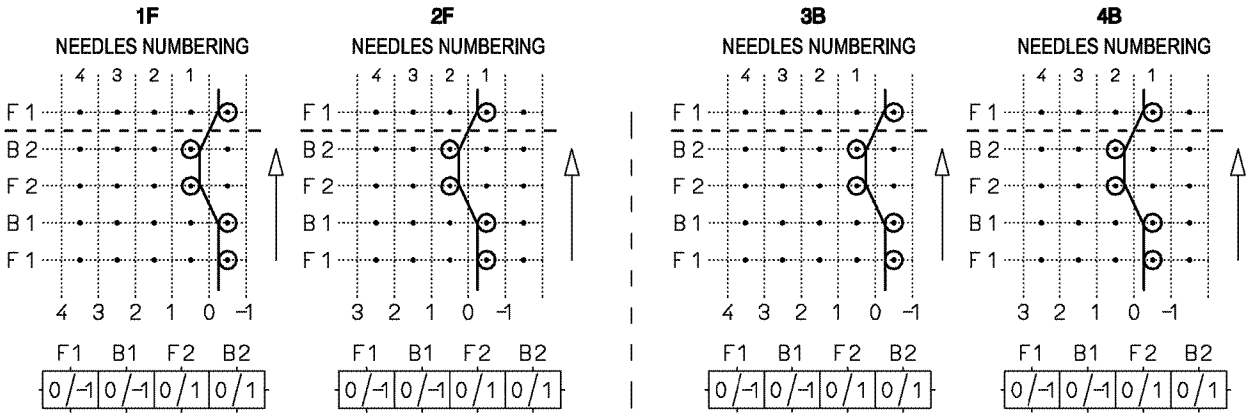
Figure 34A:
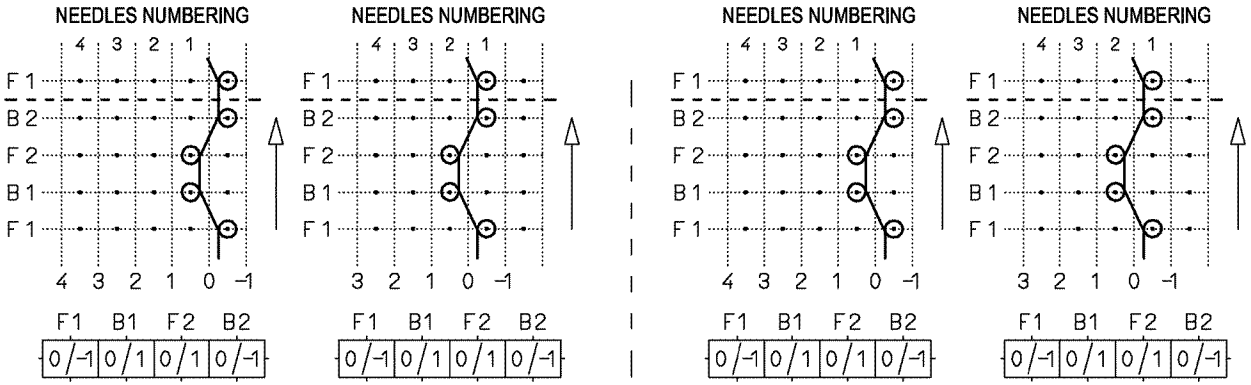
Figure 35:
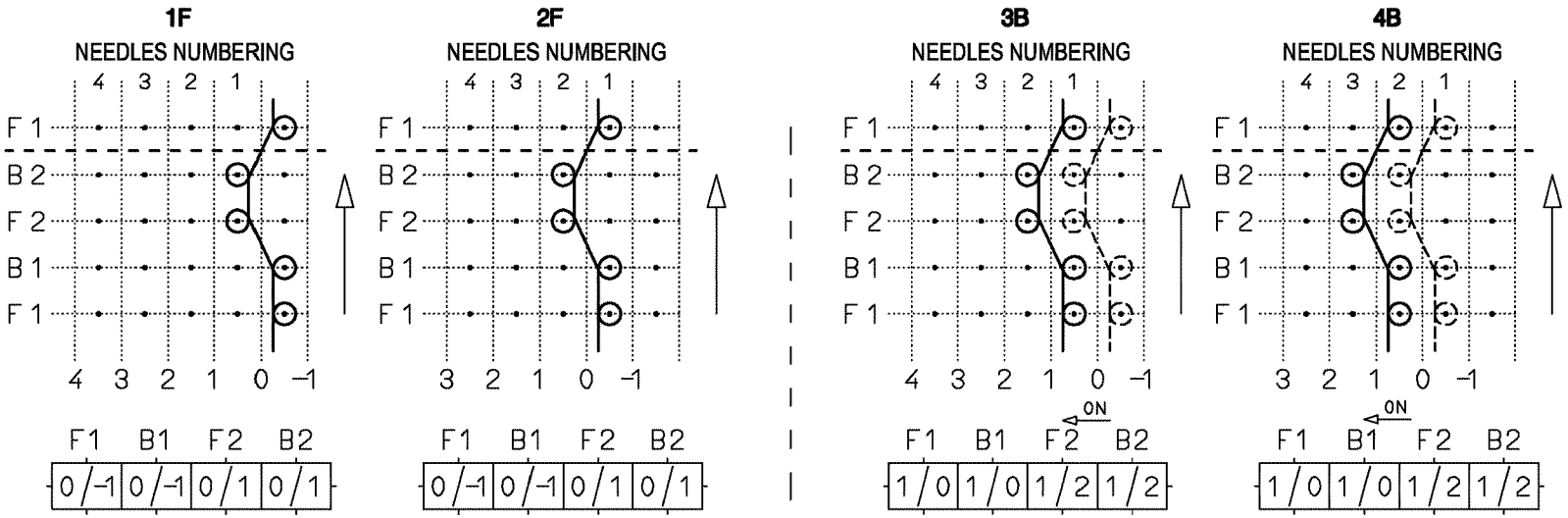
Figure 36:
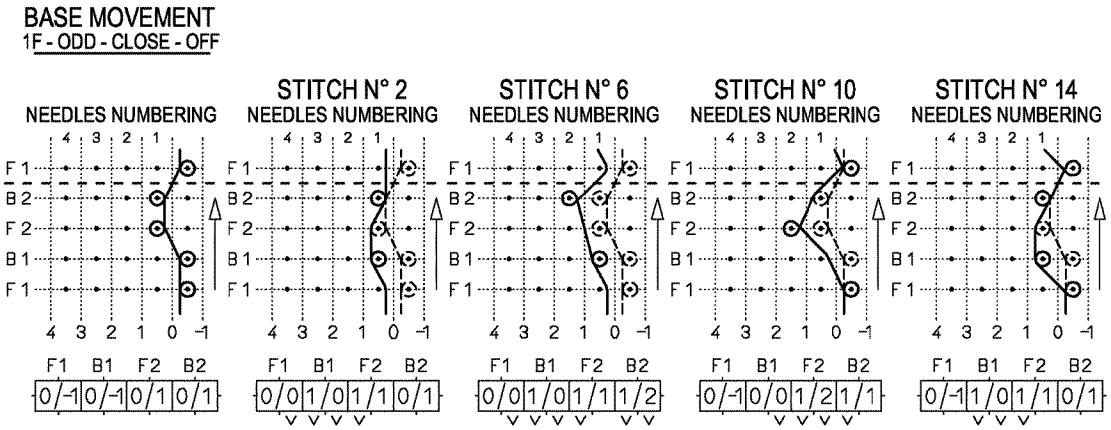
Figure 37:
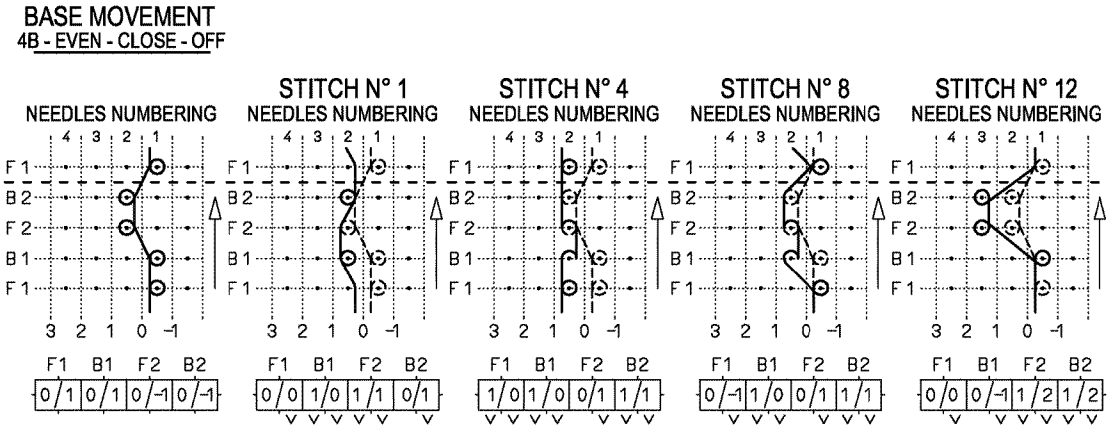
Figure 38:
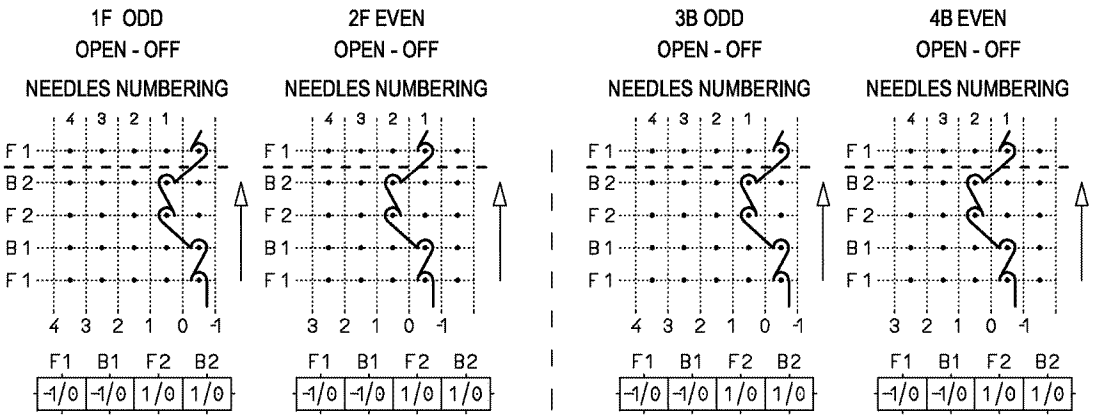
Figure 38A:
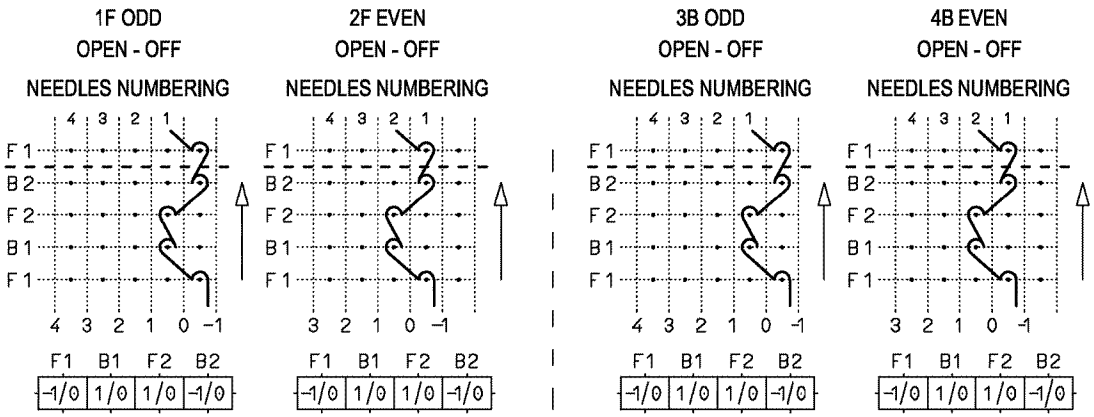
Figure 39:
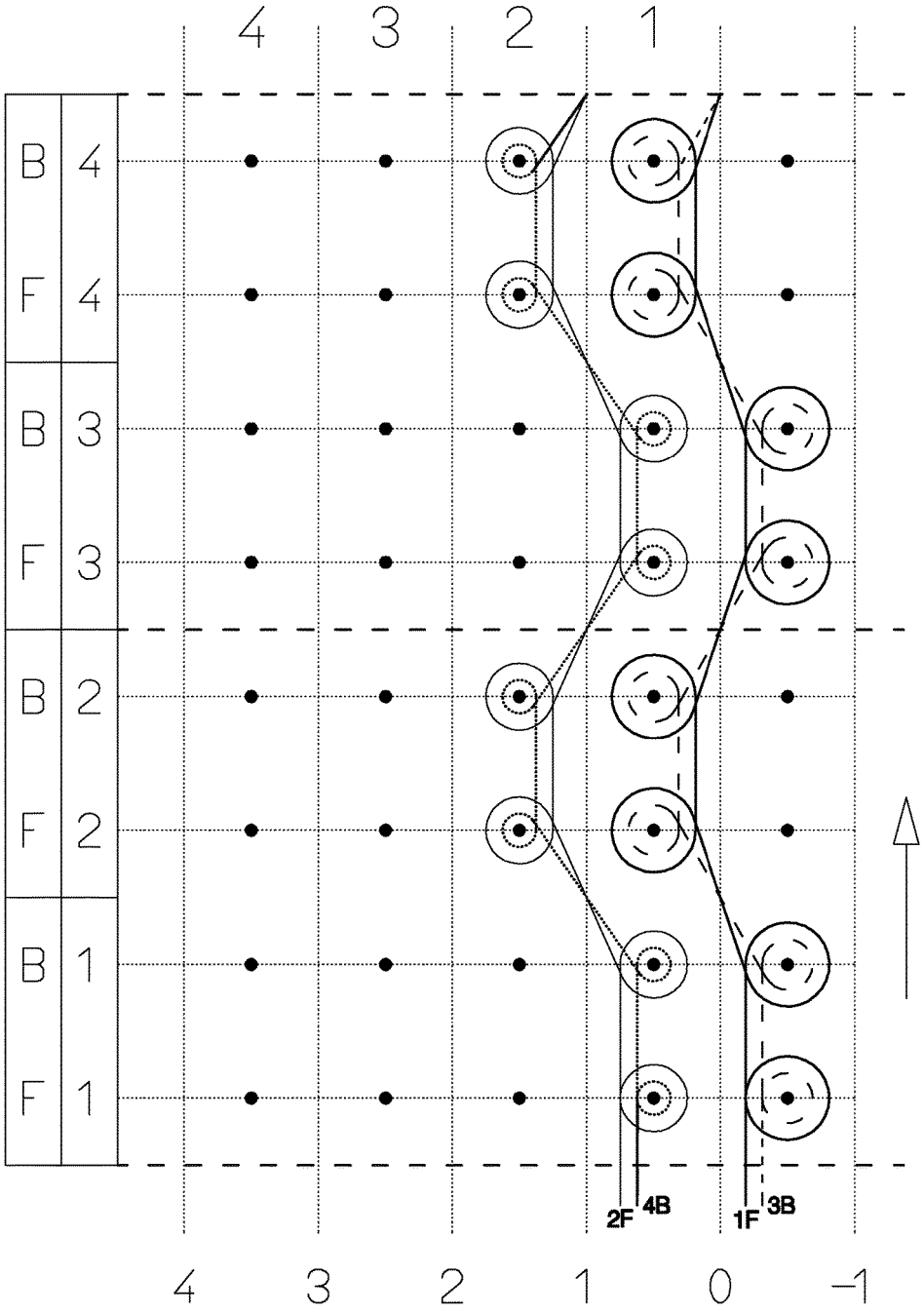
Figure 40:
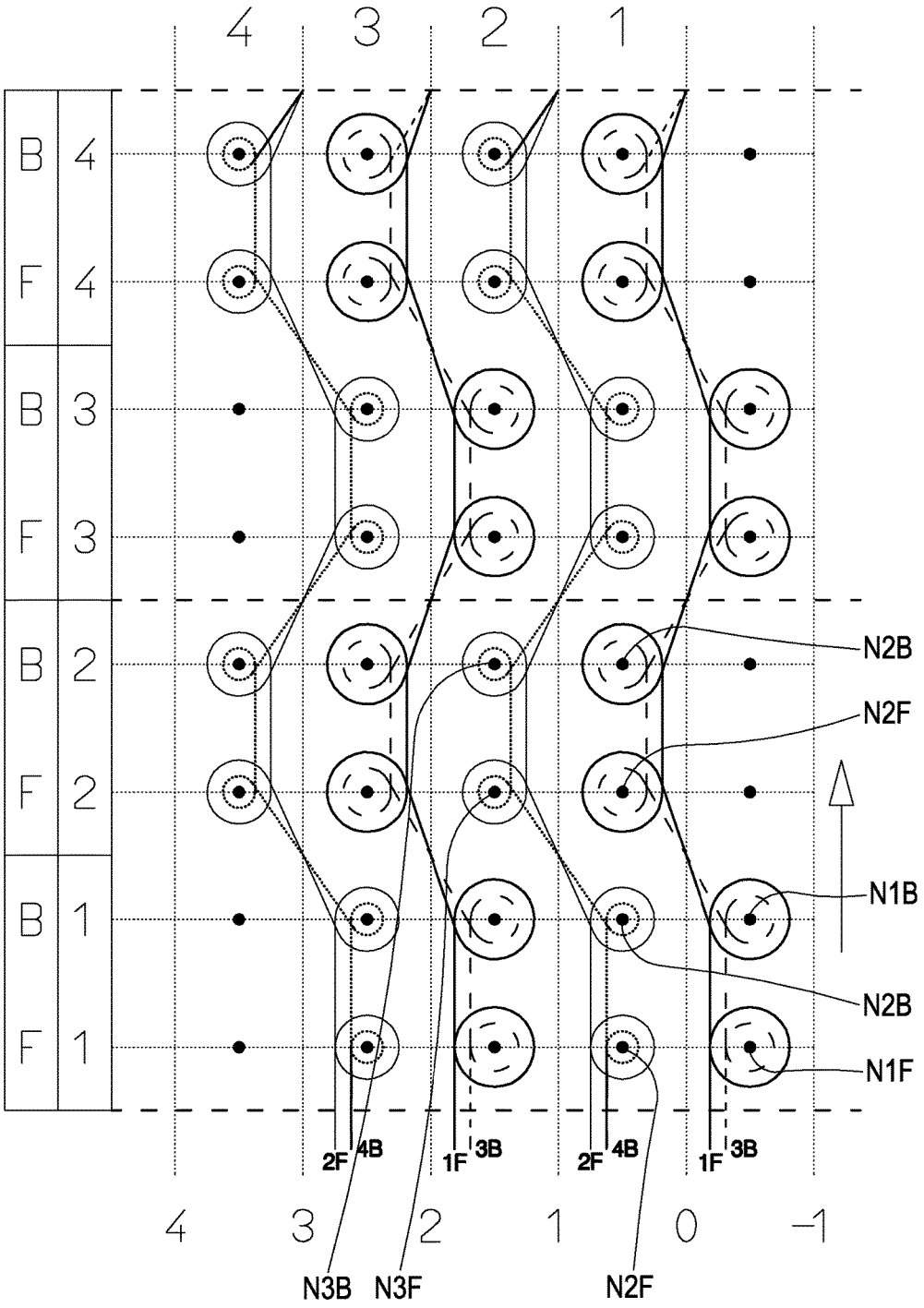

FIG. 6 is a schematic representation of a base movement of the jacquard bars according to a possible embodiment of the process of the present invention, able to carry out a particular knitting operation; in particular the four shog movements of the four jacquard bars are shown, with respect to the two needle beds, and the displacements determined by the activation of the thread guides of the two jacquard bars are highlighted;

FIG. 7 schematically shows the shog movement of a jacquard bar, arranged at a first bed, according to a plurality of example knitting stitches according to the present invention; each stitch is obtained by adding to the base shog movement (shown in the first diagram to the left) one or more jacquard displacements of a thread guide of the jacquard bar;

FIG. 8 schematically shows the shog movement of a jacquard bar, arranged at a second bed, according to a plurality of example knitting stitches according to the present invention; each stitch is obtained by adding to the base shog movement (shown in the first diagram to the left) one or more jacquard displacements of a thread guide of the jacquard bar;

FIG. 9 schematically shows the base movement of FIG. 2 or 2A, repeated cyclically for a plurality of knitted rows; the figure further shows, internally of a plurality of knitting rows, how it is possible to isolate a base movement of the jacquard bars according to the present invention; in substance, the diagram of FIG. 9 comprises, according to the sequence of four half-rows of consecutive knitting considered, both the diagram of FIG. 2 and that of FIG. 2A;

FIG. 10 schematically shows a plurality of knitting stitches obtainable by means of the process of the present invention and combined with a thread guide of a first jacquard bar 1F (arranged at the first bed); each of the knitting stitches shown is obtainable by adding (for each half-row of knitting) one or more respective jacquard displacements of the thread guide to the base movement of the first bar shown in FIG. 2 (close knitting stitches);

FIG. 11 schematically illustrates a plurality of knitting stitches obtainable by means of the process of the present invention and combined with a thread guide of a third jacquard bar 3B (arranged at the second bed); each of the knitted stitches shown is obtainable by summing (for each half-row of knitting) one or more respective jacquard displacements of the thread guide to the base movement of the third bar shown in FIG. 2 (close knitting stitches);

FIG. 12 schematically shows a plurality of knitting stitches obtainable by means of the process of the present invention and combined with a thread guide of a second jacquard bar 2F (arranged at the first bed); each of the knitting stitches shown is obtainable by summing (for each half-row of knitting) one or more respective jacquard displacements of the thread guide to the base movement of the second bar shown in FIG. 2 (close knitting stitches);

FIG. 13 schematically shows a plurality of knitting stitches obtainable by means of the process of the present invention and combined with a thread guide of a fourth jacquard bar 4B (arranged at the first bed); each of the knitting stitches shown is obtainable by summing (for each half-row of knitting) one or more respective jacquard displacements of the thread guide to the base movement of the fourth bar shown in FIG. 2 (close knitting stitches);

FIG. 14 schematically shows a plurality of knitting stitches obtainable by means of the process of the present invention and combined with a thread guide of a first jacquard bar 1F (arranged at the first bed); each of the knitting stitches shown is obtainable by summing (for each half-row of knitting) one or more respective jacquard displacements of the thread guide to the base movement of the first bar shown in FIG. 22 (open knitting stitches);

FIG. 15 schematically shows a plurality of knitting stitches obtainable by means of the process of the present invention and combined with a thread guide of a third jacquard bar 3B (arranged at the second bed); each of the knitting stitches shown is obtainable by summing (for each half-row of knitting) one or more respective jacquard displacements of the thread guide to the base movement of the third bar shown in FIG. 22 (open knitting stitches);

FIG. 16 schematically shows a plurality of knitting stitches obtainable by means of the process of the present invention and combined with a thread guide of a second jacquard bar 2F (arranged at the first bed); each of the knitting stitches shown is obtainable by summing (for each half-row of knitting) one or more respective jacquard displacements of the thread guide to the base movement of the second bar shown in FIG. 22 (open knitting stitches);

FIG. 17 schematically shows a plurality of knitting stitches obtainable by means of the process of the present invention and combined with a thread guide of a fourth jacquard bar 4B (arranged at the second bed); each of the knitting stitches shown is obtainable by summing (for each half-row of knitting) one or more respective jacquard displacements of the thread guide to the base movement of the fourth bar shown in FIG. 22 (open knitting stitches);

FIG. 18 shows by way of example a programming diagram of the jacquard bars of a linear knitting machine for performing a process according to the present invention; in particular the diagram shows, by way of example, a selection of knitting stitches, according to the preceding FIGS. 10-13, to be realized by a group of adjacent thread guides (on each jacquard bar) for a determined number of rows of knitting with the aim of obtaining a portion of fabric having determined characteristics;

FIG. 19 schematically shows a portion of fabric realized using the process of the present invention and attributing to the jacquard bars the programming pattern of the jacquard bars of FIG. 18; in particular, the pathways of the threads carried by the thread guides at work are illustrated, superposed on one another, with respect to the needles of the two beds, on the basis of the knitting stitches selected in the programming pattern; the knitted stitches shown relate to both the beds;

FIG. 19A shows the knitting stitches used in the pattern of FIG. 19 for each of the four bars and a larger-scale view of a portion of the stitching of FIG. 19;

FIG. 20 is like FIG. 19, but schematically illustrates the knitted stitches only on the front bed;

FIG. 20A shows a larger-scale view of a portion of stitching of knitted stitches of FIG. 20;

FIG. 21 relates to the same process of FIGS. 19 and 20, and shows a knitting pattern in which the horizontal rows represent successive half-rows of knitting only on the first bed (or front bed); in other words, the stitches on the first bed are visible, while the half-rows relating to the second bed (or back bed) are "hidden";

FIG. 21A illustrates, with a photograph, the knitted article realised by means of the process of the present invention, by applying the knitting pattern of FIGS. 18, 19, 20 and 21;

FIG. 22 schematically illustrates a base movement of the jacquard bars according to a third embodiment of the process of the present invention; in particular, a third embodiment of the four shog movements of the four jacquard bars, with respect to the two needle beds, the shog movements realizing a plurality of open knitting stitches;

FIG. 22A schematically illustrates a base movement of the jacquard bars according to a fourth embodiment of the process of the present invention; in particular, a fourth embodiment of the four shog movements of the four jacquard bars is shown, with respect to the two needle beds, the shog movements realizing a plurality of open knitting stitches; in substance, the base movement of FIG. 22A is that same as in FIG. 22, but translated by a half-row of knitting with respect thereto:

FIG. 23 schematically illustrates a base movement of the jacquard bars according to the prior art; in particular shog movement of known type are illustrated of the four jacquard bars, with respect to the two needle beds, the shog movements realising a plurality of open knitted stitches;

FIG. 24 schematically illustrates a further base movement of the jacquard bars according to the prior art; in particular, further shog movements of known type of the four jacquard bars are illustrated, the shog movements realizing a plurality of open knitting stitches;

FIG. 25 schematically illustrates the knitting stitches realised by four corresponding thread guides, one for each jacquard bar, by means of the base movement of FIG. 2 (and without any jacquard selection); the knitted stitches are show for four rows of knitting;

FIG. 26 is alike FIG. 25, but schematically illustrates the knitted stitches realised by a plurality of adjacent thread guides of the four jacquard bars, by means of the base movement of FIG. 2 (and with no jacquard selection), on a group of adjacent needles of the first and the second bed; the knitted stitches are shown, in repetition, for four rows of knitting;

FIG. 27 is an example of a further programming pattern of the jacquard bars of a linear knitting machine for carrying out a process according to an embodiment of the present invention; in particular, the pattern describes, by way of example, a selection of knitting stitches, according to preceding FIGS. 10-13, to be carried out by a group of adjacent thread guides (on each jacquard bar) for a determined number of rows of knitting with the aim of obtaining a portion of fabric having a sponge effect;

FIG. 28 illustrates, by means of a photograph, an example of a knitted article made by means of the process of the present invention; in this case the articles is a shoe upper;

FIG. 29 illustrates, by means of a photograph, a further example of a knitted article realized by means of the process of the present invention; in this case the article is a further shoe upper;

FIG. 30 illustrates, by means of a photograph, a further example of a knitted article realised using the process of the present invention; in this case the example is a portion of fabric with letters realised using the sponge effect on a sharply-defined background;

FIG. 31 is a photograph of a whole sheet of fabric, by way of example, realised by a linear knitting machine for warp knitting by means of the process of the present invention, the sheet comprising, by way of example, horizontal series of knitted portions each destined to form a shoe upper;

FIG. 32 is an example of a further programming pattern of the jacquard bars of a linear knitting machine for carrying out a process according to an embodiment of the present invention; in particular, the pattern shows, by way of example, a selection of knitting stitches, according to preceding FIGS. 10-13, to be carried out by a group of adjacent thread guides (on each jacquard bar) for a determined number of rows of knitting with the aim of obtaining a portion of fabric with a sponge effect on a background also exhibiting a sponge effect (of a different colour);

FIG. 33 illustrates, by means of a photograph, the knitted article realised by means of the process of the present invention, applying the programming pattern of FIG. 32;

FIG. 34 schematically shows a base movement of the jacquard bars according to a further possible embodiment of the process of the present invention; in particular, a further embodiment of the four shog movements of the four jacquard bars is shown, with respect to two needle beds, the shog movements realising a plurality of close knitted stitches;

FIG. 34A schematically illustrates a base movement of the jacquard bars according to a further embodiment of a further embodiment of the process of the present invention; in particular, a further embodiment of the four shog movements of the four jacquard bars is illustrated, with respect to the two needle beds, the shog movements realizing a plurality of close knitted stitches; in substance, the base movement of FIG. 34A is obtainable by translating the base movement of FIG. 34 by a half-row;

FIG. 35 schematically illustrates a base movement of the jacquard bars according to a possible embodiment of the process of the present invention, able to perform a particular knitting function; in particular the four shog movements of the four jacquard bars are shown, with respect to the two needle beds, and the displacements determined by the activation of the thread guides of two jacquard bars are highlighted;

FIG. 36 schematically illustrates the shog movements of a jacquard bar, arranged at a first bed (by way of example bar 1F), according to a plurality of knitting stitches according to the present invention; each stitch is obtained by adding, to the base shog movement (shown in the first diagram on the left) one or more jacquard displacements of a thread guide of the jacquard bar;

FIG. 37 schematically illustrates the shog movement of a jacquard bar, arranged at a second bed (by way of example bar 4B), according to a plurality of a knitting stitches by way of example according to the present invention; each stitch is obtained by adding to the base movement (shown in the first diagram to the left) one or more jacquard displacements of a thread guide of the jacquard bar;

FIG. 38 schematically illustrates a base movement of the jacquard bars according to a further embodiment of the process of the present invention; in particular a further possible embodiment of the four shog movements of the four jacquard bars is shown, with respect to the two needle beds, the shog movements realising a plurality of open knitting stitches;

FIG. 38A schematically illustrates a base movement of the jacquard bars according to a further embodiment of the process of the present invention; in particular a further embodiment of the four shog movements of the four jacquard bars is shown, with respect to the two needle beds, the shog movements realising a plurality of open knitting stitches; in substance, the base movement of FIG. 38A is the same as in FIG. 38, but translated by a half-row of knitting with respect thereto;

FIG. 39 schematically illustrates the knitting stitches realised by four corresponding thread guides, one for each jacquard bar, by means of the base movement of FIG. 34 (and without any jacquard selection); the knitting stitches are shown for four knitting rows;

FIG. 40 is alike FIG. 39, but schematically illustrates the knitting stitches realised by a plurality of adjacent thread guides of the four jacquard bars, by means of the base movement of FIG. 34 (and with no jacquard selection), on a group of adjacent needles of the first and second bed; the knitting stitches are shown, in repetition, for four rows of knitting.

With reference to the figures, reference number 1 denotes in its entirety a linear knitting machine for realizing a process according to the present invention. In general, the same reference number is used for identical or like elements, possibly in the variant embodiments thereof.

Figure 1:
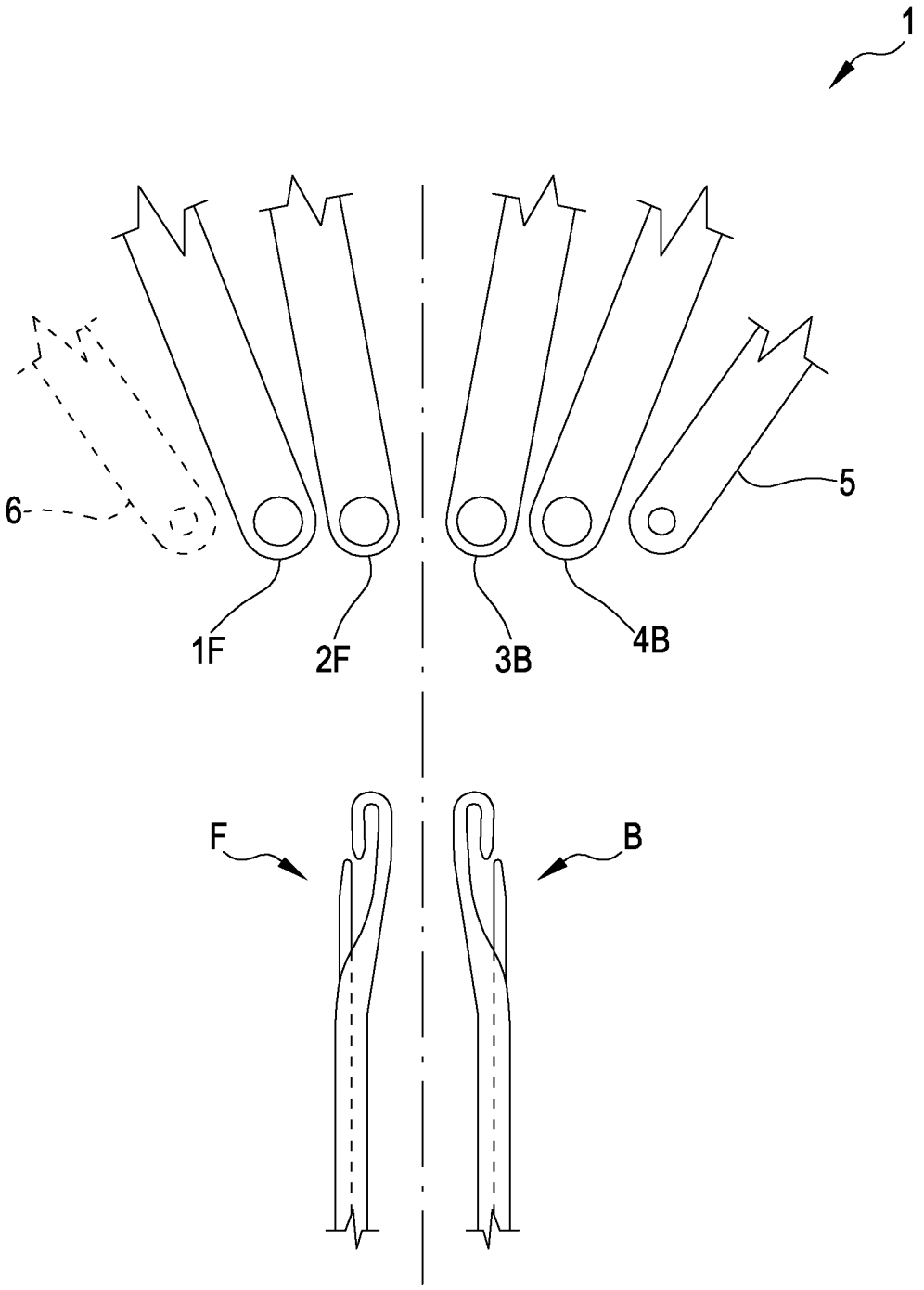

FIG. 1 schematically shows a portion of a linear knitting machine for warp knitting, and in particular schematically illustrates the needle beds and the thread guide bars.

Some parts of the machine, such as the frame, control unit, activation devices of the bars, etc. are not shown in detail in the figures, as they are in themselves known and of conventional type: the schematic representation of the machine is focused on the parts serving for the comprehension of the knitting process of the present invention, and in particular the context in which knitting diagrams of the following figures should be interpreted (FIGS. 2-26; 34-40).

From the point of view of knitting technology, the functioning of the whole linear knitting machine (for example the function of the thread guide bars, the jacquard selection of the thread guides, the cooperation between needles and threads, etc.) is not described in detail, as it is known in the technical sector of the present invention.

The process for the production of knitted articles of the present invention first comprises predisposing a linear knitting machine 1 for warp knitting, of a double-bed raschel type, comprising at least a bearing structure and knitting organs mounted on the bearing structure and comprising a first needle bed F, comprising a plurality of even and odd needles aligned and alternated to one another, and a second needle bed B, comprising a respective plurality of equal and odd needles aligned to one another. The first and the second needle beds are typically termed "front" and "back" in the sector.

The needles of the first and the second beds can be of a piston type or a latch type, according to knitting requirements and the type of knitted article that is to be produced. FIG. 1 shows, by way of example, piston needles for both beds; this type of needle is required for realizing particular knitting effects, for example a sponge effect (described in the following).

As shown by way of example in FIG. 1, the knitting machine 1 comprises at least:

- a first jacquard bar 1F arranged at the first bed F and provided with an odd-number plurality of thread guides of a jacquard type configured such as to selectively supply thread to the needles of the beds F and B;

a second jacquard bar 2F arranged at the first bed F and provided with an even-number plurality of jacquard-type thread guides, configured such as to selectively supply thread to the needles of the beds F and B;

a third jacquard bar 3B arranged at the second bed B and provided with an odd-number plurality of jacquard-type thread guides configured such as to selectively supply thread to the needles of the beds F and B;

a fourth jacquard bar 4B arranged at the second bed B and provided with an even-number plurality of jacquard-type thread guides configured such as to selectively supply thread to the needles of the beds F and B.

The figure further illustrate two bottom bars 5 and 6. The bottom bars are optional and will be described in the following.

Each of the odd and even jacquard-type thread guides (regardless of the jacquard bar to which it belongs) is further singly and selectively mobile by means of a corresponding jacquard-activation element between a base position (OFF) and an activation position (ON), displaced by a needle space with respect to the base position. The movement of a thread guide is schematically shown by way of example in FIG. 5 (a frontal view of a jacquard bar, relating to a single thread guide): the base position is represented on the right and the activation position is represented on the left. However the ON and OFF positions can be inverted, according to the type of machine. What is important is the distance of a needle space between the two positions, and the fact that they can be selectively attained thanks to the jacquard device. Two endruns are schematically represented in the figure, which define the two positions, OFF and ON of the thread guides, halting the movement of the thread guide by means of the jacquard device.

Each of the jacquard bars (1F, 2F, 3B, 4B) is configured such as to carry out:

a respective linear shog movement, frontally and posteriorly to the tip of the needles in the beds; and a respective oscillating swing movement, substantially perpendicular and substantially alternated with the respective shog movement and carried out by a side of the needles of the beds so as to bring the threads alternatively in front of and behind the needle tips.

The shog movement and the swing movement enable production of at least a knitted article on the needle beds F and B.

The knitting machine 1 implementing the process of the present invention includes the jacquard bars being activated, using appropriate activation means (motors, linear motors, cams, gears etc.) preferably each independently in relation to the axial linear displacements (shog movements etc.). Further, the knitting machine 1 preferably includes the jacquard bars being activated, using appropriate activating means, all together (i.e. in unison) as regards the oscillating movements (swing movements).

The independent activation of the shog movement of the four bars enables moving the bars together or in a "mixed" way, i.e. the jacquard bars can work in phase or in phase opposition; they are in substance completely unconstrained (in terms of possible selectable movements therefor) from one another.

The process of the present invention comprises a step of producing at least a portion of a knitted article by means of a base movement of the jacquard bars. In this step of producing at least a portion of a knitted article by means of a base movement of the jacquard bars, the first jacquard bar, the second jacquard bar, the third jacquard bar and the fourth jacquard bar are moved, in each row of knitting, so as to operate alternatively at the first and the second needle bed.

Further, in general the step of producing at least a portion of a knitted article includes at least the first jacquard bar 1F and the third jacquard bar 3B being moved identically to one another, performing a same shog movement, and a same swing movement; further, the step of producing at least a portion of a knitted article includes at least the second jacquard bar 2F and the fourth jacquard bar 4B being moved identically to one another, performing a same linear movement and a same swing movement.

In substance, the base movement of the present invention includes at least the bars moving, in pairs, identically to one another, where each pair comprises a bar (even or odd) located at the front bed and the corresponding bar (even or odd) positioned at the back bed. The example shown in FIG. 1 includes an alternation of jacquard bars (following the order 1F, 2F, 3B, 4B) odd for the front bed (1F), odd for the front bed (2F), odd for the back bed (3B), even for the back bed (4B). Therefore, in this configuration, the pairs performing a same movement are the jacquard bars 1F and 3B and the jacquard bars 2F and 4B.

This can be seen in FIGS. 2 and 2A, which show the base movements of the jacquard bars according to an embodiment, and can also be observed in FIGS. 34 and 34A, which show the base movements of the jacquard bars according to a further embodiment (described in the following).

Note how the base movement underpinning the process of the present invention is identically applicable also to machines which include a different arrangement of the four jacquard bars: for example (using the numbering reported in FIG. 1), the jacquard bars can be arranged (from left towards right) in a sequence 1F-2F-3B-4B (odd-even-odd-even, as in FIG. 1) or 2F-1F-4B-3B (even-odd-even-odd) or 1F-2F-4B-3B (odd-even-even-odd) or 2F-1F-3B-4B (even-odd-odd-even). According to the arrangement, the knitting pattern of FIG. 2 or 2A can be adapted, attributing each of the four base movements to the respective jacquard bar, respecting the above-mentioned equality of the base movement of the corresponding bars on the two fronts.

In an embodiment, in the base movement of the jacquard bars, the shog movement of the first jacquard bar 1F and the third jacquard bar 3B is carried out in phase opposition, i.e. in a same and contrary way, or in a symmetrical way, with respect to the shog movement of the second jacquard bar 2F and of the fourth jacquard bar 4B. This condition can be added to the preceding condition, leading to a situation in which the bars move equally in like couples i.e. identically for bars (even or odd) located at the two beds) and further symmetrically, or in "phase opposition" between bars located in the same bed (i.e. with reference to FIG. 1, the bars 1F and 2F move in phase opposition to one another, as do the bars 3B and 4B). The base movement shown by way of example in FIGS. 2 and 2A is characterized by the phase opposition between bars placed on the same bed.

The first and the second bar can be identical and half-gauge (with respect to the gauge of the needle beds, or gauge of the knitting machine) and be in the default position, one with respect to another, offset by one needle space. In other words, the first jacquard bar is in default position associated to conventionally "odd" needles and the second jacquard bar is in default position associated to conventionally "even" needles (or vice versa). Likewise, the third and fourth bar can be identical and half-gauge (with respect to the needle bed gauge or knitting machine gauge) and be in default position, one with respect to the other, offset by a needle space. By "half gauge" is meant that the number of thread guides of each jacquard bar is equal to half the number of needles of a single needle bed (for example, if the number of needles of a bed is X, the number of thread guides of each jacquard bar is X/2).

Note that, with reference to the position of the single thread guides, that a jacquard thread guide is considered "passive" (or static) when it is not individually moved between the respective base position and the respective activation position at the shog movements of the jacquard bar, and is considered "active" when it is individually moved between the respective base position and the respective activation position at the shog movements of the jacquard bar thereof.

Note that, in all the figures illustrating knitting patterns (in particular base movements or knitting stitches), above the pattern an "absolute" numbering of the needles is included, i.e. a numbering of the needles of the two beds (1, 2, 3, 4 etc.), regardless of the position of the thread guides. The number "1" denotes a first needle of the first bed and a corresponding first needle of the second bed, while number "2" denotes the second needles and so on.

Further, below the knitting pattern a numbering is included that is "relative" to zero (or the default position) of the jacquard bars with the thread guides in the OFF position, i.e. a numbering which identifies the work position when crossing the thread guides with respect to the needles. In essence, these numbers (−1, 0, 1, 2, etc.) identify the position between the needles reachable by the thread guides on the basis of the combination of the base movement of the bar thereof and the jacquard movement of the thread guide.

Note that, in each knitting pattern showing the thread carried by a thread guide and the movements thereof, the number "0" below the pattern is relative to the thread guide considered (and can therefore be varied), while the upper numbering, relative to the needles, remains unvaried. This said, the notation adopted in the "relative" number of the thread guides follows the rules below:

- reference "0" of the thread guide is on the right of needle number 1 (or in general an odd-numbered needle) for the thread guides belonging to a jacquard bar of the "odd" type (first jacquard bar 1F or third jacquard bar 3B);
- reference "0" of the thread guide is on the right of needle number 2 (or in general an even-numbered needle) for the thread guides belonging to an "even" type jacquard bar (second jacquard bar 2F or fourth jacquard bar 4B).

Observe for example the patterns of FIGS. 7 and 8:

- FIG. 7 relates by way of example to the first bar 1F (odd), and in fact the "0" of the thread guides is always just to the right of needle number 1 (odd);
- FIG. 8 relates by way of example to the fourth bar 4B (even), and in fact the "0" of the thread guides is always just to the right of needle number 2 (even).

This notation used in the figures serves to understand how the different jacquard bars simultaneously provide thread to the various needles of the two needle beds, and how from the shog movement of the single bars (for example as in FIG. 2) a specific knitting structure is realized (for example as in FIG. 25).

There now follows a description in greater detail of the knitting pattern forming the basis of the process of the present invention, with particular reference to FIGS. 2, 2A and 9.

In the base movement, the jacquard bars are preferably moved in such a way that the passive (or static) thread guides of each bar always form stitches at each half-row of knitting produced, alternatively on the needles of the first bed F and on the needles of the second bed B. This is clearly visible in FIG. 2: the thread guides of all four jacquard bars 1F, 2F, 3B and 4B realize for each half-row (with no interruptions) knitting stitches, alternatedly on the two needle beds.

In other words, the base movement realises, for each row of knitting, a plurality of stitches on needles of the first bed and a plurality of stitches on needles of the second bed. By modifying the position of one or more thread guides of one or more jacquard bars (for example by performing a jacquard selection), in addition to the base movement, the process of the present invention can realize a double-cloth or linked fabric (and not two distinct lengths of fabric), i.e. it can realize a fabric in which the two layers (produced on the beds F and B) are linked and combined to one another.

The base movement preferably determines, for all the passive jacquard thread guides of each jacquard bar, the realising of a stitch on both beds, for each row of knitting. This is clear from the figures, in which it can be observed that for each row of knitting (i.e. for a sequence of two consecutive half-rows of knitting, of which one of the bed F and one on the bed B), each jacquard bar realizes stitches on both the beds (without "leaving out" one or the other bed).

The base movement preferably defines a productive sequence of stitches carried out alternatively on the first bed F and on the second bed B, the productive sequence being cyclically repeated every two rows of knitting.

In other words, the base unit of the base movement of the process of the present invention is constituted by a "productive sequence", i.e. by a succession of knitted stitches having a "textile length" of two rows of knitting and being cyclically repeated (see in particular FIGS. 2, 2A, 9, 22, 22A).

In greater detail, in the base movement, the jacquard bars 1F, 2F, 3B and 4B are moved such that each passive thread guide of each jacquard bar produces, in a predetermined sequence:

- in a first half-row of knitting (F1), a first stitch at a respective first needle (N1F) of the first bed (F),
- in a second half-row of knitting (B1), a second stitch at a respective first needle (N1B) of the second bed (B), corresponding in position to the first needle (N1F) of the first bed,
- in a third half-row of knitting (F2) a third stitch at a respective second needle (N2F) of the first bed (F), adjacent to the first needle (N1F) of the first bed,
- in a fourth half-row of knitting (B2), a fourth stitch at a respective second needle (N2B) of the second bed B, adjacent to the first needle of the second bed.

This predetermined sequence is schematically illustrated in FIG. 2 and in FIGS. 25 and 26. In FIGS. 25 and 26 the threads are indicated by references (1F, 2F, 3B, 4B) of the respective jacquard bar (to which the thread guide bearing the thread belongs).

As illustrated in FIG. 9, the base movement is preferably determined by a plurality of iterative repetitions of the predetermined sequence, each repetition—for each passive thread guide—starting from the same respective first needle of the first bed.

Preferably, in the base movement:

- the first jacquard bar 1F and the third jacquard bar 3B are moved in such a way that each odd passive thread guide of the jacquard bars actuates the predetermined sequence at the respective:

first needle (N1F) of the first bed F, first needle (N1B) of the second bed B, second needle (N2F) of the first bed F, adjacent and displaced in a first direction (for example to the left in FIG. 2) with respect to the first needle (N1F) of the first bed F, second needle (N2B) of the second bed B, adjacent and displaced in the first direction with respect to the first needle of the second bed, the second 2F and the fourth jacquard bar 4B are moved so that each even passive thread guide of the jacquard bars actuates the predetermined sequence at the respective:

first needle (N1F) of the first bed F, first needle (N1B) of the second bed B, further second needle (N2F) of the first bed F, adjacent and displaced in a second direction (for example to the right in FIG. 2), with respect to the first needle of the first bed, further second needle (N2B) of the second bed B, adjacent and displaced in the second direction with respect to the first needle (N1B) of the second bed B.

In the base movement, the jacquard bars are preferably moved such that that the passive thread guides of each bar always form close stitches on the first and second needle bed at each half-row or row of knitting produced. This condition is shown in FIGS. 2, 2A and 9, in which it can be observed that each stitch is of the closed type ("close loop").

Alternatively, in the base movement, the jacquard bars are moved in such a way that the passive thread guides of each bar always form open stitches on the first needle bed and on the second needle bed at each half-row or row of knitting produced. This condition is shown in FIGS. 22 and 22A, in which it can be observed that each stitch is an open stitch ("open loop"). This embodiment is entirely equivalent, at the level of the base movement, to the preceding: the base movements of the pairs 1F-3B and 2F-4B of jacquard bars are identical, as is the symmetry of the base movements of the pairs 1F-2F and 3B-4B of jacquard bars, and further the needles involved in the knitted stitches are the same as illustrated above. The difference is in the production of open-loop stitches.

The base movement preferably comprises a base semi-movement in which each of the jacquard bars produces, by means of the respective passive thread guides, at least at a first half-row of kitting (F1) and the first needle bed F, a respective stitch on respective equal or odd needles, alternated with needles, odd or even, on which stitches are not formed. This can be seen schematically in FIGS. 25 and 26 (knitting pattern with close loop stitches): these figures show the stitches realized by the jacquard bars at some needles of the beds and for some subsequent rows of knitting. For each half-row of knitting (i.e. a knitting step on the first bed or the second bed) there is an alternating of needles with realize stitches alternated with needles which do not create knitting stitches.

The respective alternated needles, even or odd, on which the stitches of the first half-row of knitting are formed are the same alternated needles, even or odd, at least for corresponding passive thread guides in the first F1 and the third jacquard bar 3B and/or for corresponding passive thread guides in the second 2F and fourth jacquard bar 4B.

The process preferably includes repeating the "base semi-movement" at least at two directly successive half-rows on the first (F) and on the second needle bed (B). FIGS. 25 and 26 show, in this regard, a sequence of four rows of knitting, where the base half-movement is repeated on the needles for two half-rows of knitting (on the two beds), i.e. for a row of knitting, and successively is identically repeated, in the successive row, displaced by a needle. This means that in a row the even needles form knitting and the odd needles do not form knitting, while, vice versa, in the following row the odd needles form knitting and the even needles do not form knitting; this pattern is cyclically repeated.

Considering a plurality of adjacent thread guides (and corresponding on all four bars) the result is that the needles forming knitting are supplied by corresponding thread guides of the first, second, third and fourth jacquard bar, while the alternated needles are not supplied by any thread guides.

In the following the base movement will be described in different terms. In a possible embodiment of the present invention, the base movement of the jacquard bars is carried out in such a way that for the passive thread guides in the same position of each jacquard bar, at the formation of at least a stitch or at least a half-row of knitting, or at a plurality of consecutive stitches or a plurality of consecutive half-rows of knitting:

the first 1F and the third jacquard bar 3B supply thread and produce, by means of respective odd passive thread guides and reciprocally corresponding to one another in the first and third jacquard bar, stitches realized at the same identical needles of one of the needle beds or at the same identical needles on both the needle beds; and the second 2F and the fourth jacquard bar 4B supply thread and produce, by means of respective even passive thread guides reciprocally corresponding in position in the second and the fourth jacquard bar, stitches realized at the same identical needles of one of the needle beds or sequentially at the same identical needles on both the needle beds.

By way of example reference is made to FIGS. 25 and 26 and FIG. 2. The base movement comprises following operating steps:

simultaneously producing, by means of first odd passive thread guides in the same position and reciprocally corresponding in the first 1F and third jacquard bar 3B and by means of first even passive thread guides in the same position and reciprocally corresponding in the second 2F and in the fourth jacquard bar 4B, a first stitch with four threads at a first needle of the first needle bed F;

thereafter simultaneously producing, by means of the first odd passive thread guides in the same position and reciprocally corresponding in the first and the third jacquard bar and by means of the even passive thread guides in the same position and reciprocally corresponding in the second and the fourth jacquard bar, a second stitch with four threads at a same first needle N1B of the second needle bed B, corresponding to the first needle N1F of the first bed;

thereafter simultaneously producing, by means of the first odd passive thread guides in the same position and reciprocally corresponding in the first and the third jacquard bar, and by means of second even passive thread guides in the same position and reciprocally corresponding in the second and fourth jacquard bar and adjacent and displaced in a first direction with respect to the first even passive thread guides, a third stitch with four threads at a same second needle N2F of the first needle bed F adjacent and displaced in the first direction with respect to the first needle N1F of the first needle bed F; and thereafter, simultaneously producing, by means of the first odd passive thread guides in the same position and reciprocally corresponding in the first and the third jacquard bar, and by means of the second even passive thread guides in the same position and reciprocally corresponding in the second and the fourth jacquard bar and adjacent and displaced in a first direction with respect to the first even passive thread guides, a fourth stitch with four threads at a same second needle N2B of the second needle bed B adjacent and displaced in the first direction with respect to the first needle N1B of the second needle bed and corresponding to the second needle N2F of the first needle bed F.

In a preferred embodiment the base movement preferably comprises an iterative repetition of the operating steps. The operating steps are preferably carried out for all the passive jacquard thread guides of the jacquard bars.

In a preferred embodiment, which fully exploits the knitting potential of the process of the present invention, the process comprises a step of activating, during the base movement of the jacquard bars, a plurality of jacquard thread guides, by carrying out corresponding individual displacements by one needle space of the plurality of jacquard thread guides, so as to selectively modify a base structure of the portion of the knitted article by means of realizing differentiated knitting stitches and structures, deriving from a combination of the base movement of the jacquard bars and the individual movements of the single active jacquard thread guides, in addition to or in subtraction from the shog movements of the jacquard bars.

In substance, the process includes selecting, according to knitting needs and the characteristics to be obtained for the fabric to be manufactured, a plurality of single jacquard movements of a plurality of thread guides: this jacquard selection of single thread guides is "added" onto the base movements described above, with modifications thereto so as to obtain a plurality of different knitting stitches and therefore a plurality of knitting effects on the article produced. The particular base movement described up to the present point enables, by means of a jacquard selection of the thread guides associated thereto, obtaining a plurality of different stitches for each needle of the needle beds and for each row of knitting.

The step of jacquard selection of the process of the present invention is schematically illustrated in figures from 10 to 17.

FIGS. 10-13 illustrate an array assembly of 29 different knitting stitches that can be realized on the four jacquard bars starting from the base movement of FIG. 2 (close knitting stitches). In detail, FIGS. 10-13 are combined, in sequence, with the first jacquard bar 1F (odd thread guides, first bed F) with the third jacquard bar 2B (odd thread guides, second bed B), with the second jacquard bar 2F (even thread guides, first bed F) and with the fourth jacquard bar 4B (even thread guides, second bed B). In substance, the Applicant has developed, starting from the base movement described above, an extended set of knitting stitches realizable as desired on a same row of knitting, without ever modifying the base movement. On the basis of the characteristics which are to be obtained on the fabric, it is possible to select a plurality of knitting stitches, from among those shown, to be realized in a same row of knitting, and change them as desired in the following row.

FIGS. 14-17 are alike to FIGS. 10-13, but describe the knitting stitches realisable by the four bars (29 stitches for each bar) starting from the base movement of FIG. 2A (open stitches). In this case too the FIGS. 14-17 are combined, in sequence, with the first jacquard bar 1F (odd thread guides, first bed F), with the third jacquard bar 3B (odd thread guides, second bed B), with the second jacquard bar 2F (even thread guides, first bed F) and with the fourth jacquard bar 4B (even thread guides, second bed B).

An example of how the stitches are obtained starting from the base movement and "summing" the jacquard selection is shown in FIGS. 7 and 8.

FIG. 7 illustrates, on the left, the base movement of the first jacquard bar 1F as in FIG. 2 (close stitches), for a thread guide. To the right can be observed four knitting stitches by way of example selected from among the 29 stitches of FIG. 10. Below each of the four stitches are illustrated the changes in state of the jacquard thread guide (from OFF to ON by ticking "v") for each half-row of knitting, which cause the base movement to modify, obtaining the respective represented knitting stitch. In the four figures to the right of the base movement it is possible to observe, in a continuous line, the specific knitting stitch, and in the broken line, the original base movement.

On the left in FIG. 8, the base movement of the fourth jacquard bar 4B can be observed as in FIG. 2 (close stitches) for a thread guide. On the right can be seen four knitting stitches by way of example selected from among the 29 stitches of FIG. 13. In this case too, below each of the four stitches the changes in state of the jacquard thread guide (from OFF to ON by ticking "v") can be seen for each half-row of knitting, which cause the base movement to modify, obtaining the respective represented knitting stitch.

The process preferably comprises the step of supplying the first jacquard bar 1F and the second jacquard bar 2F with first threads of a first colour and/or a first type and supply the third jacquard bar 3B and the fourth jacquard bar 4B with second threads of a second colour and/or a second type. For example, the first threads can be white and the second threads black.

In a possible embodiment, the process includes selectively activating the jacquard thread guides of the jacquard bars so as to realize at least a portion of the knitted article having on both sides of the fabric stitches realized with the first and with the second threads or with all the first and the second threads. In a further embodiment, the jacquard thread guides are activated so as to realize at least a portion of the knitted article having at least a side constituted only by knitting stitches realized only with the first threads or with the second threads (for example the portion comprises, on a side of the knitted article, only white threads or only black threads).

In a further embodiment, the jacquard thread guides are activated in such a way as to realise at least a portion of the knitted article having both sides only constituted by knitting stitches realised respectively only with the first threads or with the second threads (for example, a portion having a black side and a white side, or both sides in a single colour).

In a further embodiment, the jacquard thread guides are activated such as to realize a portion of fabric comprising two cloths that are distinct and parallel and realized respectively on the first bed and on the second bed. In this case the first and the second jacquard bars realize the cloth on the first bed and the third and fourth jacquard bars realize the cloth on the second bed.

In a further embodiment, in which the process of the present invention clearly shows its knitting potentials, the process comprises the step of alternating, on one side of the fabric of the textile product, at least a first portion made solely by knitting stitches made only with the first threads and at least a second portion realised only with stitches made only with the second threads or with the first and the second threads, so as to define on that side of the fabric of the knitted article graphics, drawings or writing that are sharp and/or have substantially sharp edges. In this case, in essence, one side of the fabric comprises alternated portions each of which shows only the first thread or only the second threads, with a crisp and sharp passage between a portion and a next portion (or adjacent portions). This sharp alternation between portions of different colours having desired shapes enables realizing graphic elements on a side of the fabric (for example drawings, logos, etc.) and/or clear and sharp writing in comparison to the " background" of the fabric and to the surrounding portions. An example of this embodiment is illustrated in FIGS. 18-21 and will be analyzed in the following.

Preferably the step of providing a linear textile machine for warp knitting comprises a step of providing at least a first bottom bar 5, preferably arranged at the second needle bed (as shown by way of example in FIG. 1) and in which the process comprises the step of realizing, by means of the bottom bar, stitches, chains or textures in cooperation with the four jacquard bars so as to form at least a portion of the textile and to reinforce the structure of the fabric.

In a possible embodiment, the process comprises a step of forming knitting stitches or a chain (or chains) in cooperation with the four jacquard bars. In which at least the first 1F and the second jacquard bar 2F or at least the third and 3B fourth jacquard bar 4B operate with at least a group of passive jacquard thread guides in order to realise at least a portion of a textile article with sponge effect on the needle bed opposite the bottom bar.

In a further possible embodiment, at least one group of adjacent jacquard thread guides of the first bar and at least one group of corresponding adjacent jacquard thread guides of the second bar are in the base position and at least one group of corresponding adjacent thread guides of the third jacquard bar and at least one group of corresponding adjacent jacquard thread guide bars of the fourth bar are in the activation position, so as to achieve, at the portion of fabric realised with the threads carried by these groups of adjacent thread guides on the jacquard bars, a portion of "checked" fabric characterized, at least on one side of the fabric, by an alternation of individual stitches made only with the first thread and individual stitches made only with the second threads. The same checked effect can be obtained, vice versa, even when at least one group of adjacent jacquard thread guides of the first bar and at least one group of corresponding adjacent jacquard thread guides of the second bar are in the activation position and at least one group of corresponding adjacent thread guides of the third jacquard bar and at least one group of corresponding adjacent jacquard thread guides of the fourth bar are in the base position. In essence. The "checked" effect is obtainable, for a portion of fabric, while maintaining a group of thread guides of the pair of jacquard bars of the first needle bed (first and second bar) in the base position (or respectively in the activation position) and on the contrary, maintaining a corresponding group of thread guides of the pair of jacquard bars of the second needle bed (third and fourth bar) in the activation position (or respectively in the base position).

This embodiment of the present process is illustrated by way of example in FIG. 6: it can be observed that the thread guides of the third and fourth bar jacquard are in activation position for the entire base movement (two rows of knitting). The result is a translation (to the left in the figure) of the base movement for both bars. The base movement of FIG. 6 realizes a checked fabric (e.g. white and black checks) repeated with an width of a knitting stitch.

In a possible embodiment, the process comprises a step of providing also a second bottom bar 6, arranged at the needle bed opposite the needle bed at which the bottom bar is present. In this case the process comprises the step of forming stitches, chains or weaves, by means of the second bottom bar, in cooperation with the four jacquard bars for forming at least a portion of the knitted article.

The process of the present invention preferably comprises a step of supplying each jacquard thread guide of the jacquard bars with a respective thread, independently with respect to the other jacquard thread guides of the knitting machine.

The process preferably comprises a step of preparing thread feeding devices configured such as to provide a plurality of threads to the jacquard bars, in which these thread feeding devices comprise at least a thread creel provided with a plurality of thread-carrying bobbins each singly coupled individually with a respective jacquard thread guide, so that each thread guide supplies, independently of the other reels, a respective amount of thread to a respective thread guide on the basis of the take-up of thread thereof. The creel is configured such as to compensate for the difference in take-up of the various threads in relation to the number of knitting stitches made by the different thread guides of the jacquard bars.

The thread supply devices preferably comprise a plurality of thread tensioning elements such as a plurality of stretchers. Each tensioning element is singly dedicated to a respective thread sourcing from one of the reels and is interposed between the coil supplying the respective thread and a respective threading thread guide. Each of the tensioning elements is configured so as to slidingly receive the respective thread and to deform elastically and proportionally according to the tension of the respective thread guide is received, in order to provide the respective thread guide thread having a certain and substantially constant tension value.

In practice, the stretchers serve as the means for stabilising the working tension of the individual threads, compensating for the marked difference in absorption thereof in the different knitting stitches.

The supply devices can include a warp beam bearing the threads in supply to the first bottom bar (if present, as it is optional). In fact, the beam is configured to bear a plurality of supply threads and to supply them all with a same amount of thread supplied to the stitches formed. Therefore, since the threads supplying the bottom bar do not have different consumptions, a warp beam can be used for them. Likewise, the thread supply devices can include a further warp beam carrying supply threads intended for the second bottom bar (if present, as it is optional).

In general, the process of the present invention necessarily includes, for the feeding of the four jacquard bars, the use of creels if the threads destined for the jacquard bars are stiff threads, while warp beams can be used if the threads destined for the jacquard bars are elastic (which due to the elasticity thereof make up for the difference in consumption).

FIGS. 18, 19, 20 and 21 illustrate an embodiment of a technical fabric in double layer, bearing writing and crisp colours at least on one side thereof, according to a preferred embodiment of the present invention.

This embodiment firstly includes selecting, for the four jacquard bars, the base movement of FIG. 2 according to the present invention, i.e. a base movement having at least the following characteristics:

the first jacquard bar and the third jacquard bar are moved with a shog movement identical to one another and simultaneously on a same bed of the needle beds;

the second jacquard bar and the fourth jacquard bar are moved with a respective shog movement identical to one another and simultaneously on the same bed of the needle beds;

the swing movement is the same for all four jacquard bars;

the shog movement of the first jacquard bar and the third jacquard bar is carried out in phase opposition, i.e. in a same and contrary way, or in a symmetrical way, with respect to the shog movement of the second jacquard bar and of the fourth jacquard bar;

the jacquard bars are moved such that the passive thread guides of each bar always form knitted stitches at each half-row of knitting produced, alternatively on the needles of the first bed and the needles of the second bed.

With the base movement established, the first and the second bar are supplied with first threads (for example white) and the third and the fourth bar are supplied with second threads (for example black).

Then, for each thread guide supplied, a respective knitting stitch is selected to carry out each half-row of knitting: in the present example (see FIGS. 18-21), thirty adjacent needles are illustrated for each needle bed, and the knitting process carried out has a length of 54 rows of knitting. In practice, the portion of the knitted article produced in the following example has an area of 30 to 54 rows of knitting.

The knitting stitches selected for each thread guide, and for each half-row of knitting, are selected—for each jacquard bar—between the possible knitting stitches shown in FIGS. 10-13; in practice, for each thread guide of the first bar one (for each row of knitting) of the 29 stitches of FIG. 10 can be attributed, at each thread guide of the second bar one(for each row of knitting) of the 29 stitches of FIG. 11 can be attributed, at each thread guide of the third bar one (for each row of knitting) of the 29 stitches of FIG. 12 can be attributed, at each thread guide of the fourth bar one (for each row of knitting) of the 29 stitches of FIG. 13 can be attributed.

All of the above is done without changing the base movement (in the present example the base movement of FIG. 2, with close stitches).

Obviously, the stitches of each thread guide can be repeated for a plurality of half-rows, depending on the result to be obtained.

The programming pattern of FIG. 18 (in which the numbers represent the stitches carried out by each thread guide according to the pattern and the numbering of FIGS. 10-13), is translated into a specific weave of stitches, shown in detail in FIG. 19. In this figure all threads can be observed, carried by the 60 of thread guides of the four bars, which supply a series of needles on the two beds; the colour grey is used to highlight the first threads, while the second threads are represented in black. FIG. 19A shows the knitting stitches used in the pattern of FIG. 19 (with a respective identifying number) taken from FIGS. 10-13 and corresponding to the programming pattern of FIG. 18.

Further, and again with reference to FIG. 19A, an enlarged illustration is shown of a portion of the stitching, so as to evidence in detail the path of the threads which cooperate with the needles for the formation of the fabric.

FIG. 20 is similar to FIG. 19, but showing only the knitting stitches formed on the needles of the first needle bed (front), with the aim of showing the result on the front side of the fabric (where a particular graphic element is shown). The needles of the second needle bed (back) are shown as not supplied.

FIG. 20A shows a larger-scale view of a portion of FIG. 20, which illustrates some knitting stitches formed on the needles of the first needle bed.

FIG. 21 is equivalent to FIG. 20, with the difference that it shows only the first needle bed, for all the 54 half-rows of knitting of the present embodiment (note, by the side, the sequence of letters F, which identify the first needle bed). This figure shows the knitting result on the side of the fabric realised on the first needle bed. On the basis of the programming pattern of FIG. 18, the process of the present invention has therefore produced a portion of textile article showing, clearly and sharply, a letter "N" in the colour black on a white background. In practice two pieces of textile article have been produced, one black (with an "N" shape by way of example) and one white (i.e. the rectangular background on which the letter "N" is set). The black portion is produced with stitches realised only with second threads (black) and the white portion is produced with stitches realised only with first threads (white).

Note that in the lower part of the diagrams of FIGS. 19, 20 and 21, the default positions of the thread guides are numbered from right to left; in the upper part of the pattern, 30 needles in active processing mode are highlighted, numbered from 20 to 49 from right to left.

FIG. 21A is a photograph of a portion of a knitted article (front side) produced using the process of the present invention: in particular, the knitted article has been obtained by programming the knitting machine exactly with the knitting pattern illustrated in FIGS. 18, 19, 20 and 21. As can be observed, the result is exactly a portion of a knitted article comprising, on the front side, a letter "N" in black on a white background. Observe the colour sharpness—on the front side of the fabric—forming the letter and background, and the definition of the borders.

In the following an embodiment is illustrated of a process according to the present invention, for manufacturing a knitted article having at least a portion exhibiting a sponge effect. This embodiment firstly includes selection, for the four jacquard bars, of a base movement according to the present invention, for example one of the base movements shown in FIGS. 2, 2A, 22 or 22A.

The embodiment includes moving the jacquard bars such as to realise, in cooperation with suitable jacquard movements of the single thread guides, in a predetermined sequence of two successive rows of knitting:

in a first half-row of knitting, a first stitch at a respective first needle of the first bed, in a second half-row of knitting, a further stitch at a respective first needle of the second bed, corresponding in position to the first needle of the first bed, in a third half-row of knitting, a no stitch at the first needle of the first bed, in a fourth half-row of knitting, a further stitch at the first needle of the second bed, corresponding in position to the first needle of the first bed;

so as to realise a portion of knitted article having a sponge effect on the first needle bed.

Alternatively, and entirely equivalently, the jacquard bars can be moved in such a way as to realise, in cooperation with suitable jacquard movements of the single thread guides, in a predetermined sequence of two successive rows of knitting:

in a first half-row of knitting, a first stitch at a respective first needle of the first bed, in a second half-row of knitting, a further stitch at a respective first needle of the second bed, corresponding in position to the first needle of the first bed, in a third half-row of knitting, a further stitch at a respective second needle of the first bed, adjacent to the first needle of the first bed, in a fourth half-row of knitting, no stitch at the first needle of the second bed, corresponding in position to the first needle of the first bed, in this case realising a portion of the knitted article with a sponge effect on the second needle bed.

Preferably a plurality of iterative repetitions of the above predetermined sequence of two successive rows of knitting is carried out cyclically, and each repetition begins from the first needle of the first needle bed and has a length of two rows of knitting.

In essence, the embodiment of the present procedure aimed at creating the "sponge" effects on one side of the fabric includes realising cycles of two rows of knitting, in which a stitch in knitted for each row on a needle bed (first or second), while on the other needle bed (second or first respectively) a stitch is knitted in a row and no stitch is knitted on the other row; the realising of this cycle involves corresponding needles of the two beds.

In practice, this embodiment realises, for the corresponding needles on the two needle beds and every four half-rows of knitting (i.e. for a sequence of stitches on the needle beds of F-B-F-B), three consecutive stitches alternating with a missing stitch. For example, the following is carried out:

two consecutive stitches on the first needle bed;

a knitted stitch followed by no stitch on the second needle bed.

Or, the following is carried out:

two consecutive stitches on the second needle bed;

a knitted stitch followed by no stitch on the first needle bed.

It is clear that, regardless of which needle bed stitches are always knitted and which there is an alternation of stitch-no stitch, by carrying out a cyclic series of movement as described above, sequences of three stitches (on the beds F-B-F or B-F-B) are obtained, alternated and missing one stitch (respectively on the B or F bed).

This embodiment of the method of the present invention realises a continuous structure on the needle bed on which stitches are knitted in each row, and an alternating stitch-no stitch structure on the other needle bed. It is exactly this stitch-no stitch alternation which achieves a sponge effect on the side of the fabric corresponding to the beds where alternating stitches are present (i.e. on the opposite side to the needle bed where knitting is always produced).

In a further description of the embodiment, it can be stated that the jacquard bars are moved in such a way as to realise, in a predetermined sequence of two successive rows of knitting and for needles corresponding to the first and second needle beds:

on one from between the first and second needle beds, a stitch in each of the two respective half-rows of knitting of the one from between the first and second needle beds;

on the other needle bed, a knitted stitch in one of the two respective half-rows of knitting of the other needle bed and no stitch in the other half-row of the two respective half-rows of knitting of the other needle bed;

this is so as to realise at least a portion of knitted article having a sponge effect on the other of the needle beds.

Note that the process realising this type of sponge effect includes only assigning successive stitches (or lack of stitches) to the two needle beds: this is regardless of which jacquard bars actually supply the thread to the two needle beds. In essence, each of the stitches made on the first or on the second needle bed is produced by one or more threads carried by any one of jacquard bars, according to the combination between the base to movement and position of the individual thread guides.

FIG. 27 is a diagram of an example of programming of jacquard bars of a linear knitting machine for carrying out a process in accordance with the embodiment described above, i.e. to realize a portion with a sponge effect.

By way of example, this diagram shows a selection, for each powered thread guide, of the respective stitches to be knitted for each half-row of knitting: the example shows thirty adjacent needles for each needle bed, and the knitting processing to be done has a length of 54 rows of knitting. In practice, the portion of the knitted article produced with the following example has an area of 30 to 54 rows of knitting needles. In this case too (as for the example of FIG. 18) the knitting stitches selected for each thread guide, and for each half-row of knitting, are selected—for each jacquard bar—from among the possible knitting stitches illustrated in FIGS. 10-13. All of the preceding is achieved without ever changing the base movement (in this example the base movement of FIG. 2, with stitches of the closed type).

The programming pattern of the bars of FIG. 27 enables providing a letter "N" in the colour black with a sponge effect on the front side of the fabric, with a sharp white background.

FIGS. 28, 29, 30 and 31 show, by way of photographs, some examples of real knitted articles produced by means of the process of the present invention. In particular:

FIG. 28 shows a portion of a shoe upper obtained with the process of the present invention, in particular a front portion of the upper is visible;

FIG. 29 shows a lateral portion of an upper of the shoe obtained with the process of the present invention; in particular, note in particular the presence of logos and writing with sharp and defined edges obtained by the process of the present invention;

FIG. 30 shows a portion of a knitted article manufactured with the process of the present invention, which includes a mixture of letters written with sponge effect on a sharp white background. The sponge shown in this figure is of the type obtained by means of four jacquard bars, black and white threads and with the bottom bar;

FIG. 31 shows, by way of example, an entire sheet of fabric made by a knitting machine for linear warp knitting using the process of the present invention, as it exits from the machine. In the photographic example, this sheet, consisting of successive rows of knitting, is made up of a horizontal series of shoe uppers adjacent to one another (to form series of five uppers). Each portion corresponds to an upper and is then cut to fit a respective shoe. From this figure it can be seen how the process of the present invention enables simultaneous production of a plurality of textile articles (in this case uppers), each separate and having its own characteristics. In the figure, the uppers contained in the cloth are, by way of example, identical to one another, but they can also be different in terms of size, textile effects, type of thread, etc.

By way of example, FIG. 32 shows a further programming pattern of the jacquard bars of a linear knitting machine for the carrying out of a process in accordance with an embodiment of the present invention. This pattern is similar to the patterns of FIGS. 18 and 27 and in this case shows, by way of example, a selection of knitting stitches for obtaining a portion of fabric with sponge effect and with defined edges, on a background which also exhibits a sponge effect (of different colour). In essence, this embodiment shows a "sponge on sponge" effect, i.e. a graphic with sponge effect (the letter "N" in black) on a background also with sponge effect (white). The actual result of the application of the scheme of FIG. 32 is shown, with a photograph, in FIG. 33.

All the figures used by way of example and described above highlight how the process of the present invention enables obtaining knitted articles characterized by a variety of different effects textile simultaneously present in a same row. For each row of knitting, without changing the basic movement but only by combining the base movement according to a particular jacquard selection of the thread guides, it is possible to select any type of stitch to be knitted (from among the plurality of stitches described above and illustrated in FIGS. 10-17), combining them to form different effects on each portion of the knitted article produced.

The figures illustrate knitting effects (realised on a same row) such as sharp colour (white and black in the figures), graphic elements with shapes and edges well defined, checked, holes, portions having different densities, and so on.

In the following a further embodiment of the process is described according to the present invention, with reference to FIGS. 34-40.

In this embodiment, in the base movement of the jacquard bars, the first jacquard bar, the second jacquard bar, the third jacquard bar and the fourth jacquard bar are all moved with a shog movement identical to one another and simultaneously on a same bed of the beds (i.e. all four bars are "in phase" with one another).

This is represented schematically in FIGS. 34 and 34A, where it can be observed that the shog movement of the four bars is identical to and synchronised on a cycle of two rows of knitting. In greater detail, the jacquard bars are moved so that, in a predetermined sequence:

- in a first half-row of knitting, corresponding passive thread guides of the first 1F and third jacquard bar 3B produce a first stitch at a respective first needle (N1F) of the first bed and corresponding passive thread guides of the second 2F and the fourth jacquard bar 4B produce a second knitting stitch at a respective second needle (N2F) of the first bed, adjacent to the first needle of the first bed;
- in a second half-row of knitting, the corresponding passive thread guides of the first and third jacquard bars produce a third knitting stitch at a respective first needle (N1B) of the second bed, corresponding in position to the first needle of the first bed, and the corresponding passive thread guides of the second and fourth jacquard bars produce a fourth knitting stitch at a respective second needle (N2B) of the second bed, corresponding in position to the second needle of the first bed;
- in a third half-row of knitting, the corresponding passive thread guides of the first and the third jacquard bar produce a fifth knitting stitch at the second needle (N2F) of the first bed, and the corresponding passive thread guides of the second and the fourth jacquard bar produce a sixth knitting stitch at a respective third needle (N3F) of the first bed, adjacent to the second needle (N2F) of the first bed and on opposite sides with respect to the first needle (N1F) of the first bed;
- in a fourth half-row of knitting, the corresponding passive thread guides of the first and the third jacquard bar produce a seventh knitting stitch at the second needle (N2B) of the second bed, and the corresponding passive thread guides of the second and the fourth jacquard bars produce an eighth knitting stitch at a respective third needle (N3B) of the second bed, corresponding in position to the third needle of the first bed.

This predetermined sequence is schematically illustrated in FIGS. 39 and 40, in which the threads are denoted by references (1F, 2F, 3B, 4B) of the respective jacquard bar (to which the thread guide carrying the thread belongs) and in which the needles (N1F, N2F, N3F, N1B, N2B, N3B) are highlighted on which—for each base movement—the eight knitting stitches with two threads each are realized.

As visible in the figures, the base movement is preferably determined by a plurality of iterative repetitions of the predetermined sequence, where each repetition begins, for each passive thread guide, from the same respective first or second needle of the first bed.

In the base movement of this embodiment, the jacquard bars are preferably moved such that the passive thread guides of each bar always form close knitting stitches on the first and the second needle bed at each half-row or row of knitting produced. This condition is shown in FIGS. 34 and 34A, in which it can be observed that each stitch is of the close loop type. Alternatively, in the base movement, still according to this embodiment, the jacquard bars are moved in such a way that the passive thread guides of each bar always form open knitting stitches on the first and on the second needle bed at each half-row or row of knitting produced. This condition is shown in FIGS. 38 and 38A, in which it can be observed that each stitch is open loop type. The patterns of FIGS. 38 and 38A are entirely equivalent, at a base movement level, to the patterns of FIGS. 34 and 34A: there is still equality and synchronism of the base movements in the four jacquard bars, and further the needles involved by the knitting stitches are the same as has already been illustrated. The difference lies in the production of open type knitting stitches.

In accordance with the embodiment illustrated in FIGS. 34 and 34A, the first jacquard bar and the third jacquard bar are preferably moved in such a way that each passive odd thread guide of the jacquard bars actuates the above-mentioned predetermined sequence at: a first needle of the first bed, a first needle of the second bed, a second needle of the first bed, adjacent and displaced in a first direction with respect to the first needle of the first bed, and a second needle of the second bed, adjacent and displaced in the first direction with respect to the first needle of the second bed. The second jacquard bar and the fourth jacquard bar are instead moved in such a way that each even passive thread guide of the jacquard bars actuates the above predetermined sequence at: a second needle of the first bed, a second needle of the second bed, a third needle of the first bed, adjacent and displaced in the first direction with respect to the second needle of the first bed, and a third needle of the second bed, adjacent and displaced in the first direction with respect to the second needle of the second bed.

In this embodiment too, the base movement comprises a base half-movement in which, at least at a first half-row of knitting and the first needle bed, each of the first and third jacquard bar produces, by means of the respective jacquard thread guides which remain passive in the same position, a respective knitting stitch on respective even or odd needles, alternative with needles, odd or even, on which respective knitting stitches are formed by each of the second and fourth jacquard bars, by means of the respective jacquard thread guides which remain passive in the same position. The respective alternated needles, on which the knitting stitches of the first half-row of knitting are formed, are the same alternative needles, even or odd, for corresponding passive thread guides in the first and the third jacquard bar, and the respective alternated needles, odd or even, on which the knitting stitches of the first half-row of knitting are formed are the same alternated needles, odd or even, for passive corresponding thread guides in the second and fourth jacquard bar. The above-mentioned base half-movement is repeated at least at two half-rows directly following on the first and the second needle bed.

In this case the knitting structure produced, as can be seen in FIGS. 39 and 40, comprises knitting stitches with two threads (coming from the first and third jacquard bar or from the second and fourth jacquard bar) on each of the needles of the two beds, and there are no needles present which do not realise stitches; this in consideration of a group of corresponding passive thread guides on the four jacquard bars.

Describing the embodiment of FIGS. 34 and 34A in a further way, it can be said that the base movement comprises following operating steps:

simultaneously producing, by means of first passive odd thread guides in the same position and corresponding to one another in the first and the third jacquard bar, a first knitting stitch with two threads at a same first needle of the first needle bed, and simultaneously producing, with first passive even thread guides in the same position and corresponding to one another in the second and the fourth jacquard bar, a second knitting stitch with two threads at a same second needle of the first needle bed, adjacent to the first needle of the first bed;

successively, simultaneously producing, by means of the first passive odd thread guides in the same position and corresponding to one another in the first and the third jacquard bar, a third knitting stitch with two rows at a same first needle of the second needle bed, corresponding in position to the first needle of the first bed, and simultaneously producing, by means of the first passive even thread guides in the same position and corresponding to one another in the second and the fourth jacquard bar a fourth knitting stitch with two thread guides at a same second needle of the second needle bed, corresponding in position to the second needle of the first bed;

successively simultaneously producing, by means of the first passive odd thread guides in the same position and corresponding to one another in first and third jacquard bar, a fifth knitting stitch with two rows at the second needle of the first bed, and simultaneously producing, by means of the first passive even thread guides in the same position and corresponding to one another in the second and the fourth jacquard bar, a sixth knitting stitch with two threads at a respective third needle of the first bed, adjacent to the second needle of the first bed and on an opposite side with respect to the first needle of the first bed, and;

thereafter, simultaneously producing, by means of the first passive odd thread guides in the same position and corresponding to one another in the first and the third jacquard bar, a seventh knitting stitch with two rows at the second needle of the second bed, and simultaneously producing, by means of the first passive even thread guides in the same position and corresponding to one another in the second and the fourth jacquard bar, an eighth knitting stitch with two threads at a respective third needle of the second bed, corresponding in position to the third needle of the first bed and adjacent to the second needle of the second bed on an opposite side with respect to the first needle of the second bed.

Jacquard movements following the same modalities described above can be associated to the base movement described by way of example in FIGS. 34 and 34A, so as to obtain a variety of different knitting stitches.

In particular, in order to exploit to a maximum the knitting potential of the process of the present invention, the process can comprise the step of activating, during the base movement which includes moving the four jacquard bars all with an identical shog movement and simultaneously on a same bed, a plurality of jacquard thread guides, carrying out corresponding individual displacements of a needle space of the plurality of jacquard thread guides, so as to selectively modify a base structure of the portion of knitted article by realising differentiated stitches and structures, deriving from a combination of the base movement of the jacquard bars and the individual movements of the single active jacquard thread guides, in addition to or in subtraction from the shog movements of the jacquard bars.

In substance, in this case too, the process includes selecting, according to knitting needs and the characteristics which are to be obtained for the fabric produced, a plurality of single jacquard movements of a plurality of thread guides: the jacquard selection of single thread guides adds to the base movement of FIGS. 34 and 34A, modifying it at the end so as to obtain a plurality of different knitting stitches and therefore a plurality of knitting effects on the article produced. With a jacquard selection of the thread guides associated to the base movement, it is possible to obtain a plurality of different knitting stitches for each needle of the beds and for each row of knitting.

The step of jacquard selection summable to the base movement of FIGS. 34 and 34A can be illustrated by newly making reference to FIGS. 10 and 11.

In this case, FIG. 10 is combinable identically to the first jacquard bar 1F: this bar can carry out any one of 29 knitting stitches (close) shown in the figure, by means of a specific jacquard selection combined with the respective base movement.

Likewise, FIG. 11 is combinable identically with the third jacquard bar 3B: this bar can carry out any one of the 29 knitting stitches (close) shown in the figure, by means of a specific jacquard selection combined with the respective base movement.

FIG. 10, with an increase of a unit on the numbering of the needles (located above each knitting stitch)—for each of the 29 knitting stitches—is also combinable with the second jacquard bar 2F; the result is equivalent to algebraically summing a unit to the numbering of the needles. The second bar 2F can therefore carry out any one of the 29 knitting stitches (close) of FIG. 10, translated by a needle towards the left.

FIG. 11, with an increase by a unit on the numbering of the needles (located above each knitting stitch)—for each of the 29 knitting stitches—is also combinable with the fourth jacquard bar 4B; the result is equivalent to algebraically summing a unit to the numbering of the needles. The fourth bar 4B can therefore carry out any one of the 29 knitting stitches (close) of FIG. 11, translated by a needle towards the left.

In substance, the extended set of knitting stitches realisable as desired on a same row of knitting, without ever modifying the base movement, is applicable also to the base movement of FIGS. 34 and 34A.

As described above, FIGS. 38 and 38A illustrate a like base movement, with the difference that the jacquard bars are moved in such a way that the passive thread guides of each bar always form open knitting stitches on the first and on the second needle bed at each half-row or row of knitting produced.

In this case, the jacquard selecting step summable to the base movement of FIGS. 38 and 38A can be illustrated by newly making reference to FIGS. 14 and 15.

In this case, FIG. 14 is combinable identically to the first jacquard bar 1F: this bar can carry out any one of the 29 knitting stitches (open) shown in the figure, by means of a specific jacquard selection combined with the respective base movement.

Likewise, FIG. 15 is combinable identically to the third jacquard bar 3B: this bar can carry out any one of the 29 knitting stitches (open) shown in the figure, by means of a specific jacquard selection combined with the respective base movement.

FIG. 14, with an increase by a unit of the numbering of the needles (located above each knitting stitch)—for each of the 29 knitting stitches—is also combinable with the second jacquard bar 2F; the result is equivalent to algebraically summing a unit to the numbering of the needles. The second bar 2F can therefore carry out any one of 29 knitting stitches (open) of FIG. 14, translated by a needle towards the left.

FIG. 15, with an increase by a unit on the numbering of the needles (located above each kitting stitch)—for each of the 29 knitting stitches—is also combinable with the fourth jacquard bar 4B; the result is equivalent to algebraically summing a unit to the numbering of the needles. The fourth bar 4B can therefore carry out any one of 29 knitting stitches (open) of FIG. 15, translated by a needle towards the left.

In substance, the extended set of knitting stitches realizable as desired on a same row of knitting, without modifying the base movement, is applicable also to the base movement of FIGS. 38 and 38A.

An example of how the knitting stitches are obtained starting from the base movement of FIGS. 34 and 34A and "summing" the jacquard selection is shown in FIGS. 36 and 37.

In FIG. 36, on the left, the base movement of the first jacquard bar 1F is illustrated as in FIG. 34 (close stitches) for a thread guide. On the right are four knitting stitches, by way of example, selected from among the 29 stitches of FIG. 10. Below each of the four stitches are illustrated the changes of state of the jacquard thread guide (from OFF to ON by means of ticking "v") for each half-row of knitting, which cause the base movement to change, obtaining the respective knitting stitch represented. In the four figures, on the right of the base movement a continuous line represents the specific knitting stitch, and a broken line the original base movement.

FIG. 37 illustrates, on the left, the base movement of the fourth jacquard bar 4B as in FIG. 34 (close stitches), for a thread guide. On the right are four knitting stitches, by way of example, selected from among the 29 stitches of FIG. 11. Below each of the four stitches are illustrated the changes of state of the jacquard thread guide (from OFF to ON by means of ticking "v") for each half-row of knitting, which cause the base movement to change, obtaining the respective knitting stitch represented.

A further application of the jacquard selection at the base movement of FIGS. 34 and 34A is shown by way of example in FIG. 35: in this case it can be observed that the thread guides of the third and the fourth jacquard bar are in the activation position for the whole base movement (two rows of knitting). The result is a translation (towards the left in the figure) of the base movement for both the bars.

The definitive difference between the base movement of FIGS. 2 and 2A and the base movement of the FIGS. 34 and 34A lies in the fact that although in both cases the first and third jacquard bars have a same shog movement and the second and the fourth jacquard bar have a same respective shog movement:

- in the base movement of FIGS. 2 and 2A, the shog movement of the first and the third jacquard bar is carried out in phase opposition, i.e. in an identical and opposite way, with respect to the shog movement of the second and the fourth jacquard bar;
- in the base movement of FIGS. 34 and 34A, the shog movement of the first and the third jacquard bar is not in phase opposition with respect to the shog movement of the second and the fourth jacquard bar and, on the contrary, the shog movements of the first-third bar and second-fourth bars are identical to one another.

The process of the present invention, in any one of the embodiments thereof, can enable realising a wide variety of knitted articles, among which, by way of non-limiting example, for example: shoe uppers, scarves, portions of items of male clothing, portions of underwear, portions of socks, hats, blankets, fabric claddings, mattress covers, towels, bathroom linen items, curtains, sheets of fabric, bags and so on.

The present invention definitively relates to a process for production of knitted articles, which is based on a novel system of base movements of the jacquard bars, which in combination with the movement of the jacquard thread guides enables obtaining a large number of knit meshes, all in the same row and always and only with the same base movement.

FIGS. 2, 2A, 22 and 22A schematically illustrate base movements according to the present invention.

The new process is destined to be implemented on a knitting machine for warp knitting, of a double-bed Raschel type, provided with four jacquard bars able to move independently of one another, a thread supply system of the thread for the jacquard thread guides by means of creels, and a control of the tension of each single thread (coming from the creels) by means of single levers elastically bendable so as to harmonise the various consumptions of thread required by the various knitting stitches.

The base movement of the present invention is characterised by a sequence of knitting stitches having a size of two rows of knitting and in which the knitting stitches are produced alternatively on the needles of the front bed and on the needles of the back bed. In substance, the base movement has a knitting length of two rows of knitting, cyclically repeated, independently of the half-row considered as a start point of the base movement. The base movements shown schematically in FIGS. 2 and 2A are in this sense equivalent: the base movement of FIG. 2A is obtainable by translating by a half-row of knitting the base movement of FIG. 2. This concept is clarified in FIG. 9, which shows the base movement for a plurality of rows of knitting: in this pattern it is possible to "isolate" single cycles of base movement, retrieving, according to the half-row of knitting considered as a start, the pattern of FIG. 2 or FIG. 2A.

In the base movement of the jacquard bars, each bar knits on the front bed and the rear bed, as shown by way of example in FIGS. 2 and 2A. Further, the two jacquard bars located at the front bed move in phase opposition between them, and the two jacquard bars located at the back bed move in phase opposition between them.

Starting from the base movement, for example, of FIG. 2, simply by activating the jacquard thread guides (FIG. 5) of a pair of jacquard bars (for example moving from OFF to ON configuration the thread guides of the two jacquard bars located at the back bed) a linked fabric having white and black checks is obtained, considering for example the two jacquard bars of the front bed supplied with white threads and the two jacquard bars of the back bed supplied with black threads (FIG. 6). To clarify the above concept, if the two bars of the front bed are threaded with white thread and the two bars of the back bed are threaded with black thread, in order to obtain, on the front bed, only the colour white it is necessary to prevent the lapping of the black on the front bed, and vice versa if it is desired to obtain, on the front bed, only the colour black, it is necessary to prevent the lapping of the white on the back bed.

The original base movement according to the present invention enables all the needles to knit; if it is not intended to produce knitting on a determined needle (which in the base movement is included), it is necessary to prevent the jacquard thread guide from performing the lapping turn on that needle; this is done by modifying the state of the thread guide, for example from OFF to ON. Vice versa, if it is intended to create knitting on a determined needle (which in the base movement was not intended), it is necessary for the jacquard thread guide to perform a lapping on the needle; in this case too this is obtained by modifying the state of the thread guide, from example from ON to OFF.

By exploiting the functioning principle of the jacquard it is possible to sum (algebraically) to the base movement of the jacquard bars the movements of the jacquard thread guides, obtaining a very large number of different knitting stitches.

For example, by associating to a thread guide in OFF position value 0, and in ON position value 1, the native value 0 of the jacquard bar is transformed into 1 on a specific needle if the thread guide changes state, passing from OFF to ON, i.e. 0+1=1 (and likewise also −1+1=0 or 1+1=2, etc.).

By means of the jacquard selection it is possible to decide whether to displace or not displace a thread guide from one position to another, for example from OFF to ON, by performing a translation by a needle step, and therefore obtaining the positioning of the thread guide into the desired position, by moving or not the same thread guide in a lapping about the needle. The changing of the state of the thread guide can take place either when the thread guide is about to perform the UNDERLAP SHOG (behind the needle tip) or when the thread guide is about to perform the OVERLAP SHOG (in front of the needle tip). Starting from the base configuration, with all the levers in OFF in each SHOG position, whether UNDERLAP or OVERLAP, it is possible to change the state of the single levers from OFF to ON, which corresponds to increasing by one (SHIFT) the base position and from ON to OFF, which corresponds to the resetting of the single levers to the base position.

To sum up:

- the thread guide does not change state, i.e. it maintains the last position previously assumed (0 remains 0, 1 remains 1, etc.), or
- the thread guide changes state, i.e. it changes the last position previously assumed, i.e. it "shifts" by one (example: from 0 to 1 or from 1 to 0, but also from 1 to 2, from 2 to 1, from −1 to 0 and from 0 to −1).

The invention as it is conceived is susceptible to numerous modifications and variants, all falling within the scope of the invention, and the cited components are replaceable by other technically-equivalent elements. The invention attains important advantages. Primarily all the invention enables obviated at least some of the drawbacks of the prior art.

Further, the process of the present invention enables combining, in a novel and effective way, specific base movements of the jacquard bars with the jacquard selection of the single thread guides, so as to obtain a multiplicity of knitting stitches realizable at a same time on each row of knitting, without limits for the type and number of stitches selected, for each row of knitting and for each jacquard bar, among the multiplicity of stitches, and without having to modify the base movement. In substance, the present invention enables combining to a base movement of the jacquard bars, continuously performed by the knitting machine, a wide set of knitting stitches attributable, for each row of knitting, to each single thread guide of each of the bars; this enables obtaining, simply and rapidly, a multiplicity of knitting effects, also combinable on a same knitted article.

The process of the present invention enables producing knitted articles having characteristics such as sharpness of colours, thickness, dimensional stability, possibility of presenting areas with different air permeability, laddering resistance and other characteristics which can make the product resistant, pleasant to view and at the same time comfortable to use.

Further, the process of the present invention enables increasing the knitting possibilities offered by a warp linear knitting machine and realising jacquard motifs that are more complete and complex with respect to the prior art. Further, the process of the present invention enables realizing and combining, simply and rapidly, a plurality of different knitting effects for each row of knitting produced.

Further, the process of the present invention enables operating efficiently at all gauges (in particular at high gauges) and operating at full gauge (using all the needles) on a warp linear knitting machine.

Further, the process of the present invention enables producing knitted articles characterised by high quality and uniformity.

Further, the process of the present invention enables producing knitted articles efficiently and continuatively, including at high speed.

The invention claimed is:

1. A process for production of knitted articles comprising at least steps of:

predisposing a linear knitting machine for warp knitting, of a double-bed raschel type, comprising:

a bearing structure, knitting elements mounted on the bearing structure and comprising a first needle bed having a first plurality of needles aligned with one another, and a second needle bed having a second plurality of needles aligned with one another;

a first jacquard bar provided with a plurality of odd jacquard-type thread-guides configured for selectively supplying threads to the needles of the needle beds;

a second jacquard bar provided with a plurality of even jacquard-type thread-guides configured for selectively supplying threads to the needles of the needle beds;

a third jacquard bar provided with a plurality of odd jacquard-type thread-guides configured for selectively supplying threads to the needles of the needle beds;

a fourth jacquard bar provided with a plurality of even jacquard-type thread-guides configured for selectively supplying threads to the needles of the needle beds;

wherein each of the odd and even jacquard-type thread-guides is individually and selectively mobile, by means of a corresponding jacquard-activation element, between a base position and an activation position, displaced by a needle space with respect to the base position, and wherein each of the jacquard bars is configured to carry out a respective linear shog movement, frontally and posteriorly to tips of the needles of the needle beds, and a respective oscillating swing movement, substantially perpendicular to and substantially alternated with the respective shog movement and carried out by sides of the needles of the needle beds so as to bring the threads alternatively in front of and behind the tips of the needles, the shog movement and the swing movement enabling production of at least a knitted article on the needle beds; and producing at least a portion of the knitted article by means of a base movement of the jacquard bars, wherein:

the first jacquard bar, the second jacquard bar, the third jacquard bar and the fourth jacquard bar are moved, in each knitting row, so as to operate alternatively at the first needle bed and the second needle bed;

the first jacquard bar and the third jacquard bar are moved simultaneously with a shog movement identical to one another on a same bed of the needle beds; and the second jacquard bar and the fourth jacquard bar are moved simultaneously with a respective shog movement identical to one another on a same bed of the needle beds.

2. The process of claim 1, wherein in the base movement of the jacquard bars, the shog movement of the first jacquard bar and the third jacquard bar is carried out in phase opposition with respect to the shog movement of the second jacquard bar and the fourth jacquard bar, or wherein the first jacquard bar, the second jacquard bar, the third jacquard bar and the fourth jacquard bar are all moved simultaneously at a same bed of the needle beds.

3. The process of claim 1, wherein in the base movement, the jacquard bars are moved such that each passive thread-guide of each jacquard bar produces, in a predetermined sequence:

in a first half-row of knitting, a first stitch at a respective first needle of the first needle bed, in a second half-row of knitting, a second stitch at a respective first needle of the second needle bed, corresponding in position to the first needle of the first needle bed, in a third half-row of knitting, a third stitch at a respective second needle of the first needle bed, adjacent to the first needle of the first needle bed, in a fourth half-row of knitting, a fourth stitch at a respective second needle of the second needle bed, adjacent to the first needle of the second needle bed;

wherein the base movement is determined by a plurality of iterative repetitions of the predetermined sequence, each repetition for each passive thread-guide starting from a same respective first needle of the first needle bed;

or wherein in the base movement, the first jacquard bar and the third jacquard bar are moved in such a way that each odd passive thread-guide of the first and third jacquard bars actuates the predetermined sequence at the respective: first needle of the first needle bed, first needle of the second needle bed, second needle of the first needle bed, adjacent and displaced in a first direction with respect to the first needle of the first needle bed, and second needle of the second needle bed, adjacent and displaced in the first direction with respect to the first needle of the second needle bed, and wherein the second jacquard bar and the fourth jacquard bar are moved so that each even passive thread-guide of the second and fourth jacquard bars actuates the predetermined sequence at the respective: first needle of the first needle bed, first needle of the second needle bed, further second needle of the first needle bed, adjacent and displaced in a second direction, opposite to the first direction, with respect to the first needle of the first needle bed, and further second needle of the second needle bed, adjacent and displaced in the second direction with respect to the first needle of the second needle bed.

4. The process of claim 1, wherein the base movement comprises a base semi-movement in which each of the jacquard bars produces, by means of the respective jacquard-type thread-guides that remain passive, at least at a first half-row of knitting and at the first needle bed, a respective stitch on respective even or odd needles, alternated with needles, odd or even, on which stitches are not formed, or wherein the respective alternated needles, even or odd, on which the stiches of the first half-row of knitting are formed are same alternated needles, even or odd, at least for corresponding passive thread-guides in the first and the third jacquard bars or for corresponding passive thread-guides in the second and fourth jacquard bars, or wherein the process comprises a step of repeating the base semi-movement at least at two directly successive half-rows on the first and second needle beds.

5. The process of claim 1, wherein the base movement of the jacquard bars is carried out in such a way that for passive thread-guides in a same position of each jacquard bar, at formation of at least a stitch or at least a half-row of knitting, or at a plurality of consecutive stitches or a plurality of consecutive half-rows of knitting, the first and the third jacquard bars supply threads and produce, by means of respective odd passive thread-guides and reciprocally corresponding to one another in the first and third jacquard bars, stitches realized at same needles of one of the needle beds or at same needles on both the needle beds, and wherein the second and the fourth jacquard bars supply threads and produce, by means of respective even passive thread-guides and reciprocally corresponding in position in the second and the fourth jacquard bars, stitches realized at same needles of one of the needle beds or sequentially at the same needles on both of the needle beds.

6. The process of claim 1, wherein the base movement of the jacquard bars is carried out in such a way that for passive thread-guides in a same position of each jacquard bar, at formation of at least a stitch or at least a half-row of knitting, or at a plurality of consecutive stitches or a plurality of half-rows of knitting, all of the jacquard bars supply threads and produce, by means of respective odd and even thread-guides, passive and corresponding to one another, stitches at same needles of one of the needle beds, or sequentially at same needles on both of the needle beds.

7. The process of claim 1, wherein the base movement comprises the following operating steps:

simultaneously producing, by means of first odd passive thread-guides in a same position and reciprocally corresponding in the first and third jacquard bars and by means of first even passive thread-guides in the same position and reciprocally corresponding in the second and in the fourth jacquard bars, a first stitch with four threads at a same first needle of the first needle bed;

subsequently simultaneously producing, by means of the first odd passive thread-guides in the same position and reciprocally corresponding in the first and the third jacquard bars and by means of the first even passive thread-guides in the same position and reciprocally corresponding in the second and the fourth jacquard bars, a second stitch with four threads at a same first needle of the second needle bed, corresponding to the first needle of the first needle bed;

subsequent to producing the second stitch, simultaneously producing, by means of the first odd passive thread-guides in the same position and reciprocally corresponding in the first and the third jacquard bars, and by means of second even passive thread-guides in the same position and reciprocally corresponding in the second and fourth jacquard bars and adjacent and displaced in a first direction with respect to the first even passive thread-guides, a third stitch with four threads at a same second needle of the first needle bed adjacent and displaced in the first direction with respect to the first needle of the first needle bed; and subsequent to producing the third stitch, simultaneously producing, by means of the first odd passive thread-guides in the same position and reciprocally corresponding in the first and the third jacquard bars, and by means of the second even passive thread-guides in the same position and reciprocally corresponding in the second and the fourth jacquard bars and adjacent and displaced in a first direction with respect to the first even passive thread-guides, a fourth stitch with four threads at a same second needle of the second needle bed adjacent and displaced in the first direction with respect to the first needle of the second needle bed and corresponding to the second needle of the first needle bed;

wherein the base movement comprises an iterative repetition of the operating steps or wherein the operating steps are carried out for all of the passive jacquard-type thread-guides of the jacquard bars.

8. The process of claim 1, wherein in the base movement of the jacquard bars the first jacquard bar, the second jacquard bar, the third jacquard bar and the fourth jacquard bar are moved with a shog movement that is identical to one another and simultaneously on a same bed of the first and second needle beds.

9. The process of claim 8, wherein in the base movement, the jacquard bars are moved in such a way as to produce, in a predetermined sequence:

in a first half-row of knitting, corresponding passive thread-guides of the first and the third jacquard bars producing a first stitch at a respective first needle of the first needle bed and corresponding passive thread-guides of the second and fourth jacquard bars producing a second stitch at a respective second needle of the first needle bed, adjacent to the first needle of the first needle bed;

in a second half-row of knitting, the corresponding passive thread-guides of the first and third jacquard bars producing a third stitch at a respective first needle of the second needle bed, corresponding in position to the first needle of the first needle bed, and the corresponding passive thread-guides of the second and fourth jacquard bars producing a fourth stitch at a respective second needle of the second needle bed, corresponding in position to the second needle of the first needle bed;

in a third half-row of knitting, the corresponding passive thread-guides of the first and the third jacquard bars producing a fifth stitch at the second needle of the first needle bed, and the corresponding passive thread-guides of the second and the fourth jacquard bars producing a sixth stitch at a respective third needle of the first needle bed, adjacent to the second needle of the first needle bed and on an opposite side with respect to the first needle of the first needle bed;

in a fourth half-row of knitting, the corresponding passive thread-guides of the first and third jacquard bars producing a seventh stitch at the second needle of the second needle bed, and the corresponding passive thread-guides of the second and the fourth jacquard bars producing an eighth stitch at a respective third needle of the second needle bed, corresponding in position to the third needle of the first needle bed;

and wherein the base movement is determined by a plurality of iterative movements of the predetermined sequence, each repetition beginning for each passive thread-guide from a same respective first or second needle of the first needle bed;

or wherein in the base movement, the first jacquard bar and the third jacquard bar are moved such that each odd passive thread-guide of the jacquard bars actuates the predetermined sequence at the respective: first needle of the first needle bed, first needle of the second needle bed, second needle of the first needle bed, adjacent and displaced in a first direction with respect to the first needle of the first needle bed, and second needle of the second needle bed, adjacent and displaced in the first direction with respect to the first needle of the second needle bed, and wherein the second jacquard bar and the fourth jacquard bar are moved so that each even passive thread-guide of the jacquard bars actuates the predetermined sequence at the respective: second needle of the first needle bed, second needle of the second needle bed, third needle of the first needle bed, adjacent and displaced in the first direction with respect to the second needle of the first needle bed, and third needle of the second needle bed, adjacent and displaced in the first direction with respect to the second needle of the second needle bed.

10. The process of claim 8, wherein the base movement comprises a base semi-movement in which, at least at a first half-row of knitting and at the first needle bed, each of the first and third jacquard bars produces, by means of the respective jacquard-type thread-guides which remain passive in a same position, a respective stitch on respective even or odd needles, alternated with needles, odd or even, on which respective stitches are formed by each of the second and fourth jacquard bars, by means of the respective jacquard-type thread-guides which are passive in the same position, or wherein the respective even or odd alternated needles, on which the stitches are formed in the first half-row of knitting, are the same alternated needles, even or odd, for corresponding passive thread-guides in the first and the third jacquard bars, and the respective alternated odd or even needles, on which the stitches in the first half-row of knitting are formed, are the same odd or even alternated needles, for corresponding passive thread-guides in the second and fourth jacquard bars, wherein the process comprises a step of repeating the base semi-movement at least at two directly successive half-rows on the first and on the second needle beds.

11. The process of claim 8, wherein the base movement comprises the following operating steps:

simultaneously producing, by means of first odd passive thread-guides in a same position and reciprocally corresponding in the first and third jacquard bars, a first stitch with two threads at a same first needle of the first needle bed, and simultaneously producing, by means of first even passive thread-guides in the same position and reciprocally corresponding in the second and in the fourth jacquard bars, a second stitch with two threads at a same second needle of the first needle bed, adjacent to the first needle of the first needle bed;

subsequently simultaneously producing, by means of the first odd passive thread-guides in the same position and reciprocally corresponding in the first and the third jacquard bars, a third stitch with two rows at a same first needle of the second needle bed, corresponding in position to said first needle of the first needle bed, and simultaneously producing, by means of the first even passive thread-guides in the same position and reciprocally corresponding in the second and the fourth jacquard bars, a fourth stitch with two threads at a same second needle of the second needle bed, corresponding in position to the second needle of the first needle bed;

after producing the third and fourth stitches, simultaneously producing, by means of the first odd passive thread-guides in the same position and reciprocally corresponding in the first and the third jacquard bars, a fifth stitch with two threads at the second needle of the first needle bed, and simultaneously producing, by means of the first even passive thread-guides in the same position and reciprocally corresponding in the second and the fourth jacquard bars, a sixth stitch with two threads at a respective third needle of the first needle bed, adjacent to the second needle of the first needle bed and on an opposite side with respect to the first needle of the first needle bed; and after producing the fifth and sixth stitches, simultaneously producing, by means of the first odd passive thread-guides in the same position and reciprocally corresponding in the first and the third jacquard bars, a seventh stitch with two threads at the second needle of the second needle bed, and simultaneously producing, by means of the first even passive thread-guides in the same position and reciprocally corresponding in the second and in the fourth jacquard bars, an eighth stitch with two threads at a respective third needle of the second needle bed, corresponding in position to the third needle of the first needle bed and adjacent to the second needle of the second needle bed on an opposite side with respect to the first needle of the second needle bed;

wherein the base movement comprises an iterative repetition of the operating steps or wherein the operating steps are carried out for all of the passive jacquard-type thread-guides of the jacquard bars.

12. The process of claim 1, wherein in the base movement, the jacquard bars are moved in such a way that passive thread-guides of each jacquard bar always form stitches at each half-knitting row produced, alternatively on the needles of the first needle bed and on the needles of the second needle bed, and wherein the base movement realizes, for each knitting row, a plurality of stitches on needles of the first needle bed and a plurality of stitches on needles of the second needle bed so as to define a double-cloth, or linked, fabric, or wherein the base movement determines, for all of the passive thread-guides of each jacquard bar, the realizing of a stitch on both of the needle beds, for each knitting row, or wherein the base movement defines a productive sequence of stitches carried out alternatively on the first needle bed and on the second needle bed, the productive sequence being cyclically repeated every two rows of knitting.

13. The process of claim 1, wherein in the base movement, the jacquard bars are moved in such a way that passive thread-guides of each jacquard bar always form closed stitches on the first and second needle beds at each half-row or row of knitting produced, or wherein in the base movement, the jacquard bars are moved in such a way that the passive thread-guides of each jacquard bar always form open stitches on the first needle bed and on the second needle bed at each half-row or row of knitting produced.

14. The process of claim 1, wherein the first and the second jacquard bars are arranged at the first needle bed and wherein the third and the fourth jacquard bars are arranged and mounted at the second needle bed, or wherein one of the four jacquard bars having even thread-guides and one of the four jacquard bars having odd thread-guides are arranged and mounted at the first needle bed and wherein a remaining jacquard bar having even thread-guides and a remaining jacquard bar having odd thread-guides are arranged and mounted at the second needle bed, or wherein, in the step of producing at least the portion of the knitted article by means of the base movement of the jacquard bars, all four jacquard bars are moved to carry out a same swing movement, or wherein the first and the second jacquard bars are reciprocally identical and at half-gauge with respect to a gauge of the needle beds, and are in default position, one with respect to the other, offset by one needle space, and the third and the fourth jacquard bars are reciprocally identical and at half-gauge with respect to the gauge of the needle beds, and are in default position, with respect to one another, offset by one needle space.

15. The process of claim 1, further comprising a step of activating, during the base movement of the jacquard bars, a plurality of jacquard-type thread-guides, by carrying out corresponding individual displacements by one needle space of the plurality of jacquard-type thread-guides, so as to selectively modify a base structure of the portion of the knitted article by means of realizing differentiated knitting stitches and structures, deriving from a combination of the base movement of the jacquard bars and individual movements of single active jacquard-type thread-guides, in addition to or in subtraction from the shog movements of the jacquard bars.

16. The process of claim 1, further comprising a step of supplying the first jacquard bar and the second jacquard bar with first threads of a first colour or of a first type and supplying the third jacquard bar and the fourth jacquard bar with second threads of a second colour or of a second type, wherein the process further comprises selectively activating the jacquard-type thread-guides of the jacquard bars in such a way as to realize at least a portion of the knitted article having, on both sides of the knitting, stitches realized with the first and with the second threads or with all of the first and second threads or in such a way as to realize at least a portion of the knitted article having at least a side constituted only by stitches realized only with the first threads or with the second threads or in such a way as to realize at least a portion of the knitted article having both sides only constituted by stitches realized respectively only with the first threads on the first needle bed and only with the second threads on the second needle bed, in such a way as to realize a portion of a fabric comprising two distinct and parallel lengths realized respectively on the first and on the second needle bed, or wherein the process comprises a step of alternating, on a side of the fabric of the knitted article, at least a first portion realized only with stitches realized only with the first threads and at least a second portion realized only by stitches realized only with the second threads or with the first threads and the second threads, so as to define graphic elements, designs or writing on the side of the fabric, clearly-defined and with substantially sharply-defined borders.

17. The process of claim 1, wherein the step of predisposing the linear knitting machine for warp knitting comprises a step of predisposing at least a first bottom bar, arranged at the first needle bed or the second needle bed, and wherein the process comprises a step of realizing, by means of the bottom bar, knitting stitches, chains or non-lapped threads in cooperation with the four jacquard bars such as to realize at least the portion of the knitted article and so as to reinforce a structure of a fabric, or wherein the process comprises a step of realizing stitches, chains or non-lapped threads in cooperation with the four jacquard bars, wherein at least the first and the second jacquard bars or at least the third and the fourth jacquard bars are operating with at least a group of passive jacquard-type thread-guides so as to realize at least the portion of the knitted article with a sponge effect on a needle bed opposite to the bottom bar.

18. The process of claim 16, wherein at least a group of adjacent thread-guides of the first jacquard bar and at least a group of corresponding adjacent thread-guides of the second jacquard bar are in the base position and at least a group of corresponding adjacent thread-guides of the third jacquard bar and at least a group of corresponding adjacent thread-guides of the fourth jacquard bar are in the activation position, or vice versa wherein at least a group of adjacent thread-guides of the first jacquard bar and at least a group of corresponding adjacent thread-guides of the second jacquard bar are in activation position, and at least a group of corresponding adjacent thread-guides of the third jacquard bar and at least a group of corresponding adjacent thread-guides of the fourth jacquard bar are in the base position, such as to realize, at a portion of a fabric realized with the threads borne by the groups of adjacent thread-guides on the jacquard bars, a portion of checked fabric characterised, at least on a side of the fabric, by an alternating of single stitches realized only with the first threads and single stitches realized only with the second threads.

19. The process of claim 1, further comprising a step of supplying each jacquard-type thread-guide of the jacquard bars with a respective thread independently with respect to the other jacquard thread-guides of the knitting machine, wherein the step of predisposing the linear knitting machine for warp knitting comprises a step of predisposing thread supply devices configured for supplying a plurality of threads to the jacquard bars, wherein the thread supply devices comprise at least a creel provided with a plurality of thread-bearing reels singly combined to a respective jacquard-type thread-guide, such that each thread-bearing reel provides, independently with respect to the other thread-bearing reels, a respective quantity of threads to a respective jacquard-type thread-guide on a basis of a thread demand thereof, the creel being configured for compensating for a difference of demand of various threads in view of different stitches realized by various jacquard-type thread-guides of the jacquard bars.

* * * * *